US007396378B2

(12) United States Patent
Sato et al.

(10) Patent No.: US 7,396,378 B2
(45) Date of Patent: Jul. 8, 2008

(54) PROCESS FOR PRODUCING A HIGH CLEANLINESS STEEL

(75) Inventors: Ichiro Sato, Himeji (JP); Kaichiro Ishido, Himeji (JP); Tomomi Mori, Himeji (JP); Toshihiro Irie, Himeji (JP); Kazuya Kodama, Himeji (JP); Kiyoshi Kawakami, Himeji (JP); Shuhei Kitano, Himeji (JP)

(73) Assignee: Sanyo Special Steel Co., Ltd., Himeji (JP)

( * ) Notice: Subject to any disclaimer, the term of this patent is extended or adjusted under 35 U.S.C. 154(b) by 13 days.

(21) Appl. No.: 10/297,313

(22) PCT Filed: Jun. 5, 2001

(86) PCT No.: PCT/JP01/04742

§ 371 (c)(1),
(2), (4) Date: Dec. 4, 2002

(87) PCT Pub. No.: WO01/94648

PCT Pub. Date: Dec. 13, 2001

(65) Prior Publication Data

US 2003/0172773 A1 Sep. 18, 2003

(30) Foreign Application Priority Data

Jun. 5, 2000 (JP) ..... 2000-167085
Jun. 5, 2000 (JP) ..... 2000-167086
Jun. 5, 2000 (JP) ..... 2000-167087
Jun. 5, 2000 (JP) ..... 2000-167088
Jun. 5, 2000 (JP) ..... 2000-167089

(51) Int. Cl.
*C21C 7/06* (2006.01)

(52) U.S. Cl. ..... 75/10.64; 75/508

(58) Field of Classification Search ..... 148/602, 148/654, 661, 333; 75/10.64, 508
See application file for complete search history.

(56) References Cited

U.S. PATENT DOCUMENTS 3,737,302 A * 6/1973 Pomey ..... 75/10.64

(Continued)

FOREIGN PATENT DOCUMENTS

EP 0163784 12/1985

(Continued)

OTHER PUBLICATIONS

Wang Xueyao, "Secondary Metallurgy—Ladle Refining", *Special Steel*, Aug. 1998, vol. 19, No. 4, 9 pp.

*Primary Examiner*—Scott Kastler
(74) *Attorney, Agent, or Firm*—The Webb Law Firm

(57) ABSTRACT

A process for producing a high-cleanliness steel is provided which can produce, without relying upon a high-cost remelting process, steel products having cleanliness high enough to satisfy requirements for properties of mechanical parts used under severe environmental conditions. The production process comprises the steps of: transferring a molten steel produced in an arc melting furnace or a converter to a ladle furnace to refine the molten steel; subjecting the molten steel to circulation-type degassing; and casting the molten steel into an ingot, wherein, in transferring the molten steel to the ladle furnace, a deoxidizer including aluminum and silicon, is added to previously deoxidize the molten steel, that is, to perform tapping deoxidation before refining in the ladle refining furnace.

3 Claims, 24 Drawing Sheets

U.S. PATENT DOCUMENTS

| | | | | |
|---|---|---|---|---|
| 3,761,242 | A * | 9/1973 | Finkl | 75/10.45 |
| 4,152,140 | A | 5/1979 | Hori et al. | |
| 4,544,405 | A | 10/1985 | Glasmeyer et al. | |
| 5,015,287 | A * | 5/1991 | Yamada et al. | 75/10.17 |
| 6,364,968 | B1 * | 4/2002 | Yasuhara et al. | 148/320 |

FOREIGN PATENT DOCUMENTS

| | | | | |
|---|---|---|---|---|
| EP | 0325242 | 7/1989 | | |
| EP | 0548868 | 6/1993 | | |
| GB | 1117005 | 6/1968 | | |
| JP | 62063650 | 3/1987 | | |
| JP | 63096210 | 4/1988 | | |
| JP | 03039412 | 7/1989 | | |
| JP | 02179813 | 7/1990 | | |
| JP | 403183726 | * 8/1991 | | 148/602 |
| JP | 05-331523 | 12/1993 | | |
| JP | 05331523 | 12/1993 | | |
| JP | 06145883 | 5/1994 | | |
| JP | 06192790 | 7/1994 | | |
| JP | 10237533 | 9/1998 | | |
| JP | 11092811 | 4/1999 | | |
| JP | 11194121 | 7/1999 | | |
| JP | 2000129335 | 5/2000 | | |
| JP | 2001064718 | 3/2001 | | |

* cited by examiner

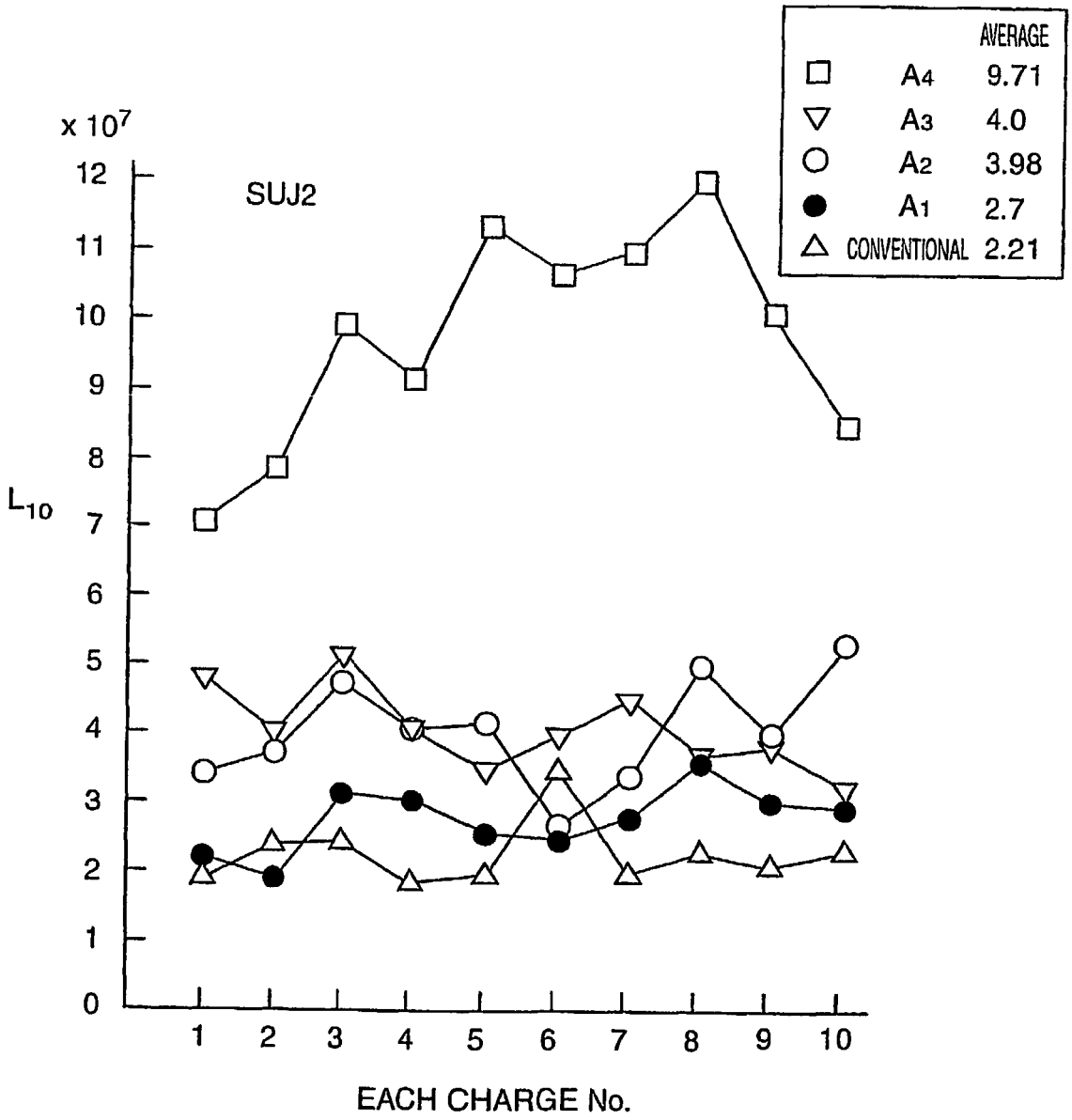
FIG. I E

PROCESS FOR PRODUCING A HIGH CLEANLINESS STEEL

TECHNICAL FIELD

The present invention relates to a high-cleanliness steel for use as steels for mechanical parts required to possess fatigue strength, fatigue life, and quietness, particularly, for example, as steels for rolling bearings, steels for constant velocity joints, steels for gears, steels for continuously variable transmission of toroidal type, steels for mechanical structures for cold forging, tool steels, and spring steels, and a process for producing the same.

Steels for use in mechanical parts required to possess fatigue strength and fatigue life should be high-cleanliness (low content of nonmetallic inclusions in steels) steels. Conventional production processes of these high-cleanliness steels include: (A) oxidizing refining of a molten steel in an arc melting furnace or a converter; (B) reduction refining in a ladle furnace (LF); (C) circulation vacuum degassing in a circulation-type vacuum degassing device (RH) (PH treatment); (D) casting of steel ingots by continuous casting or conventional ingot casting, and (E) working of steel ingots by press forging and heat treatment of steel products. In the process (A), scrap is melted by arc heating, or alternatively, a molten steel is introduced into a converter where oxidizing refining is performed, followed by the transfer of the molten steel to a ladle furnace. The temperature, at which the molten steel is transferred, is generally a high temperature of about 30° C. above to less than 100° C. above the melting point of the steel. In the process (B), a deoxidizer alloy of aluminum, manganese, silicon, etc. is introduced into the ladle furnace, to which the molten steel has been transferred, where reduction refining is carried out by deoxidation and desulfurization with a desulfurizer to regulate the alloying constituents. A generally accepted knowledge is such that the effect increased with increasing the treatment time. In this process, a long time of more than 60 min is adopted, and the treatment temperature is generally 50° C. above the melting point of the steel. In the RH treatment in the process (C), vacuum degassing is carried out in a circulation vacuum degassing tank while circulating the molten steel through the circulation vacuum degassing tank to perform deoxidation and dehydrogenation. In this case, the amount of the molten steel circulated is about 5 to 6 times the total amount of the molten steel. In the process (D), the RH treated molten steel is transferred to a tundish where the molten steel is continuously cast into a bloom, a billet, a slab or the like. Alternatively, the molten steel from the ladle is poured directly into a steel ingot mold to cast a steel ingot. In the process (E), for example, a bloom, a billet, a slab, or a steel ingot is rolled or forged, followed by heat treatment to prepare a steel product which is then shipped.

When steels having a particularly high level of cleanliness are required, in the above process, the cast steel ingot is provided as a raw material which is then subjected to vacuum remelting or electroslag remelting to prepare such steels.

In recent years, mechanical parts have become used under more and more severe conditions. This has lead to more and more severe requirements for properties of steel products, and steel products having a higher level of cleanliness have been required in the art. The above-described conventional production processes (A) to (E), however, are difficult to meet this demand. In order to meet this demand, steel products have been produced by the vacuum remelting or the electroslag remelting. These methods, however, pose a problem of significantly increased production cost.

Under these circumstances, the present invention has been made, and it is an object of the present invention to provide steel products having a high level of cleanliness without relying upon the remelting process.

DISCLOSURE OF THE INVENTION

The present inventors have made extensive and intensive studies on the production process of high-cleanliness steels with a view to attaining the above object. As a result, they have found the cleanliness of steels can be significantly improved by the following processes.

First Invention

Means of the present invention for solving the above problems of the prior art will be described. In the conventional process using a refining furnace, such as an arc melting furnace or a converter, melting and oxidizing refining are mainly carried out, for example, in the arc melting furnace or the converter, and the reduction period (deoxidation) is carried out in ladle refining. On the other hand, the first invention is directed to a process for producing a high-cleanliness steel, comprising the steps of: transferring a molten steel produced in an arc melting furnace or a converter to a ladle furnace to refine the molten steel; degassing the molten steel, preferably performing circulation-type vacuum degassing; and then casting the molten steel into an ingot, wherein a deoxidizer including manganese, aluminum, and silicon (form of alloy of manganese, aluminum, silicon, etc. is not critical) are added in an amount on a purity basis of not less than 1 kg per ton of the molten steel by previously placing the deoxidizer in the ladle furnace, and/or by adding the deoxidizer to the molten steel in the course of tapping from the arc melting furnace or the converter into the ladle, and, in some cases, a slag former, such as CaO, is simultaneously added, whereby tapping deoxidation, wherein the molten steel is pre-deoxidized before reduction refining in a ladle furnace, is carried out.

According to a preferred embodiment of the first present invention, the molten steel is transferred to the ladle furnace in such a manner that the tapping temperature of the molten steel is at least 100° C. above, preferably at least 120° C. above, more preferably at least 150° C. above, the melting point of the steel.

The refining in the ladle refining furnace is carried out for not more than 60 min, preferably not more than 45 min, more preferably 25 to 45 min, and the degassing is carried out for not less than 25 min. In particular, in the circulation-type vacuum degassing device, it is a general knowledge that satisfactory results can be obtained by bringing the amount of the molten steel circulated to not less than 5 times the total amount of the molten steel. On the other hand, in the present invention, in the circulation-type vacuum degassing device, the amount of the molten steel circulated in the degassing is brought to at least 8 times, preferably at least 10 times, particularly preferably at least 15 times, larger than the total amount of the molten steel.

The present invention embraces a high-cleanliness steel produced by the above production process.

According to the present invention, preferably, the content of oxygen in the steel is not more than 10 ppm. Preferably, when the content of carbon in the steel is less than 0.6% by mass, the content of oxygen in the steel is not more than 8 ppm. Particularly preferably, in the case of $C \geqq 0.6\%$ by mass, the oxygen content is not more than 6 ppm.

Preferably, in the steel of the present invention, the number of oxide inclusions having a size of not less than 20 μm as detected by dissolving the steel product in an acid, for example, oxide inclusions having an $Al_2O_3$ content of not less than 50%, is not more than 40, preferably not more than 30, more preferably not more than 20, per 100 g of the steel product.

In the steel of the present invention, for example, when the maximum inclusion diameter in 100 $mm^2$ of the surface of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm.

Second Invention

The second invention will be described. In the conventional process using a refining furnace, such as an arc melting furnace or a converter, melting and oxidizing refining are mainly carried out, for example, in the arc melting furnace or the converter, and the reduction period (deoxidation) is carried out in ladle refining. On the other hand, the present invention is directed to a process for producing a high-cleanliness steel, comprising the steps of: transferring a molten steel produced in an arc melting furnace or a converter to a ladle to perform degassing, preferably perform circulation-type vacuum degassing; transferring the degassed molten steel to a ladle furnace to refine the molten steel; and further performing degassing, preferably circulation-type vacuum degassing in a circulation-type vacuum degassing device.

According to a preferred embodiment of the present invention, the molten steel is transferred to the ladle in such a manner that the tapping temperature of the molten steel is at least 100° C. above, preferably at least 120° C. above, more preferably at least 150° C. above, the melting point of the steel.

The refining in the ladle furnace is carried out for not more than 60 min, preferably not more than 45 min, more preferably 25 to 45 min, and the degassing is carried out for not less than 25 min. In particular, in the circulation-type vacuum degassing device, it is a general knowledge that satisfactory results can be obtained by bringing the amount of the molten steel circulated to not less than 5 times the total amount of the molten steel. On the other hand, in the present invention, in the circulation-type vacuum degassing device, the amount of the molten steel circulated in the degassing is brought to at least 8 times, preferably at least 10 times, particularly preferably at least 15 times, larger than the total amount of the molten steel.

The present invention embraces the high-cleanliness steel produced by the above production process.

According to the present invention, preferably, the content of oxygen in the steel is not more than 10 ppm. Preferably, when the content of carbon in the steel is less than 0.6% by mass, the content of oxygen in the steel is not more than 8 ppm. Particularly preferably, in the case of $C \geqq 0.6\%$ by mass, the oxygen content is not more than 6 ppm.

Preferably, in the steel of the present invention, the number of oxide inclusions having a size of not less than 20 μm as detected by dissolving the steel product in an acid, for example, oxide inclusions having an $Al_2O_3$ content of not less than 50%, is not more than 40, preferably not more than 30, more preferably not more than 20, per 100 g of the steel product.

In the steel of the present invention, for example, when the maximum inclusion diameter in 100 $mm^2$ of the surface of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm.

Third Invention

The third invention will be described. In the conventional process using a refining furnace, such as an arc melting furnace or a converter, melting and oxidizing refining are mainly carried out, for example, in the arc melting furnace or the converter, and the reduction period (deoxidation) is carried out in ladle refining furnace. On the other hand, the present invention is directed to a process for producing a high-cleanliness steel, comprising the steps of: subjecting a molten steel to oxidizing refining in an arc melting furnace or a converter; adding a deoxidizer including manganese, silicon, and aluminum (form of alloy of manganese, silicon, aluminum, etc. is not critical) in an amount of not less than 2 kg per ton of the molten steel to the molten steel in the same furnace before tapping to deoxidize the molten steel; transferring the deoxidized molten steel to a ladle furnace to perform ladle refining; and then circulating the refined molten steel through a circulation-type vacuum degassing device to degas the molten steel.

According to a preferred embodiment of the present invention, the molten steel is transferred to the ladle furnace in such a manner that the tapping temperature of the molten steel is at least 100° C. above, preferably at least 120° C. above, more preferably at least 150° C. above, the melting point of the steel.

According to the present invention, preferably, the refining in the ladle furnace is carried out for not more than 60 min, preferably not more than 45 min, more preferably 25 to 45 min. The degassing subsequent to this step is generally carried out in a circulation-type vacuum degassing device in such a manner that the amount of the molten steel circulated is brought to not less than 5 times the total amount of the molten steel. On the other hand, in the present invention, in the circulation-type vacuum degassing device, the amount of the molten steel circulated in the degassing is brought to at least 8 times, preferably at least 10 times, particularly preferably at least 15 times, larger than the total amount of the molten steel, and the degassing time is at least 25 min.

The present invention embraces the high-cleanliness steel produced by the above production process.

According to the present invention, preferably, the content of oxygen in the steel is not more than 10 ppm. Preferably, when the content of carbon in the steel is less than 0.6% by mass, the content of oxygen in the steel is not more than 8 ppm. Particularly preferably, in the case of C a 0.6% by mass, the oxygen content is not more than 6 ppm.

Preferably, in the steel according to the present invention, the number of oxide inclusions having a size of not less than 20 μm as detected by dissolving the steel product in an acid, for example, oxide inclusions having an $Al_2O_3$ content of not less than 50%, is not more than 40, preferably not more than 30, more preferably not more than 20, per 100 g of the steel product.

In the steel of the present invention, for example, when the maximum inclusion diameter in 100 $mm^2$ of the surface of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm.

Fourth Invention

The fourth invention will be described. In the conventional process using a refining furnace, such as an arc melting furnace or a converter, melting and oxidizing refining are mainly carried out, for example, in the arc melting furnace or the converter, and the reduction period (deoxidation) is carried out in a ladle furnace. On the other hand, the present invention is directed to a process for producing a high-cleanliness steel, comprising the steps of: transferring a molten steel produced in an arc melting furnace or a converter to a ladle furnace to refine the molten steel; subjecting the refined molten steel to circulation-type vacuum degassing; and then casting the degassed molten steel into an ingot, wherein the refining in the ladle furnace is carried out for not more than 60 min, preferably not more than 45 min, more preferably 45 to 25 min, and, while the degassing subsequent to this step is generally carried out for less than 25 min in a circulation-type vacuum degassing device in such a manner that the amount of the molten steel circulated is brought to not less than 5 times the total amount of the molten steel, in the present invention, in the circulation-type vacuum degassing device, the amount of the molten steel circulated in the degassing is brought to at least 8 times, preferably at least 10 times, particularly preferably at least 15 times, larger than the total amount of the molten steel, and the degassing time is at least 25 min.

According to a preferred embodiment of the present invention, the molten steel is transferred to the ladle furnace in such a manner that the tapping temperature of the molten steel is at least 100° C. above, preferably at least 120° C. above, more preferably 150° C. above, the melting point of the steel.

The present invention embraces the high-cleanliness steel produced by the above production process.

According to the present invention, preferably, the content of oxygen in the steel is not more than 10 ppm. Preferably, when the content of carbon in the steel is less than 0.6% by mass, the content of oxygen in the steel is not more than 8 ppm. Particularly preferably, in the case of C≧0.6% by mass, the oxygen content is not more than 6 ppm.

Preferably, in the steel according to the present invention, the number of oxide inclusions having a size of not less than 20 μm as detected by dissolving the steel product in an acid, for example, oxide inclusions having an $Al_2O_3$ content of not less than 50%, is not more than 40, preferably not more than 30, more preferably not more than 20, per 100 g of the steel product.

In the steel of the present invention, for example, when the maximum inclusion diameter in 100 $mm^2$ of the surface of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm.

Fifth Invention

The fifth invention will be described. In the conventional process using a refining furnace, such as an arc melting furnace or a converter, melting and oxidizing refining are mainly carried out, for example, in the arc melting furnace or the converter, and the reduction period (deoxidation) is carried out in ladle refining. On the other hand, the present invention is directed to a process for producing a high-cleanliness steel, comprising the steps of: transferring a molten steel produced in an arc melting furnace or a converter to a ladle as an out-furnace refining furnace to perform refining; subjecting the molten steel to circulation-type ladle degassing; and then casting the degassed molten steel into an ingot, wherein the refining in the ladle is carried out in such a manner that, in addition to stirring by gas introduced from the bottom of the ladle, stirring is carried out by electromagnetic induction, and this ladle refining is carried out for 50 to 80 min, preferably 70 to 80 min.

According to the present invention, preferably, the ladle refining by the gas stirring and the electromagnetic stirring in the ladle is carried out in an inert atmosphere.

The present invention embraces the high-cleanliness steel produced by the above production process.

According to the present invention, preferably, the content of oxygen in the steel is not more than 10 ppm. Preferably, when the content of carbon in the steel is less than 0.6% by mass, the content of oxygen in the steel is not more than 8 ppm. Particularly preferably, in the case of C≧0.6% by mass, the oxygen content is not more than 6 ppm.

Preferably, in the steel of the present invention, the number of oxide inclusions having a size of not less than 20 μm as detected by dissolving the steel product in an acid, for example, oxide inclusions having an $Al_2O_3$ content of not less than 50%, is not more than 40, preferably not more than 30, more preferably not more than 20, per 100 g of the steel product.

In the steel of the present invention, for example, when the maximum inclusion diameter in 100 $mm^2$ of the surface of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm.

BRIEF DESCRIPTION OF THE DRAWINGS

FIG. 1E is a diagram showing the relationship between the use or unuse of tapping deoxidation of steel SJ 2 and the $L_{10}$ life, wherein $A_1$ shows data on the adoption of only tapping deoxidation according to the present invention, $A_2$ data on the adoption of tapping deoxidation+high-temperature tapping according to the present invention, $A_3$ data on the adoption of tapping deoxidation+short-time LF, long-time RH treatment according to the present invention, $A_4$ data on the adoption of tapping deoxidation+high-temperature tapping+short-time LF, long-time RH treatment according to the present invention, and conventional data on prior art;

Figure 1A:
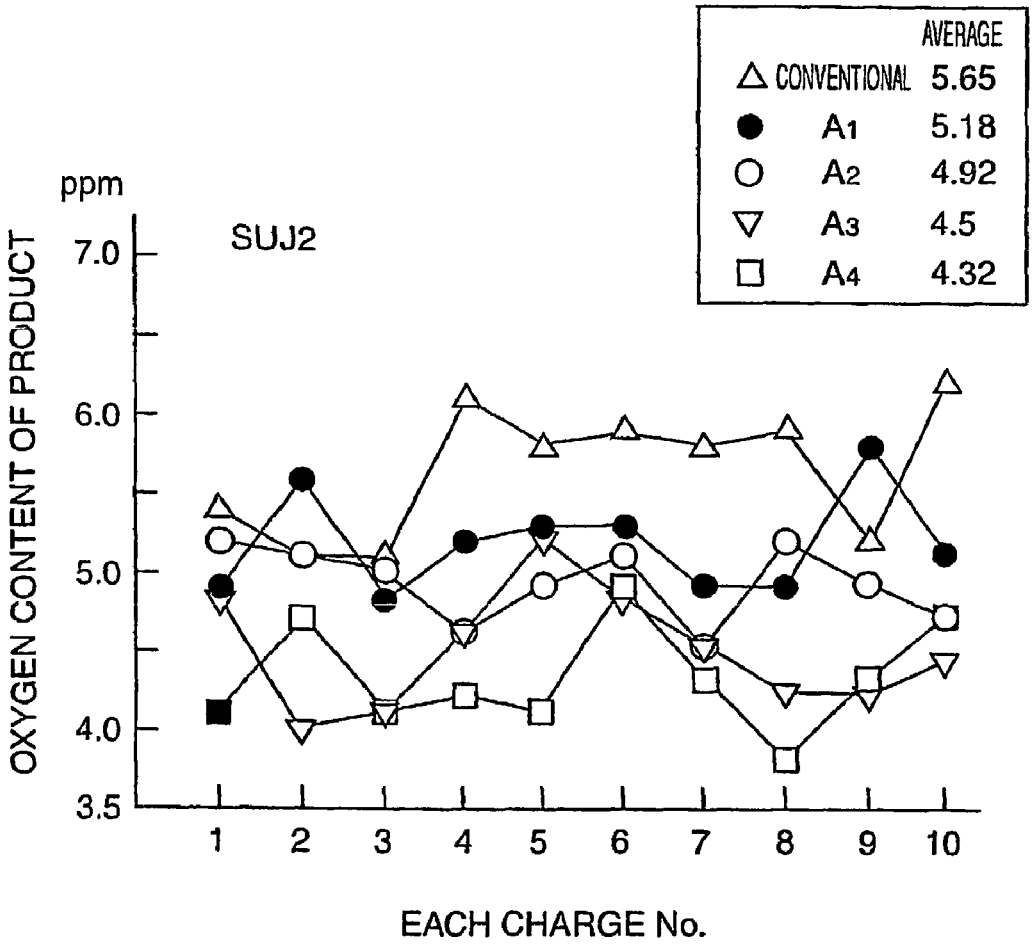
FIG. 1A is a diagram showing the relationship between the use or unuse of tapping deoxidation of steel SUJ 2 and the content of oxygen in products, wherein $A_1$ shows data on the adoption of only tapping deoxidation according to the present invention, $A_2$ data on the adoption of tapping deoxidation+high-temperature tapping according to the present invention, $A_3$ data on the adoption of tapping deoxidation+short-time LF, long-time RH treatment according to the present invention, $A_4$ data on the adoption of tapping deoxidation+high-temperature tapping+short-time LF, long-time RH treatment according to the present invention, and conventional data on prior art.
Figure 1B:
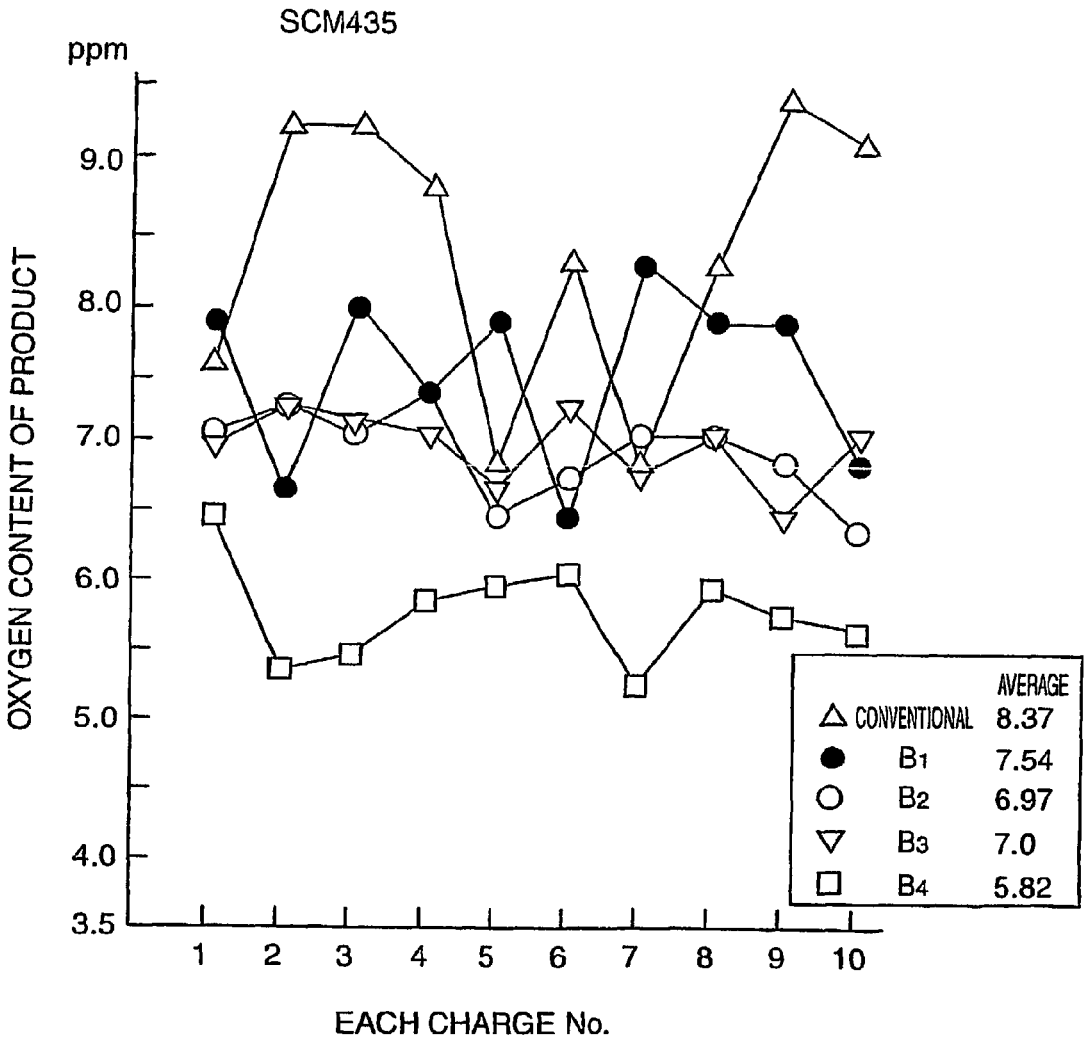
FIG. 1B is a diagram showing the relationship between the use or unuse of tapping deoxidation of steel SCM 435 and the content of oxygen in products, wherein $B_1$ shows data on the adoption of only tapping deoxidation according to the present invention, $B_2$ data on the adoption of tapping deoxidation+high-temperature tapping according to the present invention, $B_3$ data on the adoption of tapping deoxidation+short-time LF, long-time RH treatment according to the present invention, $B_4$ data on the adoption of tapping deoxidation+high-temperature tapping+short-time LF, long-time RH treatment according to the present invention, and conventional data on prior art.
Figure 1C:
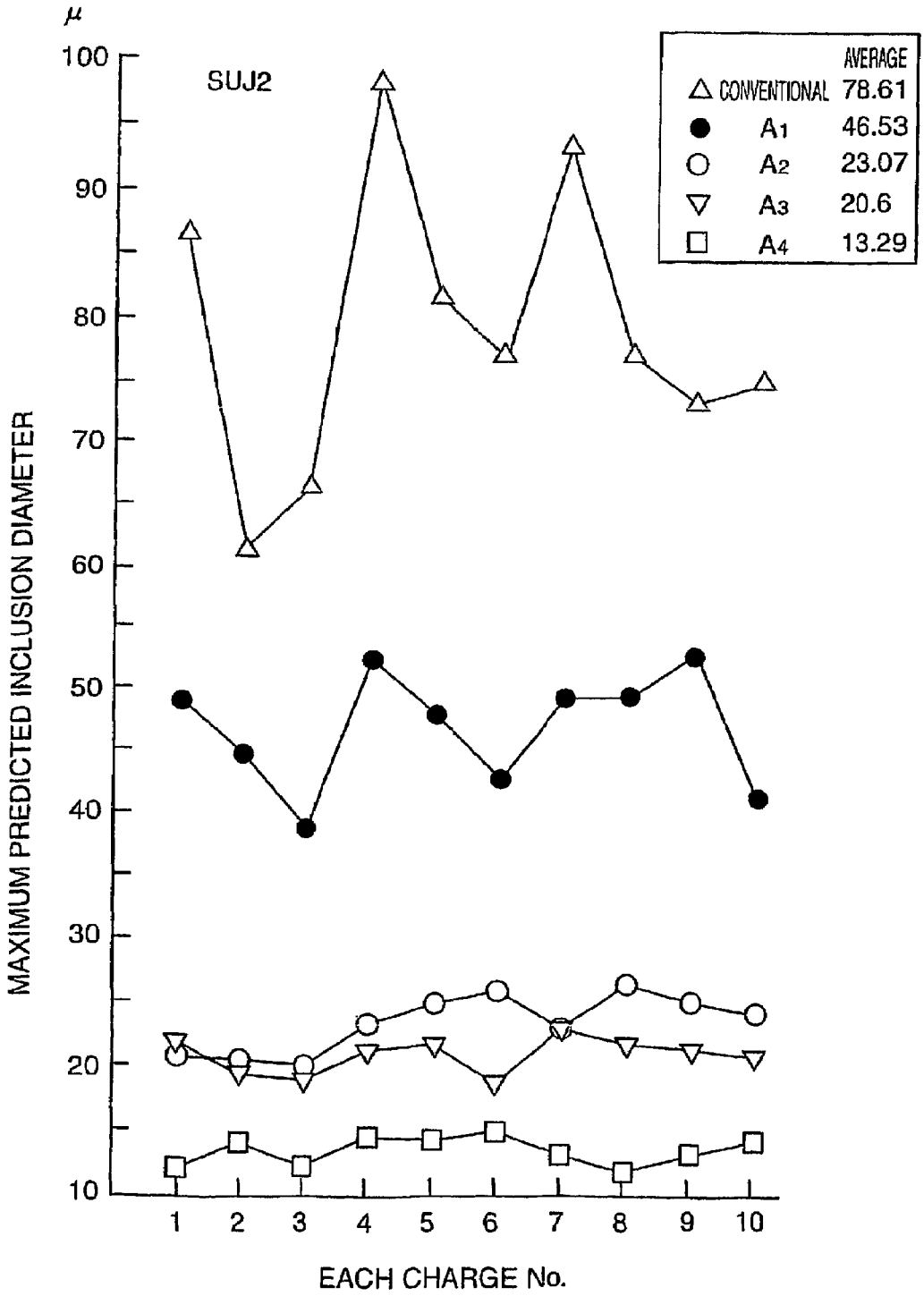
FIG. 1C is a diagram showing the relationship between the use or unuse of tapping deoxidation of steel SUJ 2 and the maximum predicted inclusion diameter, wherein $A_1$ shows data on the adoption of only tapping deoxidation according to the present invention, $A_2$ data on the adoption of tapping deoxidation+high-temperature tapping according to the present invention, $A_3$ data on the adoption of tapping deoxidation+short-time LF, long-time RH treatment according to the present invention, $A_4$ data on the adoption of tapping deoxidation+high-temperature tapping+short-time LF, long-time RH treatment according to the present invention, and conventional data on prior art.
Figure 1D:
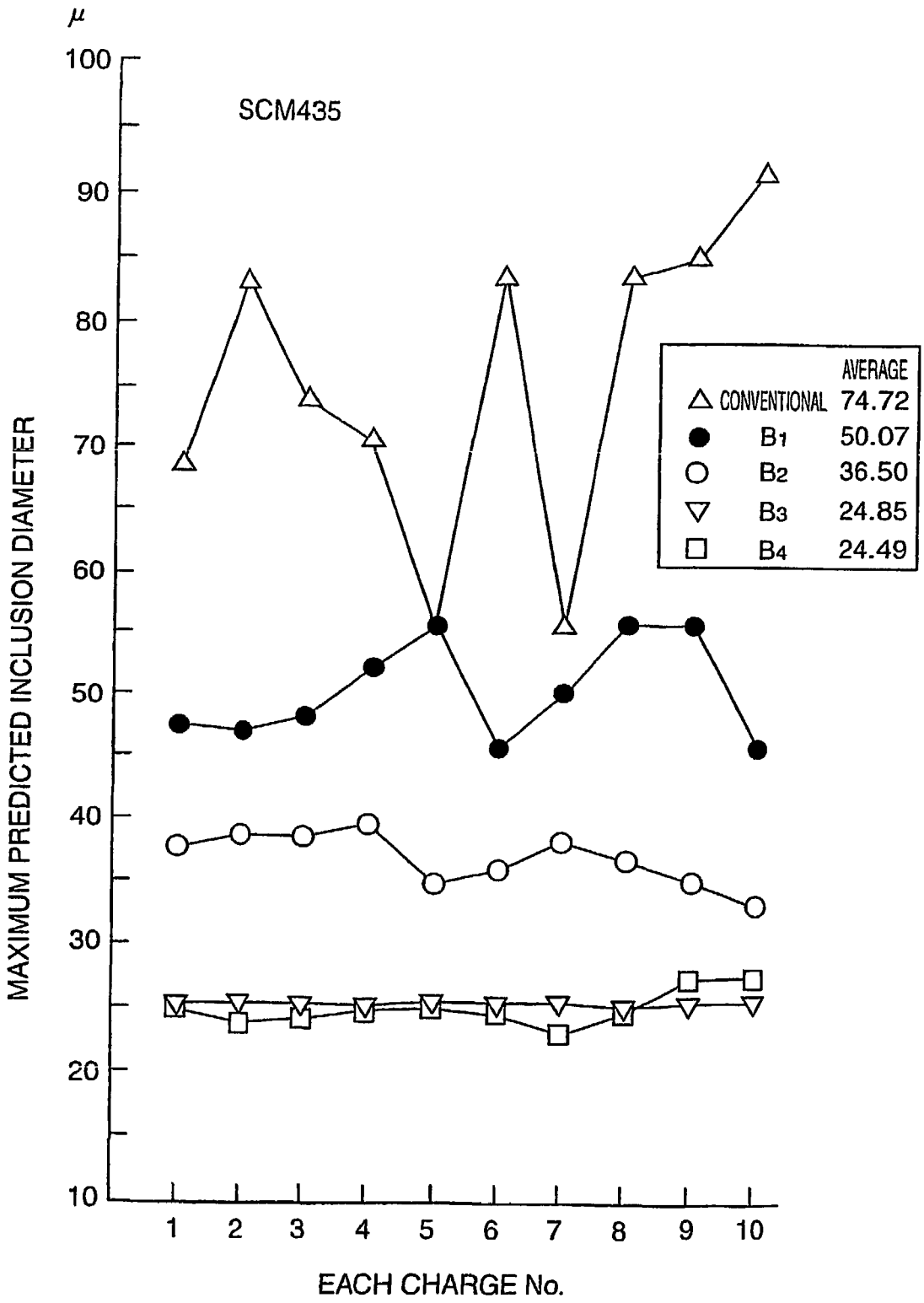
FIG. 1D is a diagram showing the relationship between the use or unuse of tapping deoxidation of steel SCM 435 and the maximum predicted inclusion diameter, wherein $B_1$ shows data on the adoption of only tapping deoxidation according to the present invention, $B_2$ data on the adoption of tapping deoxidation+high-temperature tapping according to the present invention, $B_3$ data on the adoption of tapping deoxidation+short-time LF, long-time RH treatment according to the present invention, $B_4$ data on the adoption of tapping deoxidation+high-temperature tapping+short-time LF, long-time RH treatment according to the present invention, and conventional data on prior art.
Figure 1F:
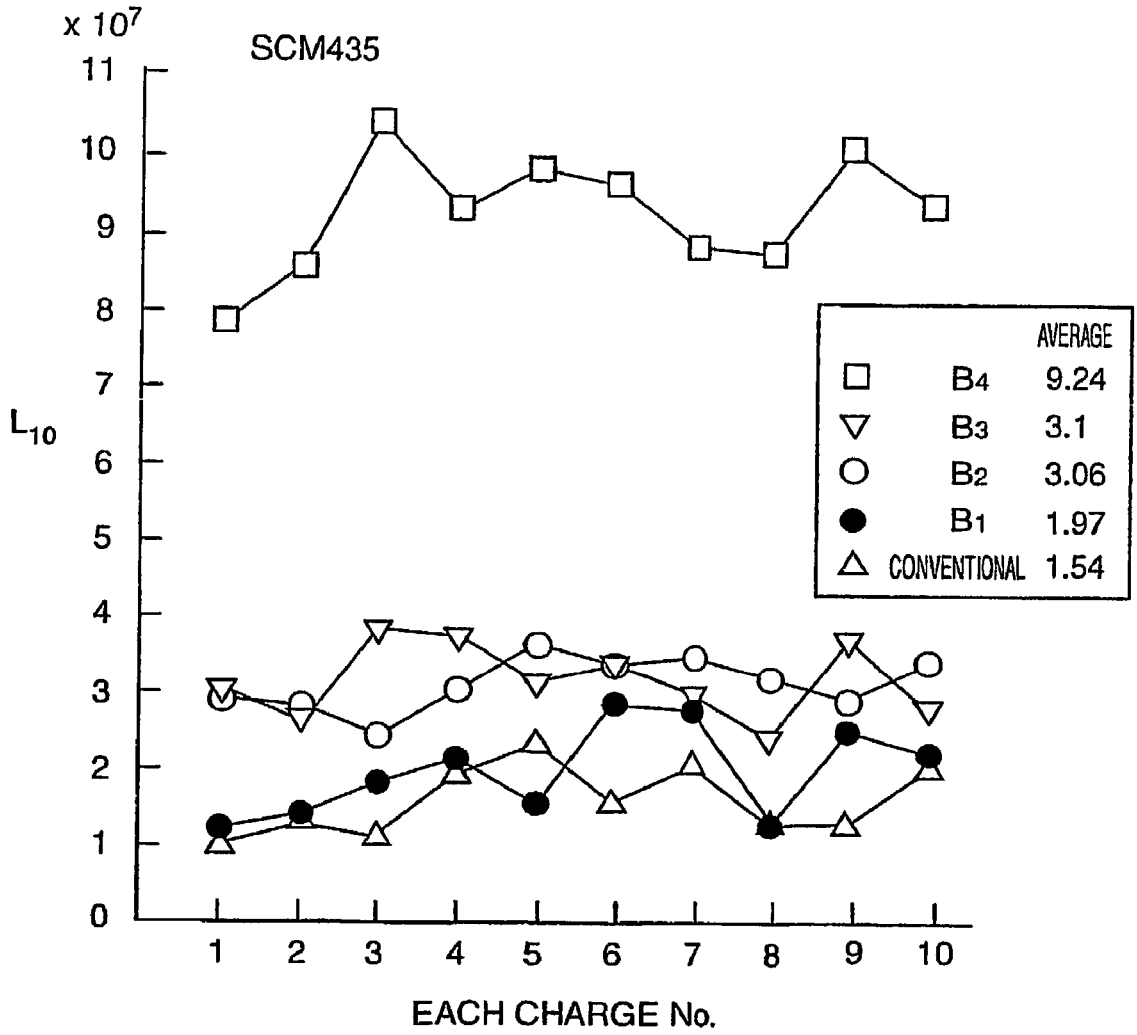
FIG. 1F is a diagram showing the relationship between the use or unuse of tapping deoxidation of steel SCM 435 and the $L_{10}$ life, wherein $B_1$ shows data on the adoption of only tapping deoxidation according to the present invention, $B_2$ data on the adoption of tapping deoxidation+high-temperature tapping according to the present invention, $B_3$ data on the adoption of tapping deoxidation+short-time LF, long-time RH treatment according to the present invention, $B_4$ data on the adoption of tapping deoxidation+high-temperature tapping+short-time LF, long-time RH treatment according to the present invention, and conventional data on prior art.
Figure 2A:
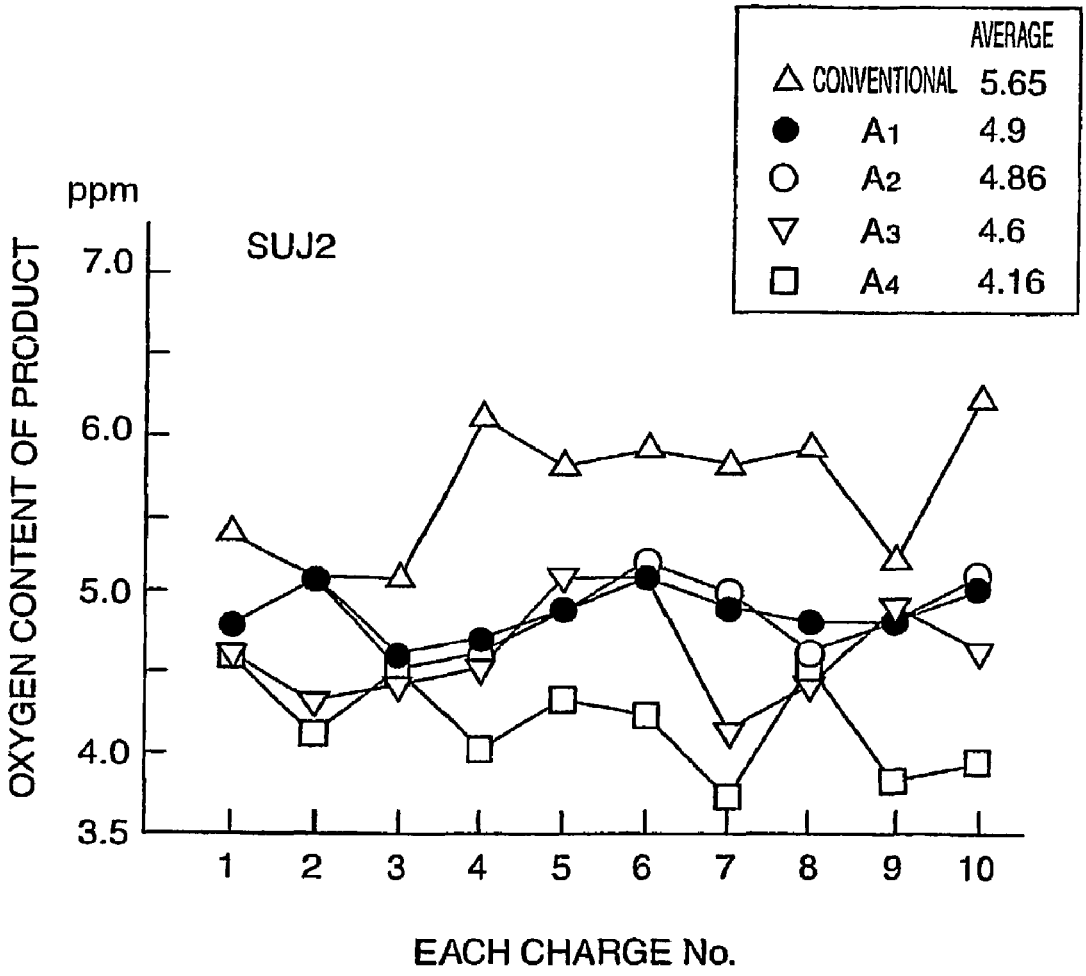
FIG. 2A is a diagram showing the relationship between the use or unuse of W-RH treatment of steel SUJ 2 and the content of oxygen in products, wherein $A_1$ shows data on the adoption of only W-RH treatment according to the present invention, $A_2$ data on the adoption of W-RH treatment+high-temperature tapping according to the present invention, $A_3$ data on the adoption of W-RH treatment+short-time LF, long-time RH treatment according to the present invention, $A_4$ data on the adoption of W-RH treatment+high-temperature tapping+short-time LF, long-time RH treatment according to the present invention, and conventional data on prior art.
Figure 2B:
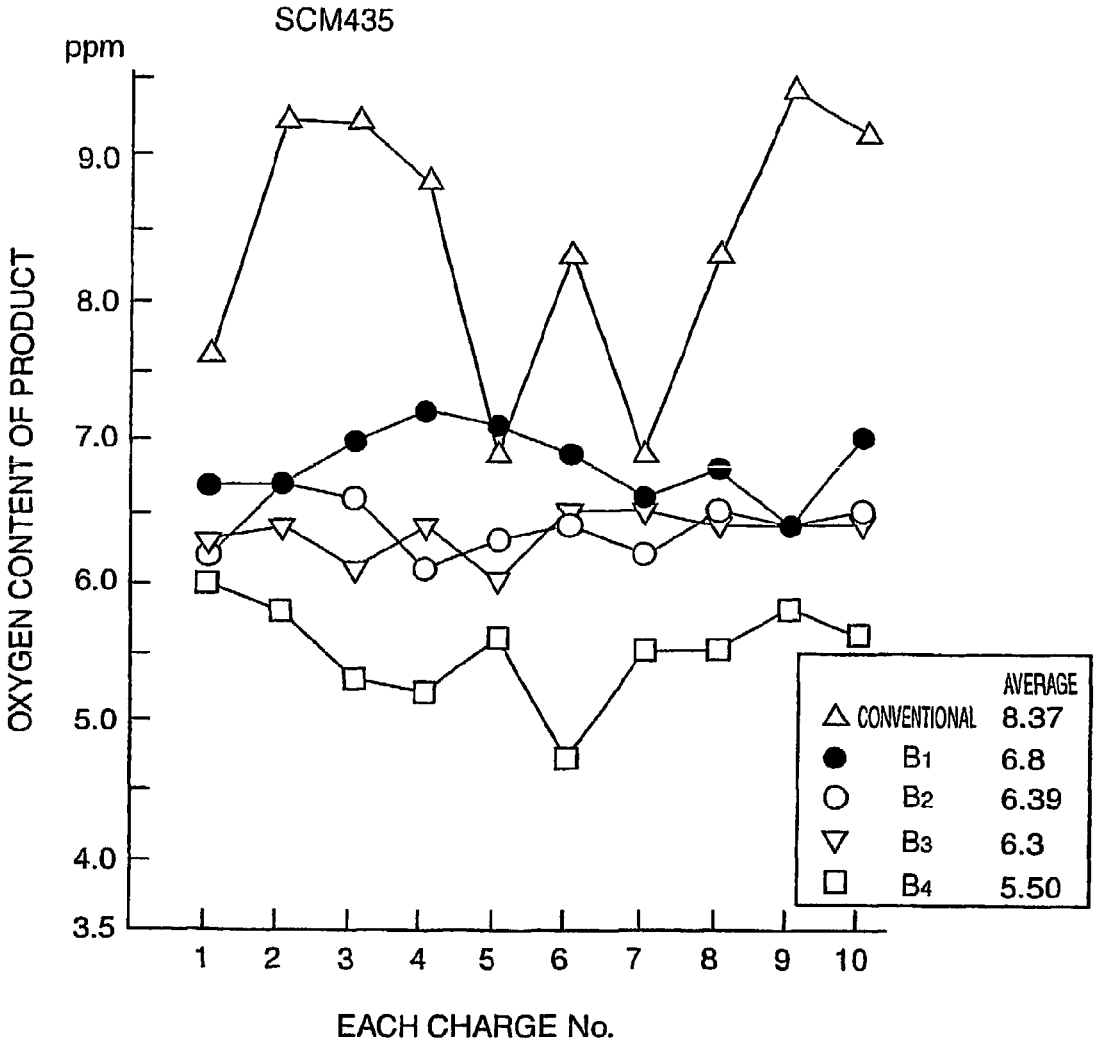
FIG. 2B is a diagram showing the relationship between the use or unuse of W-RH treatment of steel SCM 435 and the content of oxygen in products, wherein $B_1$ shows data on the adoption of only W-RH treatment according to the present invention, $B_2$ data on the adoption of W-RH treatment+high-temperature tapping according to the present invention, $B_3$ data on the adoption of W-RH treatment+short-time LF, long-time RH treatment according to the present invention, $B_4$ data on the adoption of W-RH treatment+high-temperature tapping+short-time LF, long-time RH treatment according to the present invention, and conventional data on prior art.
Figure 2C:
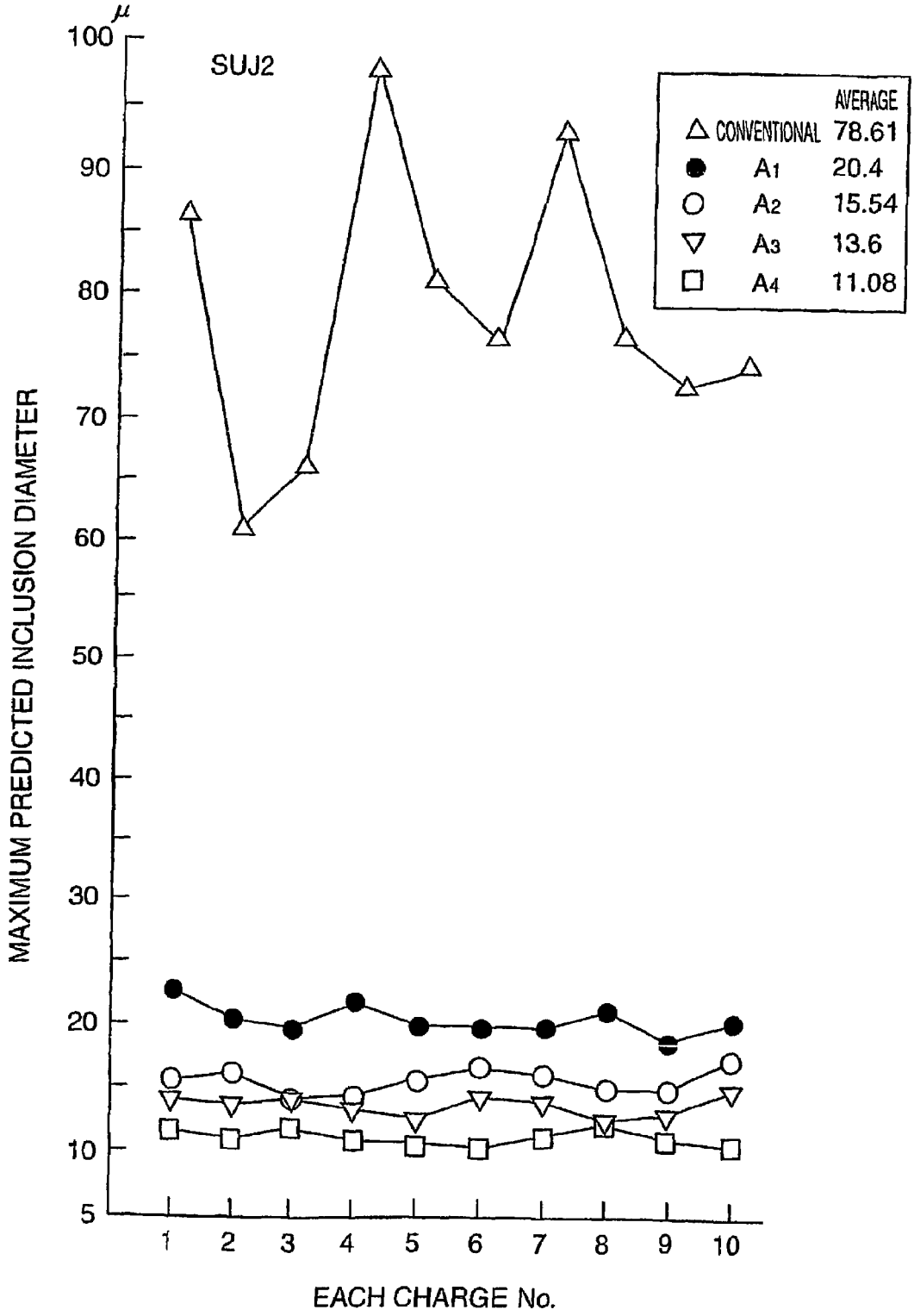
FIG. 2C is a diagram showing the relationship between the use or unuse of W-RH treatment of steel SUJ 2 and the maximum predicted inclusion diameter, wherein $A_1$ shows data on the adoption of only W-RH treatment according to the present invention, $A_2$ data on the adoption of W-RH treatment+high-temperature tapping according to the present invention, $A_3$ data on the adoption of W-RH treatment+short-time LF, long-time RH treatment according to the present invention, $A_4$ data on the adoption of W-RH treatment+high-temperature tapping+short-time LF, long-time RH treatment according to the present invention, and conventional data on prior art.
Figure 2D:
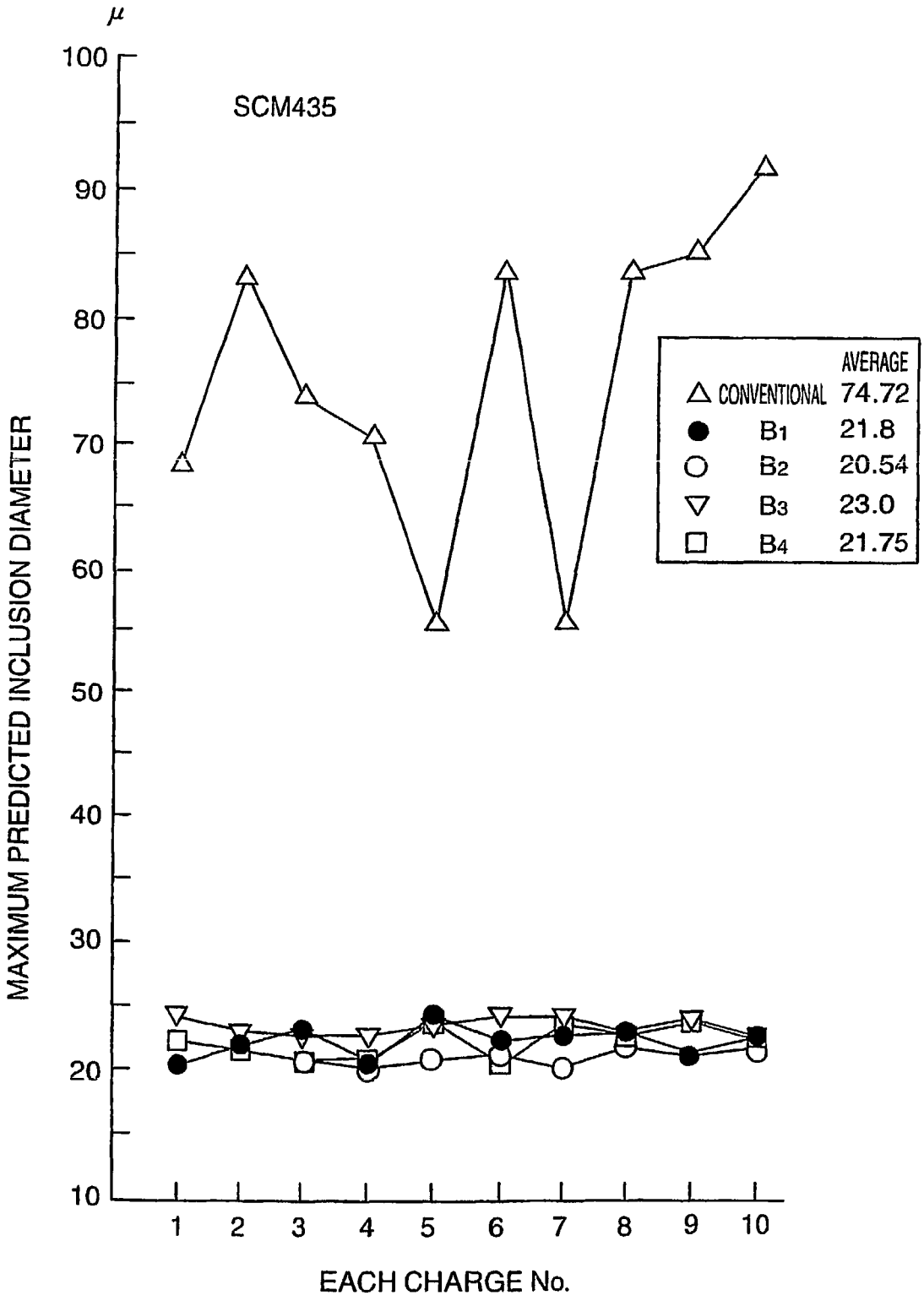
FIG. 2D is a diagram showing the relationship between the use or unuse of W-RH treatment of steel SCM 435 and the maximum predicted inclusion diameter, wherein $B_1$ shows data on the adoption of only W-RH treatment according to the present invention, $B_2$ data on the adoption of W-RH treatment+high-temperature tapping according to the present invention, $B_3$ data on the adoption of W-RH treatment+short-time LF, long-time RH treatment according to the present invention, $B_4$ data on the adoption of W-RH treatment+high-temperature tapping+short-time LF, long-time RH treatment according to the present invention, and conventional data on prior art.
Figure 2E:
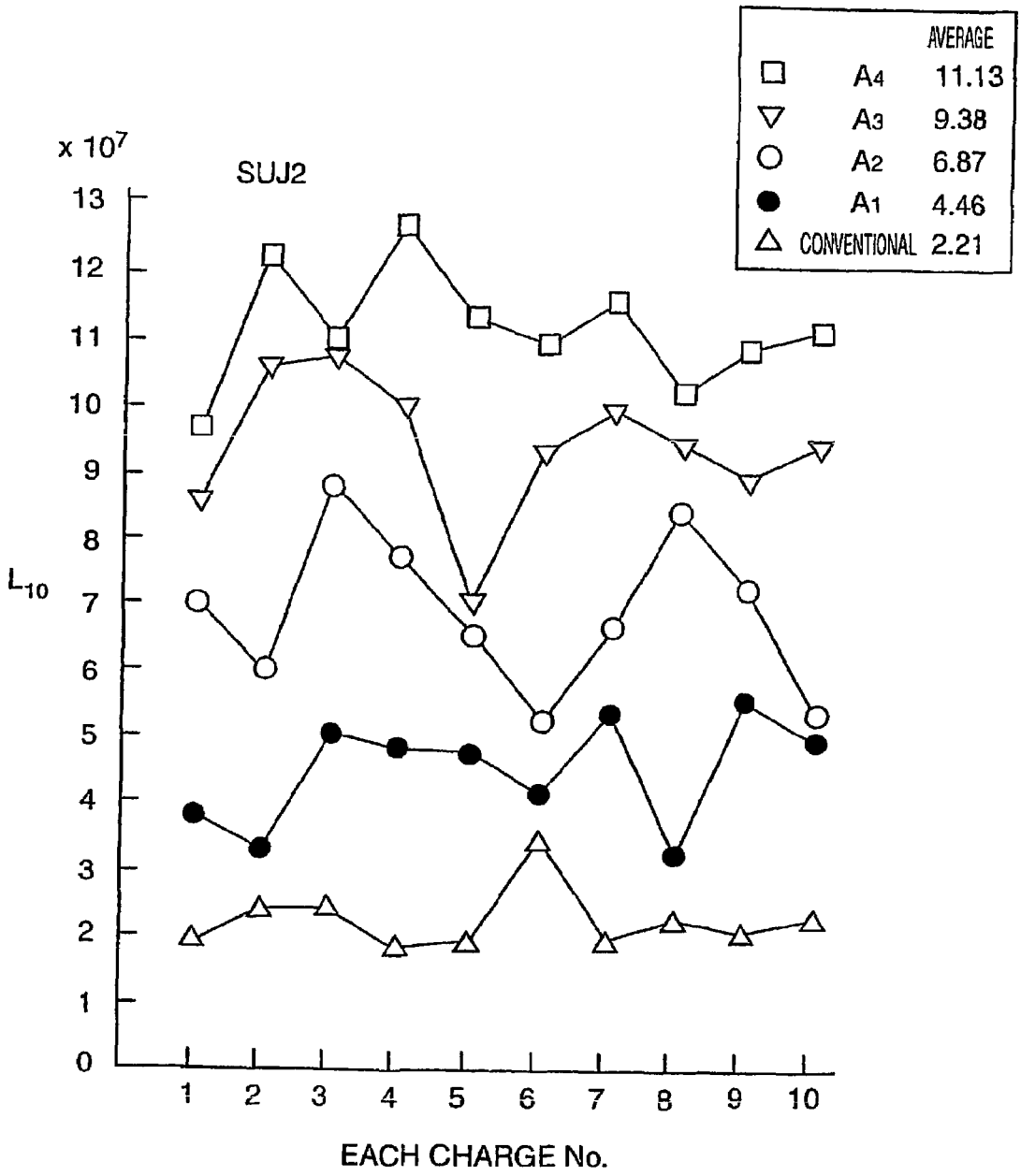
FIG. 2E is a diagram showing the relationship between the use or unuse of W-RH treatment of steel SUJ 2 and the $L_{10}$ life, wherein A, shows data on the adoption of only W-RH treatment according to the present invention, $A_2$ data on the adoption of W-RH treatment+high-temperature tapping according to the present invention, $A_3$ data on the adoption of W-RH treatment+short-time LF, long-time RH treatment according to the present invention, $A_4$ data on the adoption of W-RH treatment+high-temperature tapping+short-time LF, long-time RH treatment according to the present invention, and conventional data on prior art.
Figure 2F:
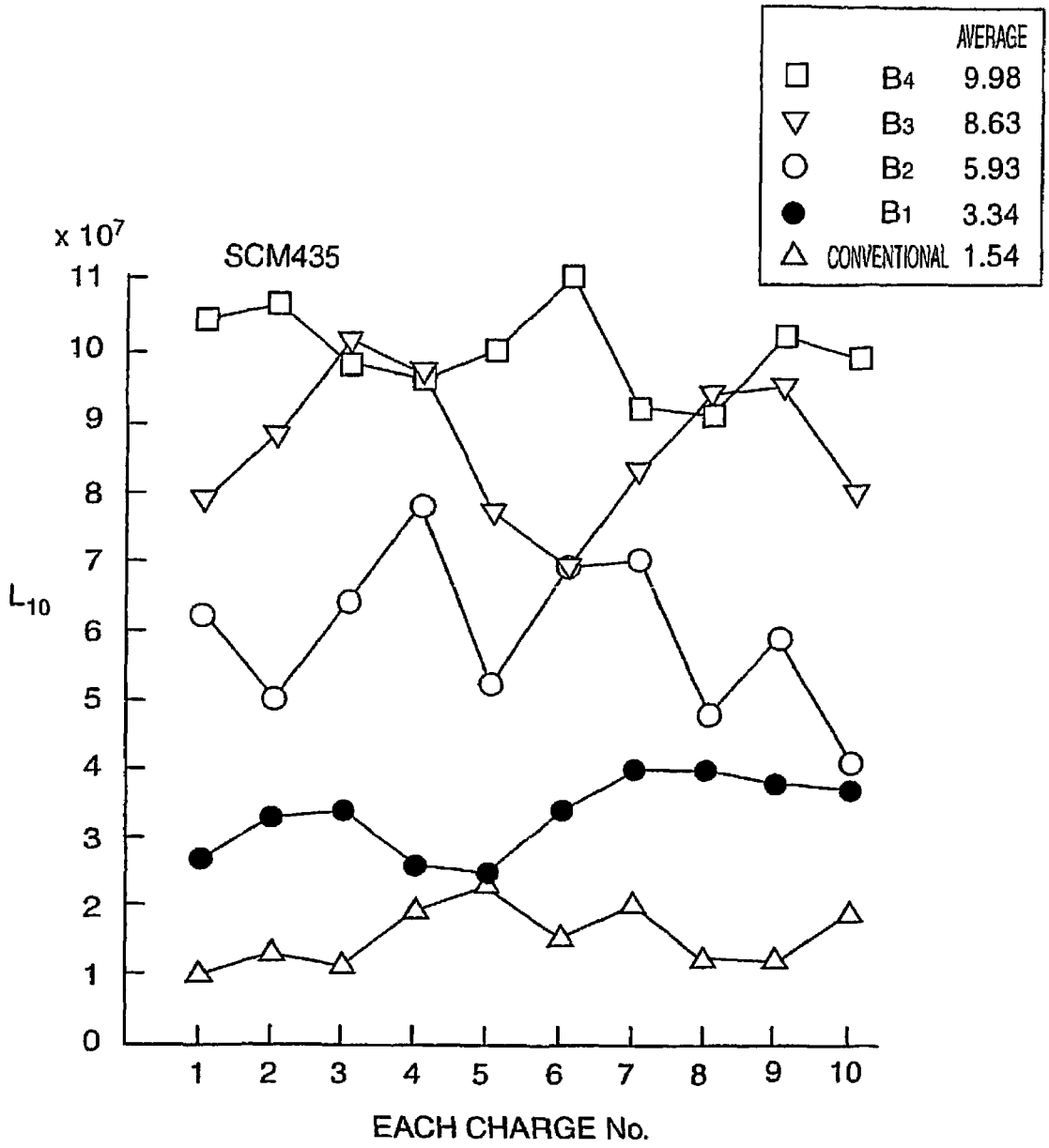
FIG. 2F is a diagram showing the relationship between the use or unuse of W-RH treatment of steel SCM 435 and the $L_{10}$ life, wherein $B_1$ shows data on the adoption of only W-RH treatment according to the present invention, $B_2$ data on the adoption of W-RH treatment+high-temperature tapping according to the present invention, $B_3$ data on the adoption of W-RH treatment+short-time LF, long-time RH treatment according to the present invention, $B_4$ data on the adoption of W-RH treatment+high-temperature tapping+short-time LF, long-time RH treatment according to the present invention, and conventional data on prior art.
Figure 3A:
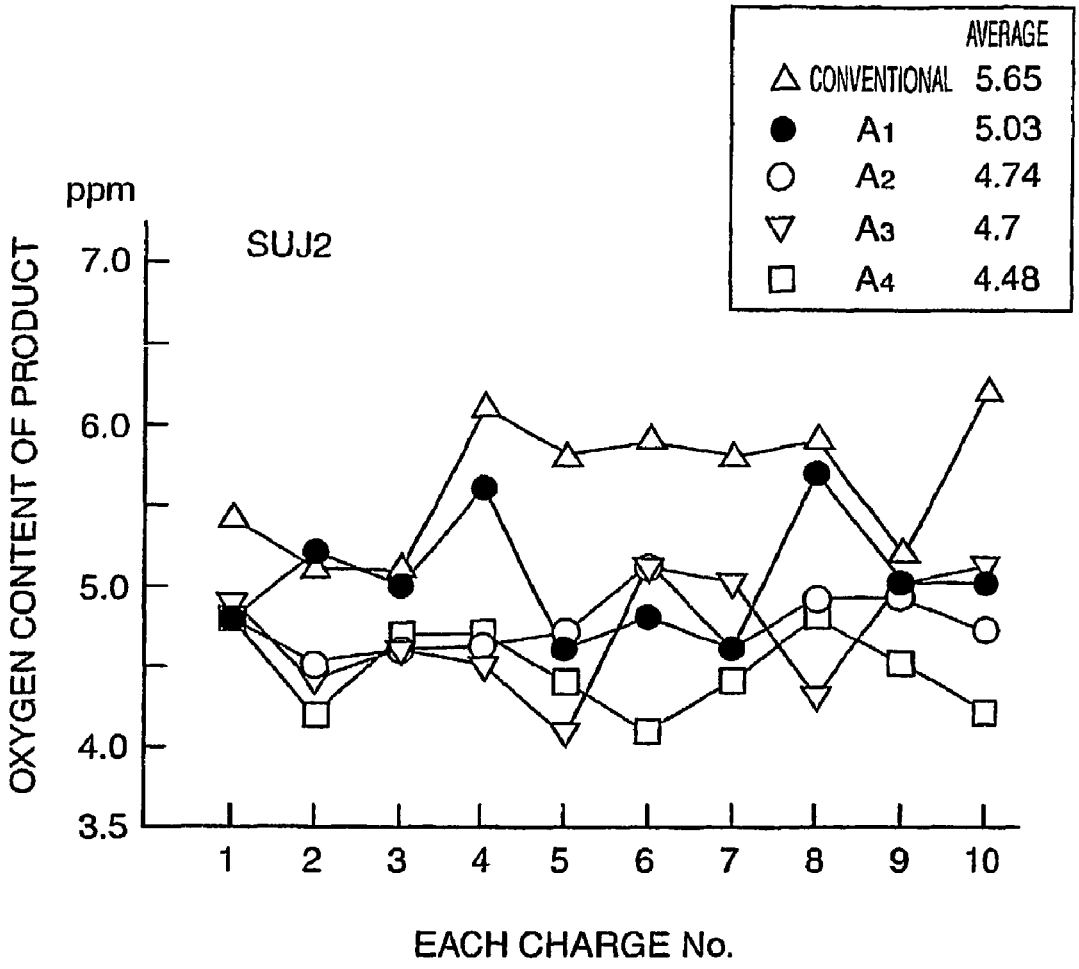
FIG. 3A is a diagram showing the oxygen content of products in 10 (heats) according to the process of the present invention using in-furnace deoxidation in the treatment of a molten steel of steel SUJ 2, and the oxygen content of products in 10 (heats) according to the conventional process wherein the in-furnace deoxidation is not carried out.
Figure 3B:
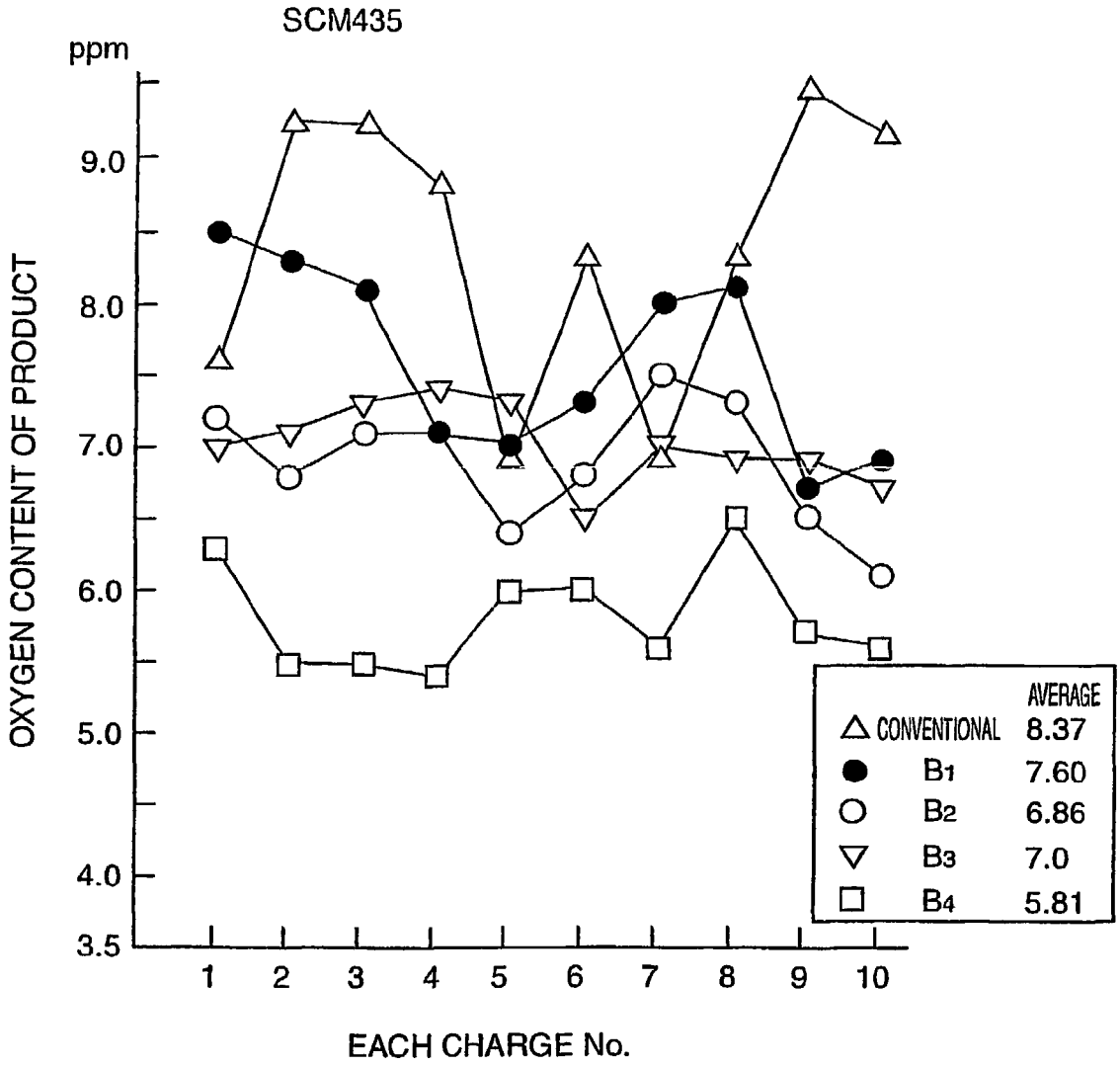
FIG. 3B is a diagram showing the oxygen content of products in 10 (heats) according to the process of the present invention using in-furnace deoxidation in the treatment of a molten steel of steel SCM 435, and the oxygen content of products in 10 (heats) according to the conventional process wherein the in-furnace deoxidation is not carried out.
Figure 3C:
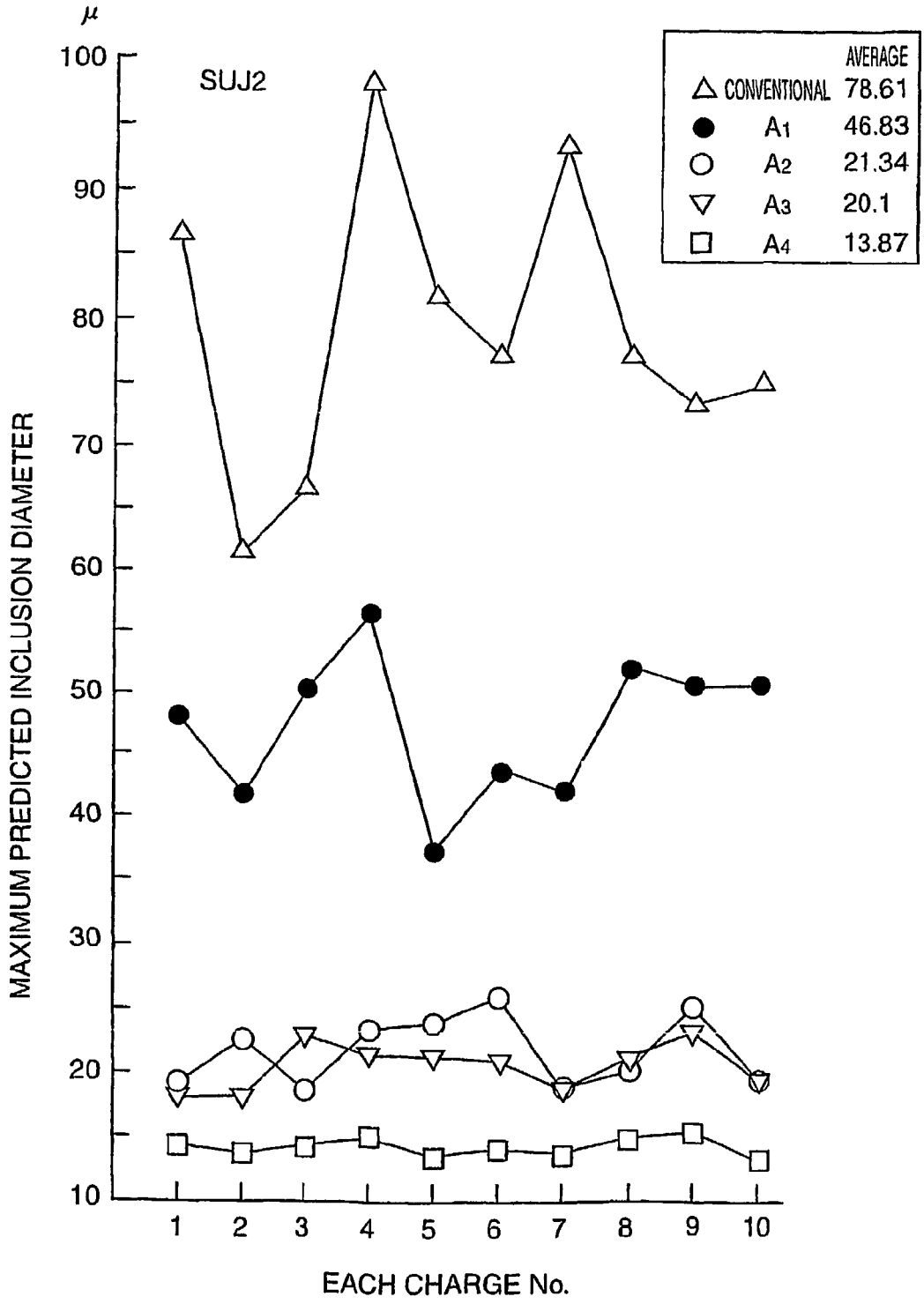
FIG. 3C is a diagram showing the maximum predicted inclusion diameter according to statistics of extreme values in products in 10 (heats) according to the process of the present invention using in-furnace deoxidation in the treatment of a molten steel of steel SUJ 2, and the maximum predicted inclusion diameter in products in 10 (heats) according to the conventional process wherein the in-furnace deoxidation is not carried out.
Figure 3D:
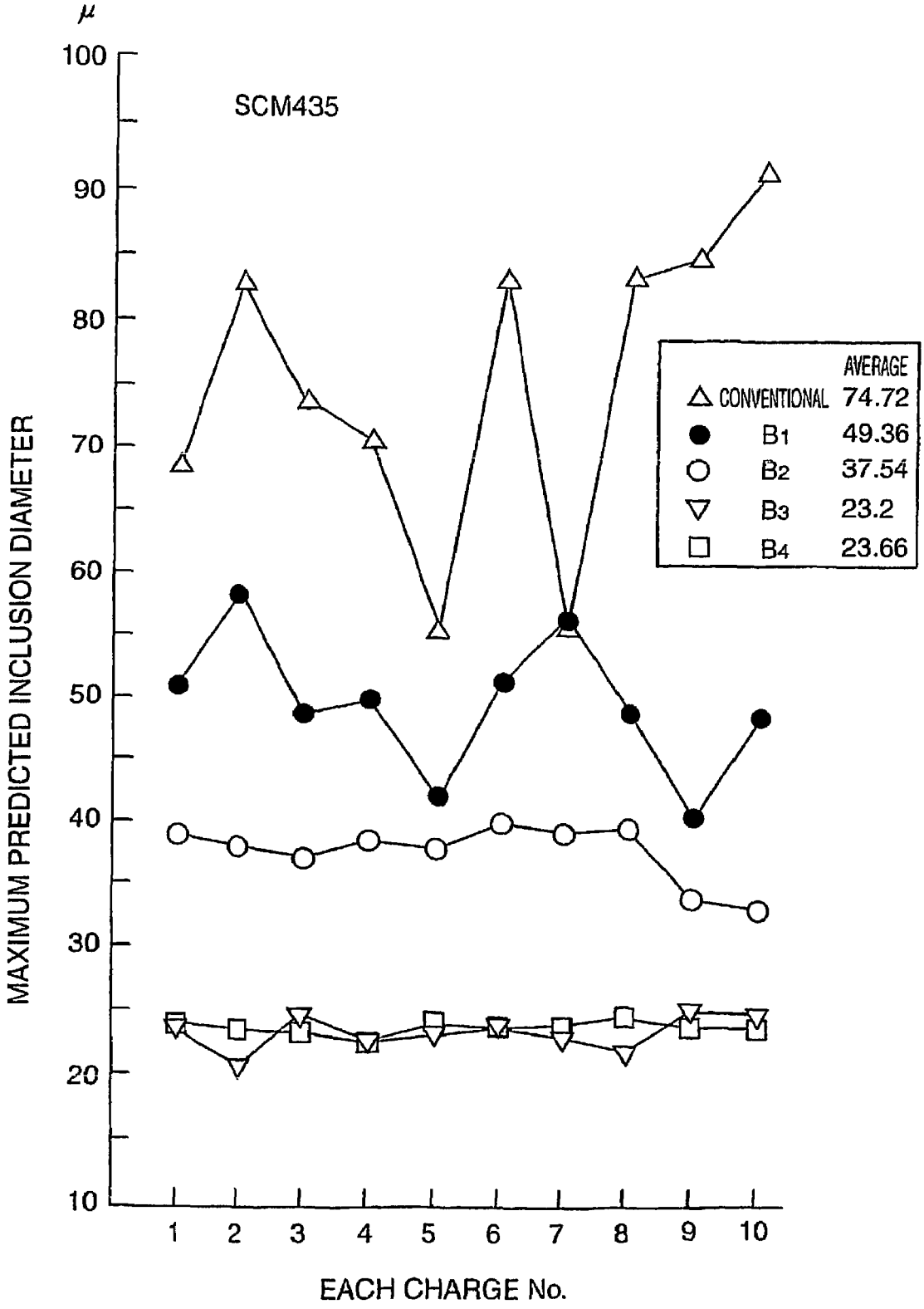
FIG. 3D is a diagram showing the maximum predicted inclusion diameter according to statistics of extreme values in products in 10 (heats) according to the process of the present invention using in-furnace deoxidation in the treatment of a molten steel of steel SCM 435, and the maximum predicted inclusion diameter in products in 10 (heats) according to the conventional process wherein the in-furnace deoxidation is not carried out.
Figure 3E:
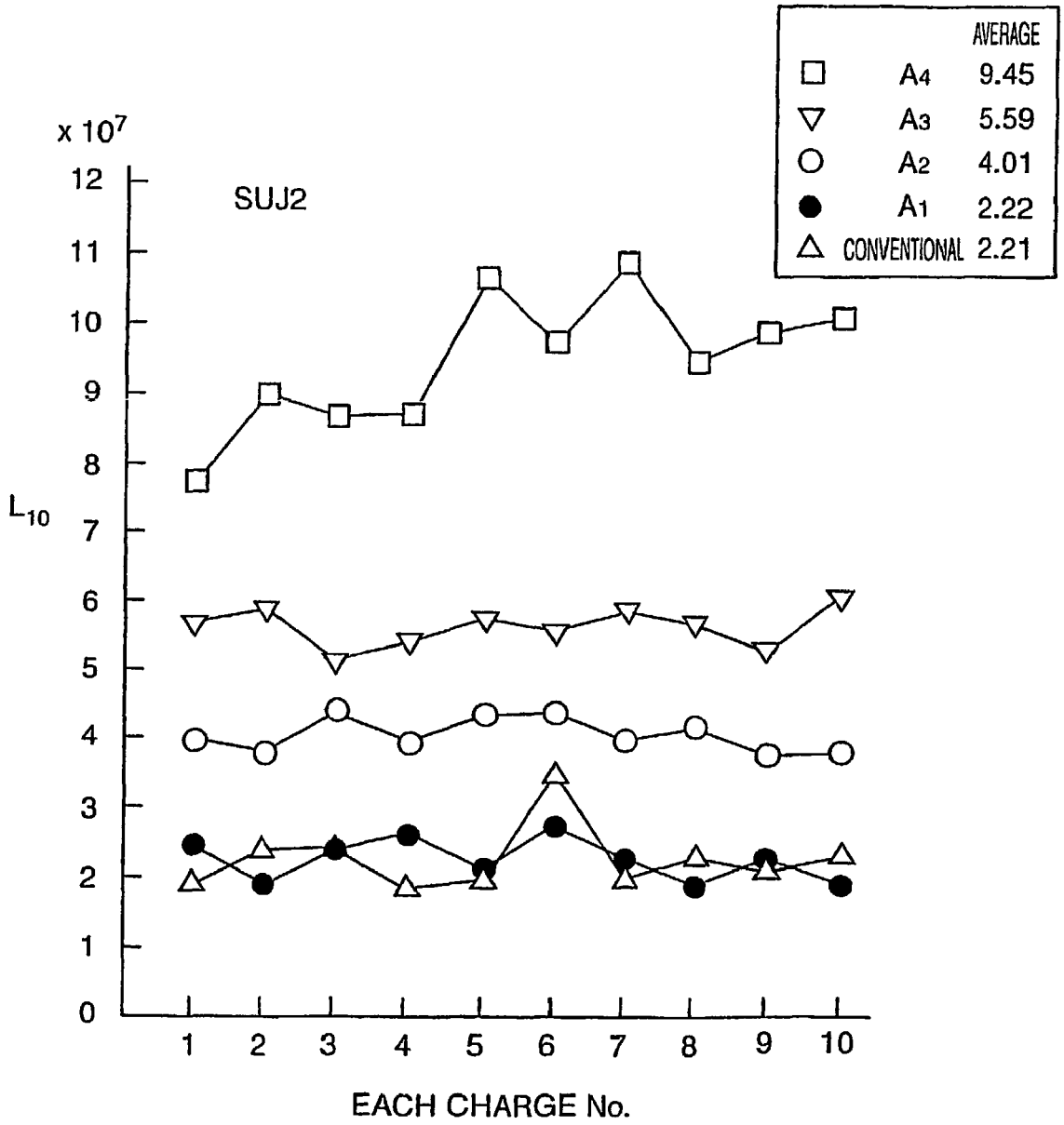
FIG. 3E is a diagram showing the $L_{10}$ life as determined by the thrust rolling service life test of products in 10 (heats)
Figure 3F:
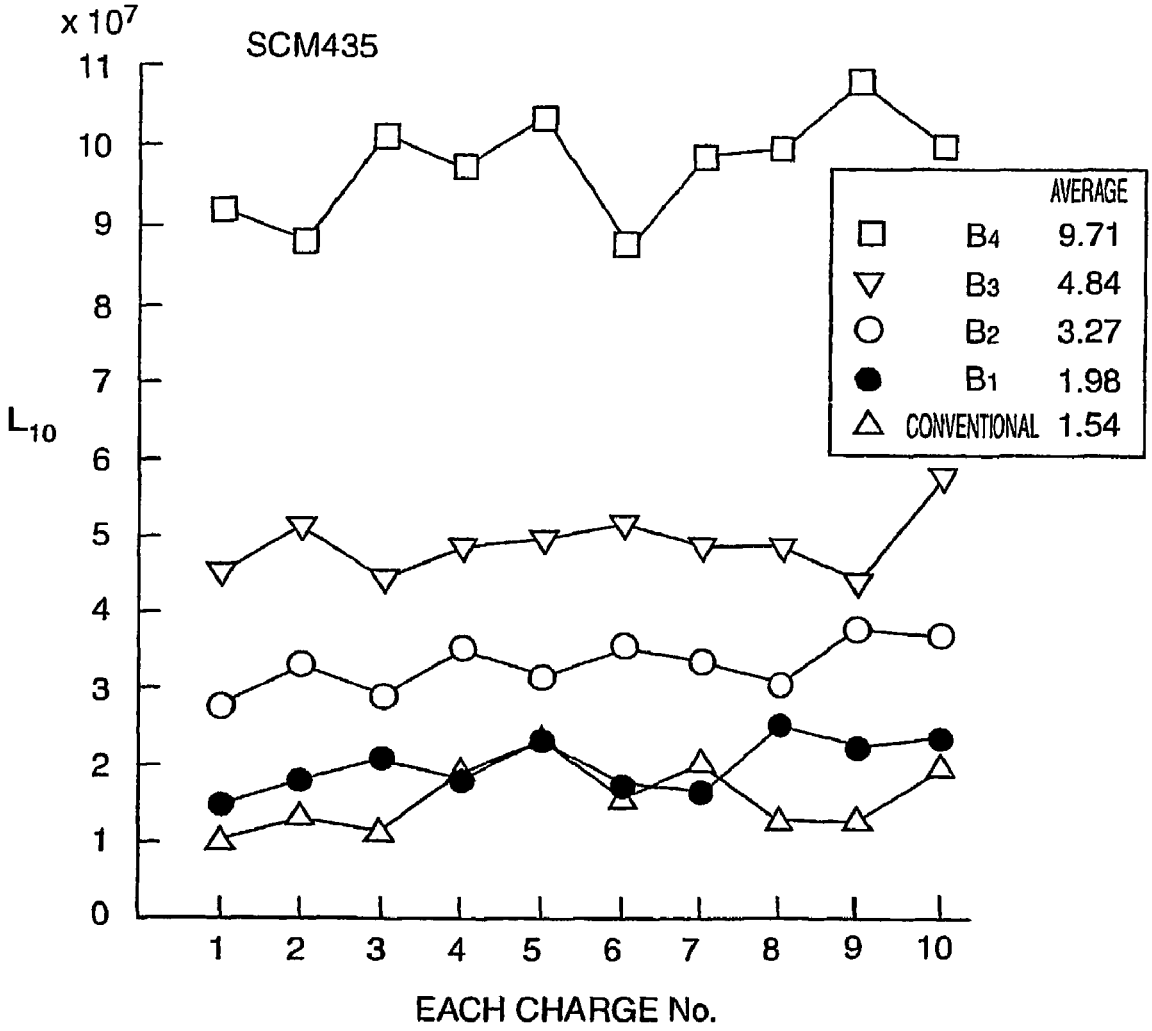
Figure 4A:
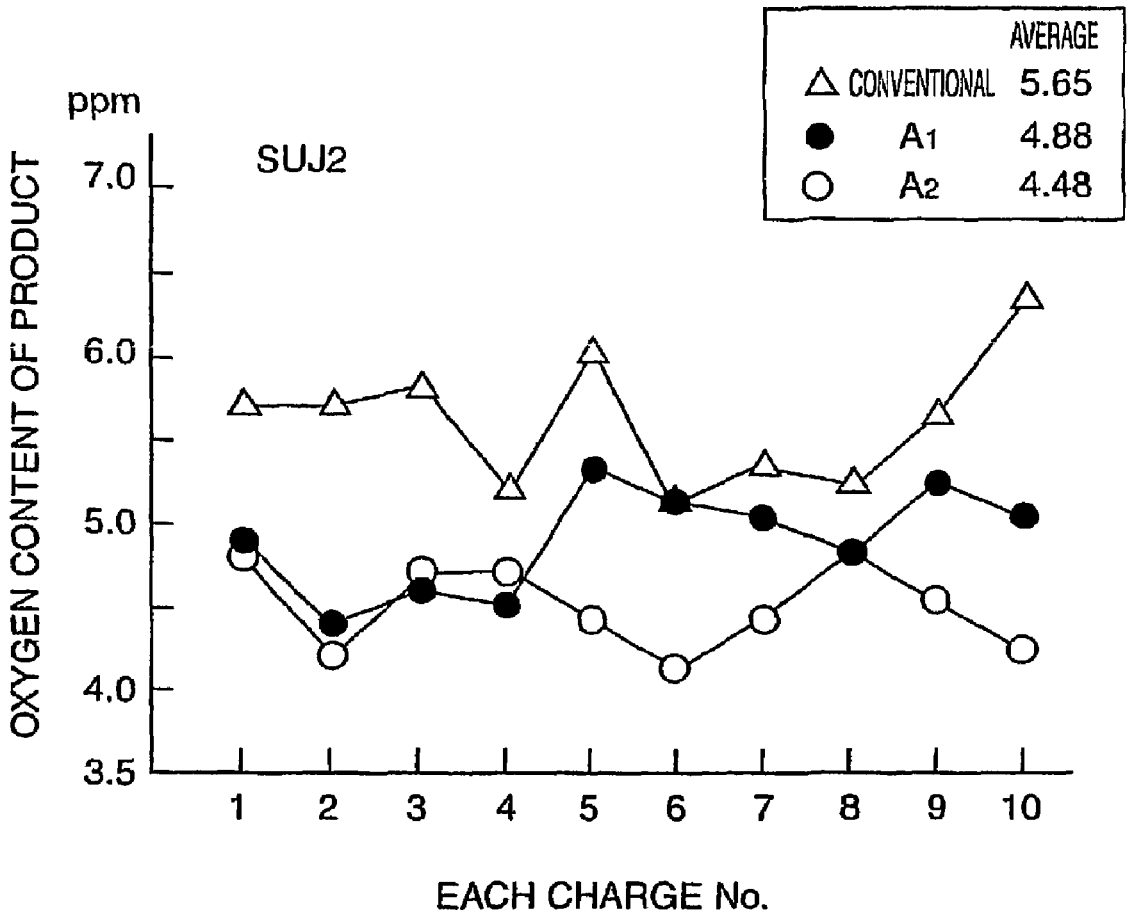
Figure 4B:
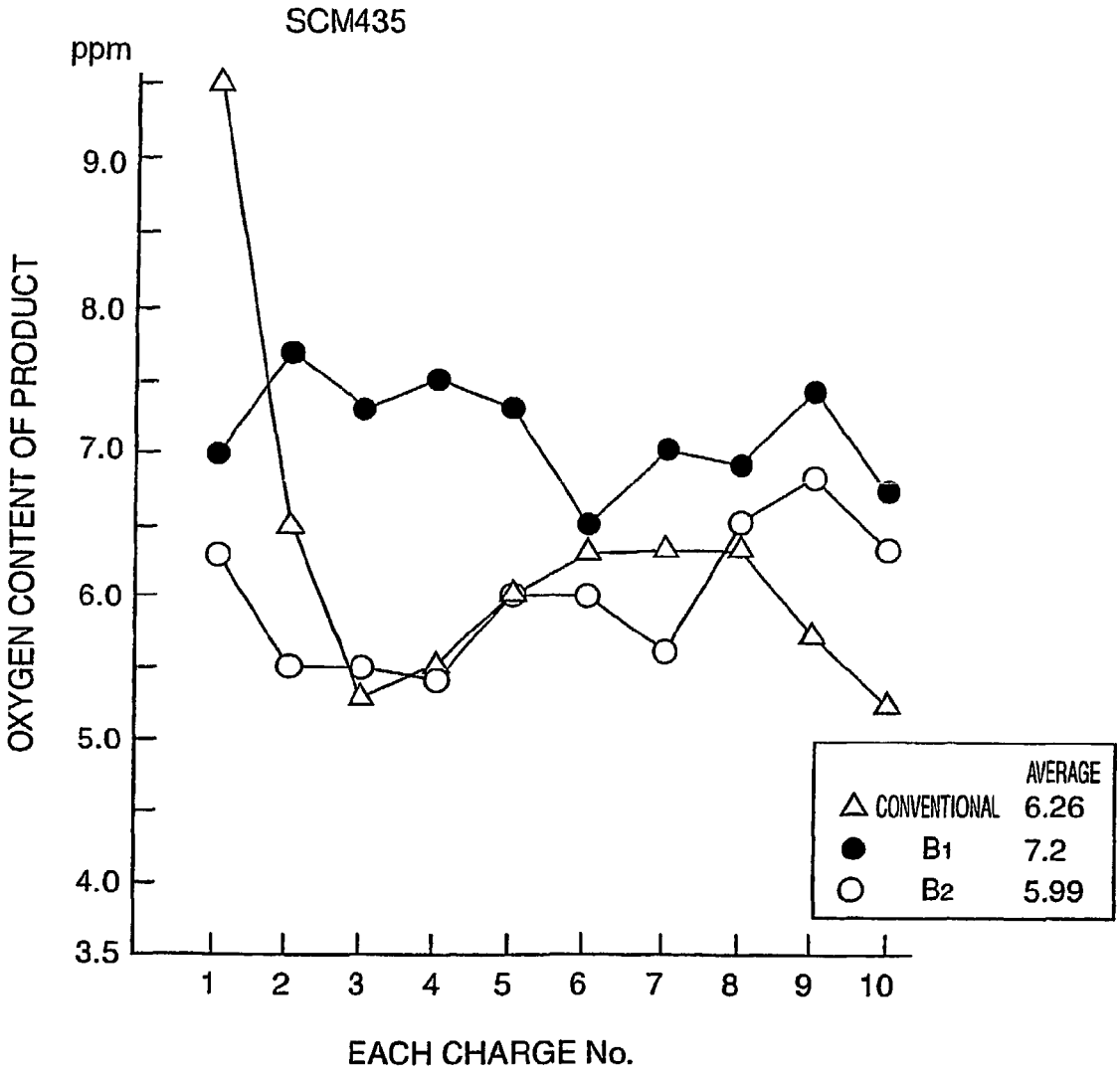
Figure 4C:
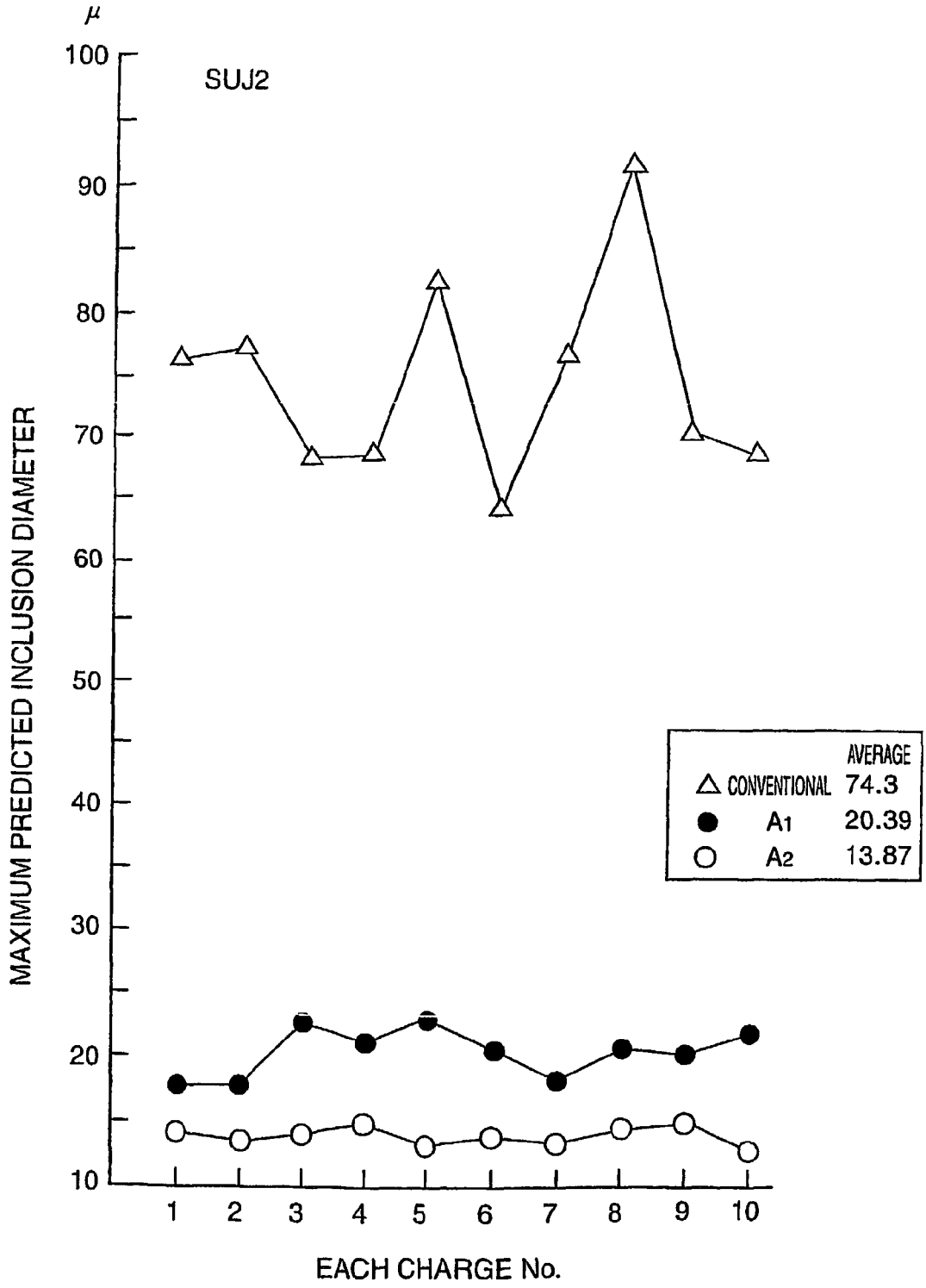
Figure 4D:
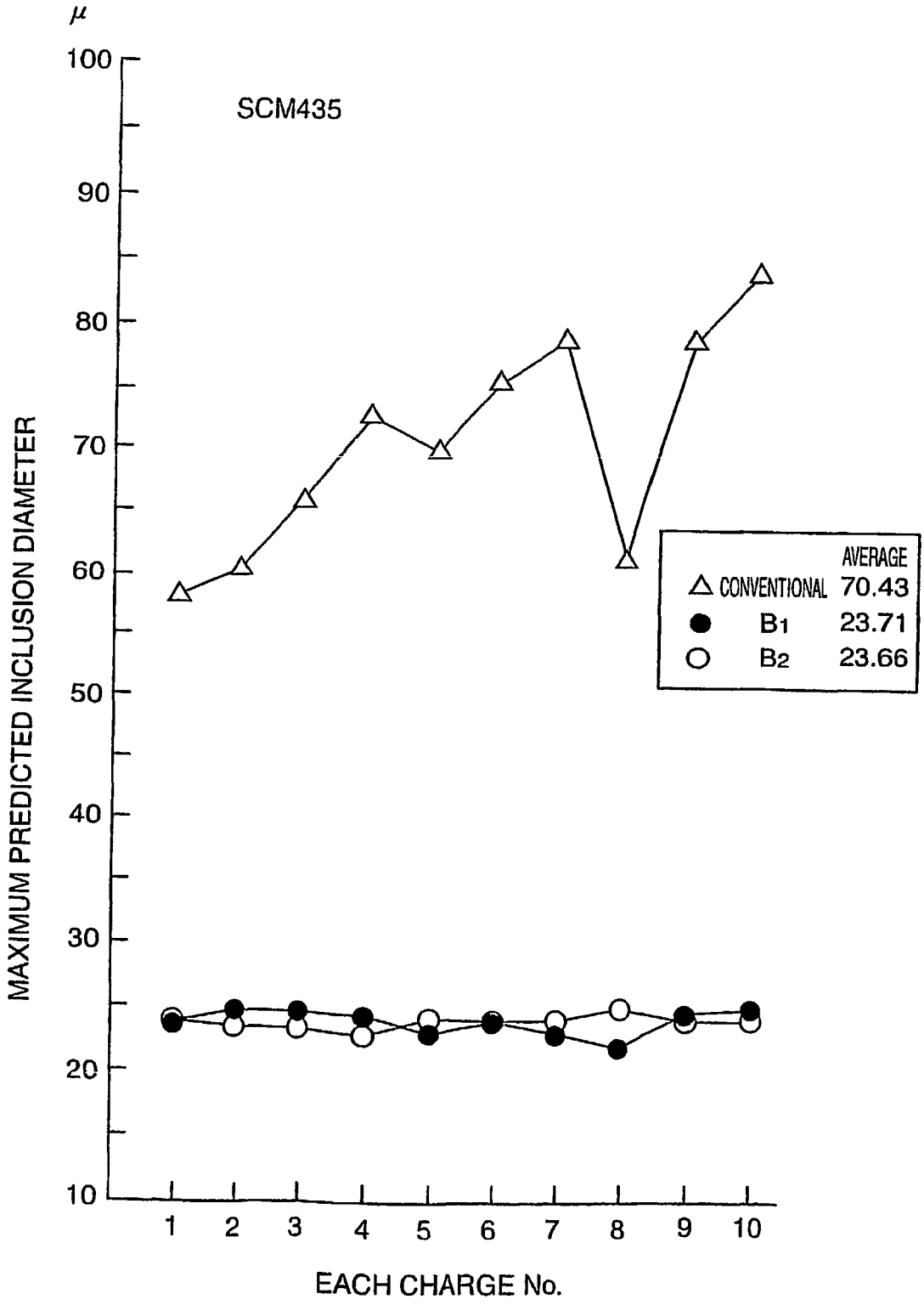
Figure 4E:
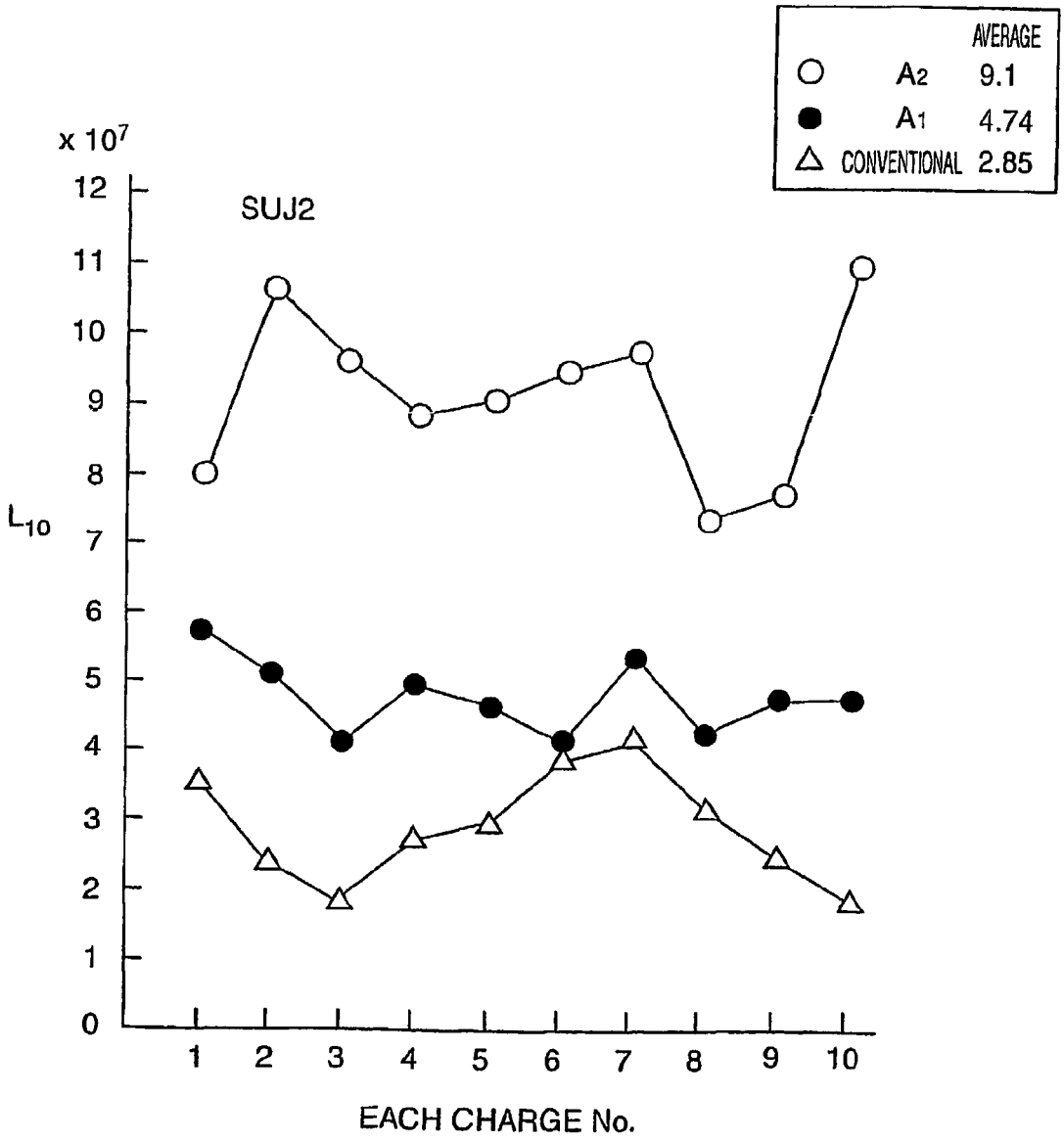
Figure 4F:
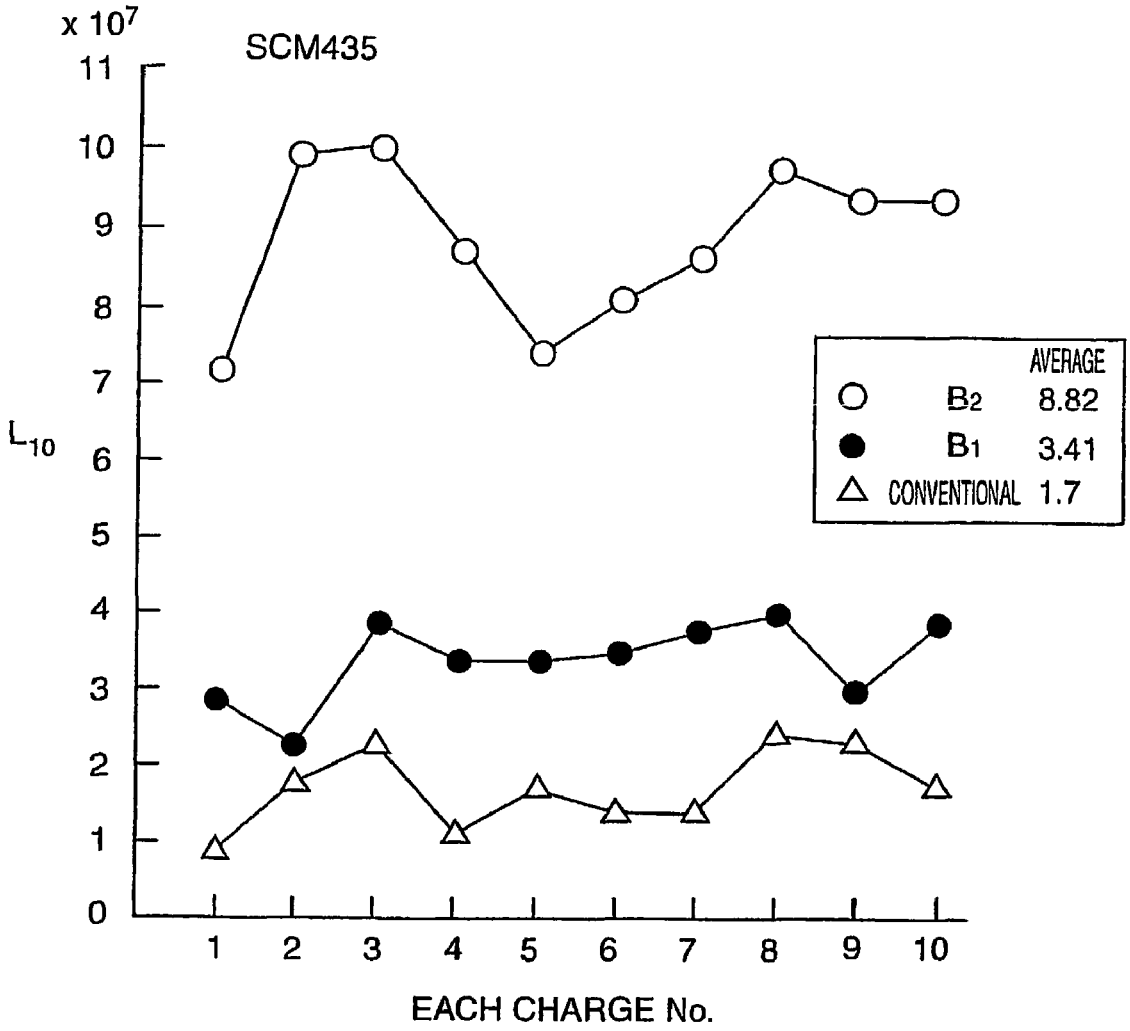

according to the process of the present invention using in-furnace deoxidation in the treatment of a molten steel of steel SUJ 2, and the $L_{10}$ life of products in 10 (heats) according to the conventional process wherein the in-furnace deoxidation is not carried out;

FIG. 3F is a diagram showing the $L_{10}$ life as determined by the thrust rolling service life test of products in 10 (heats) according to the process of the present invention using in-furnace deoxidation in the treatment of a molten steel of steel SCM 435, and the $L_{10}$ life of products in 10 (heats) according to the conventional process wherein the in-furnace deoxidation is not carried out;

FIG. 4A is a diagram showing the oxygen content of products in 10 (heats) according to the process of the present invention using short-time LF treatment and long-time RH treatment in treatment of a molten steel of steel SUJ 2, and the oxygen content of products in 10 (heats) according to the conventional process using long-time LF treatment and short-time RH treatment;

FIG. 4B is a diagram showing the oxygen content of products in 10 (heats) according to the process of the present invention using short-time LF treatment and long-time RH treatment in the treatment of a molten steel of steel SCM 435, and the oxygen content of products in 10 (heats) according to the conventional process using long-time LF treatment and short-time RH treatment;

FIG. 4C is a diagram showing the maximum predicted inclusion diameter according to statistics of extreme values in products in 10 (heats) according to the process of the present invention using short-time LF treatment and long-time RH treatment in treatment of a molten steel of steel SUJ 2, and the maximum predicted inclusion diameter in products in 10 (heats) according to the conventional process using long-time LF treatment and short-time RH treatment;

FIG. 4D is a diagram showing the maximum predicted inclusion diameter according to statistics of extreme values in products in 10 (heats) according to the process of the present invention using short-time LF treatment and long-time RH treatment in the treatment of a molten steel of steel SCM 435, and the maximum predicted inclusion diameter in products in 10 (heats) according to the conventional process using long-time LF treatment and short-time RH treatment;

FIG. 4E is a diagram showing the $L_{10}$ life as determined by the thrust rolling service life test of products in 10 (heats) according to the process of the present invention using short-time LF treatment and long-time RH treatment in treatment of a molten steel of steel SUJ 2, and the $L_{10}$ life of products in 10 (heats) according to the conventional process using long-time LF treatment and short-time RH treatment; and FIG. 4F is a diagram showing the $L_{10}$ life as determined by the thrust rolling service life test of products in 10 (heats) according to the process of the present invention using short-time LF treatment and long-time RH treatment in treatment of a molten steel of steel SCM 435, and the $L_{10}$ life of products in 10 (heats) according to the conventional process using long-time LF treatment and short-time RH treatment.

BEST MODE FOR CRYING OUT THE INVENTION

First Invention

A preferred production process of a high-cleanliness steel according to the first invention comprises the following steps (1) to (5).

(1) In the conventional steel production process using a refining furnace, such as an arc melting furnace or a converter, melting and oxidizing refining are mainly carried out in the arc melting furnace or the converter, and the reduction period (deoxidation) is carried out in a ladle refining furnace. On the other hand, according to the present invention, a molten steel is subjected to oxidizing refining in an arc melting furnace or a converter. The molten steel is then brought to a predetermined chemical composition and a predetermined temperature, and, in tapping the molten steel from the melting furnace, a deoxidizer including manganese, aluminum, and silicon (form of alloy of manganese, aluminum, silicon, etc. is not critical) is added in an amount on a purity basis of not less than 1 kg per ton of the molten steel by previously placing the deoxidizer in the ladle, and/or by adding the deoxidizer to the molten steel in the course of tapping into the ladle, and, in some cases, a slag former, such as CaO, is simultaneously added. The addition of this deoxidizer is the step which is most important to the present invention. The addition of the deoxidizer before the ladle refining, which has hitherto been regarded as unnecessary, to reduce the oxygen content to some extent before the reduction period refining in the ladle furnace can finally realize the production of steels having low oxygen content. The reason for this is as follows. The deoxidation, in a system wherein the dissolved oxygen in the molten steel is present in a satisfactory amount of not less than 100 ppm, results in the formation of a relatively large deoxidation product which can be easily floated and can be separated. As a result, the total content of oxygen in the molten steel can be significantly lowered to not more than 50 ppm.

(2) The pre-deoxidized molten steel is transferred to a ladle furnace where the molten steel is subjected to reduction refining, and the chemical composition of the steel is regulated.

(3) The molten steel, which has been subjected to reduction refining and regulation of chemical composition, is degassed, particularly is circulated through a circulation-type vacuum degassing device to perform degassing, and the chemical composition of the steel is finally regulated.

(4) The molten steel, which has been degassed and subjected to final regulation of the chemical composition, is cast into an ingot.

(5) The ingot is rolled or forged as known in the art into a product shape which is then optionally heat treated to provide a steel product.

In the preferred production process of a high-cleanliness steel according to the present invention, among the steps (1) to (5), the step (2) of transferring the molten steel to a ladle furnace is carried out in such a manner that, while the molten steel is generally tapped at a temperature of about 50° C. above the melting point of the steel, in the present invention, the molten steel is tapped at a temperature of at least 100° C. above, preferably at least 120° C. above, more preferably 150° C. above, the melting point of the steel. By virtue of this, the deoxidizer added at the time of tapping and the metal and slag in the previous treatment can be completely dissolved or separated, whereby the separation and dropping of the metal and slag into the molten steel in an advanced refining state during the ladle refining, thereby increasing the oxygen content, can be prevented, and, at the same time, in the refining furnace, the initial slag forming property and the reactivity can be improved. Specifically, the reduced metal deposited in the previous treatment is oxidized in a period between the previous treatment and this treatment, and when the metal begins to dissolve in this reduction period operation, particularly at the end of the reduction period operation, the equilibrium condition is broken. As a result, the molten steel is partially contaminated. For this reason, the deposited metal is dissolved in the molten steel being tapped before the reduction, and, this dissolved metal, together with the tapped molten steel, is deoxidized.

In the above step, while a refining time longer than 60 min is generally regarded as offering a better effect, in the preferred production process of a high-cleanliness steel according to the present invention, the refining in the ladle refining furnace is carried out for not more than 60 min, preferably not more than 45 min, more preferably 25 to 45 min, and, while it is a general knowledge that a degassing time of less than 25 min suffices for satisfactory results, the degassing in the preferred production process of the present invention is carried out for not less than 25 min. In particular, in the circulation-type vacuum degassing device, it is a general knowledge that satisfactory results can be obtained by bringing the amount of the molten steel circulated to about 5 times the total amount of the molten steel. On the other hand, in the present invention, in the circulation-type vacuum degassing device, the amount of the molten steel circulated in the degassing is brought to at least 8 times, preferably at least 10 times, more preferably at least 15 times, larger than the total amount of the molten steel. By virtue of this constitution, the time of ladle refining, wherein refining is carried out while heating, can be brought to a minimum necessary time, and, in the step of degassing not involving heating, the floating separation time for oxide inclusions can be satisfactorily ensured. This can prevent an increase in oxygen content caused by the contamination from refractories or slag on the inner side of the ladle furnace, and, at the same time, the formation of large inclusions having a size of not less than about 20 μm can be prevented. In the circulation-type vacuum degassing, particularly since a nozzle is dipped in the molten steel and only the molten steel is circulated, the slag on the upper surface of the molten steel is in a satisfactorily quiet state. Therefore, the number of oxide inclusions from slag into the molten steel is fewer than that during the reduction period process in the ladle refining furnace. Therefore, in the pre-deoxidized molten steel, the adoption of a satisfactorily long degassing time can realize a significant reduction of even relatively small deoxidation products.

The present invention embraces a high-cleanliness steel produced by the above means.

The high-cleanliness steel according to the present invention is preferably a high-cleanliness steel, excellent particularly in rolling fatigue life, which is characterized in that the content of oxygen in the steel is not more than 10 ppm; preferably, when the content of carbon in the steel is less than 0.6% by mass, the content of oxygen in the steel is not more than 8 ppm; and, particularly preferably, in the case of C≧0.6% by mass, the oxygen content is not more than 6 ppm. It is generally known that lowering the oxygen content can contribute to improved rolling fatigue life. Among the steels produced by the production process according to the present invention, high-cleanliness steels having an oxygen content of not more than 10 ppm, preferably not more than 8 ppm in the case of C<0.6% by mass in the steel, particularly preferably not more than 6 ppm in the case of C≧0.6% by mass, stably exhibit excellent rolling fatigue life.

Further, the present invention embraces, among the above high-cleanliness steels, high-cleanliness steels possessing excellent rolling fatigue life and fatigue strength, which are characterized in that the number of oxide inclusions having a size of not less than 20 μm as detected by dissolving the steel product in an acid, for example, oxide inclusions having an $Al_2O_3$ content of not less than 50%, is not more than 40, preferably not more than 30, more preferably not more than 20, per 100 g of the steel product. This evaluation method for steel products reflects both the oxygen content and the maximum inclusion diameter in a predetermined volume. Regarding the fatigue strength, fatigue life, and quietness, in the case of steels having the same oxygen content, oxide inclusions having a certain large size are harmful, and, in particular, oxide inclusions having a size of not less than 20 μm are harmful. Therefore, among the steels produced by the process according to the present invention, steels, wherein the number of oxide inclusions having a size of not less than 20 μm as detected by dissolving the steel product in an acid is not more than 40, preferably not more than 30, particularly preferably not more than 20, per 100 g of the steel product, are high-cleanliness steels having both excellent rolling fatigue life and excellent fatigue strength and, in addition, excellent quietness.

The high-cleanliness steels according to the present invention further include high-cleanliness steels, which are excellent particularly in rotating bending fatigue strength and cyclic stress fatigue strength and are characterized in that, when the maximum inclusion diameter in 100 $mm^2$ of the cross-section of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm. The cyclic stress fatigue strength and the fatigue limit are known to greatly depend upon the maximum inclusion diameter in a predetermined volume. This is disclosed in Japanese Patent Laid-Open No. 194121/1999 of which the applicant is identical to that in the application of the present invention. High-cleanliness steels, wherein, for example, typically when the maximum inclusion diameter in 100 $mm^2$ of the cross-section of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm, stably exhibit excellent fatigue strength. In this case, the high-cleanliness steels have an oxygen content of not more than 10 ppm, preferably not more than 8 ppm in the case of C<0.6% by mass in the steel, particularly preferably not more than 6 ppm in the case of C≧0.6% by mass, and a predicted value of maximum inclusion diameter of not more than 60 μm, preferably not more than 40 μm, more preferably not more than 25 μm. The steels produced by the process according to the present invention are high-cleanliness steels possessing both excellent rolling fatigue life and excellent fatigue strength. While acid dissolution is a very time-consuming, troublesome work, the above method, which, without steel product dissolution work, can observe a certain area under a microscope to statistically predict the maximum inclusion diameter, is advantageously simple. Further, in particular, regarding fatigue created by cyclic stress of tensile compression, it is known that the maximum diameter of inclusions present at a site susceptible to failure is a great factor which governs the strength. This method, which can statistically predict this maximum diameter, is advantageous.

Second Invention

A preferred production process of a high-cleanliness steel according to the second invention comprises the following steps (1) to (6).

(1) A molten steel is subjected to oxidizing refining in an arc melting furnace or a converter to prepare a molten steel having a predetermined chemical composition and a predetermined temperature.

(2) The molten steel is then pre-degassed. Specifically, the molten steel is degassed, for example, by circulating the molten steel through a circulation-type vacuum degassing device. This step of degassing is most important to the present invention. In general, the molten steel produced in step (1) is directly subjected to reduction refining in a ladle furnace. By contrast, according to the present invention, the molten steel is pre-degassed before the reduction refining. This pre-degassing can contribute to significantly improved cleanliness of finally obtained steels.

(3) The molten steel degassed in step (2) is subjected to reduction refining and regulation of chemical composition in a ladle furnace.

(4) The molten steel, which has been subjected to reduction refining and regulation of chemical composition in step (3), is further degassed by circulating the molten steel through a circulation-type vacuum degassing device, and, in addition, the chemical composition of the steel is finally regulated.

(5) The molten steel, which has been degassed and subjected to final regulation of the chemical composition, is cast into an ingot.

(6) The ingot is rolled or forged into a product shape which is then optionally heat treated to provide a steel product.

In the preferred production process of a high-cleanliness steel according to the present invention, in the steps (1) to (6), in transferring the molten steel after step (2) to a ladle furnace for step (3), while the molten steel is generally tapped at a temperature of about 50° C. above the melting point of the steel, the molten steel is tapped at a temperature of at least 100° C. above, preferably at least 120° C. above, more preferably 150° C. above, the melting point of the steel. In the present specification, tapping at an elevated temperature is referred to as high-temperature tapping. By virtue of this constitution, the deoxidizer added at the time of tapping and the metal and slag in the previous treatment can be completely dissolved or separated, whereby the separation and dropping of the metal and slag into the molten steel in an advanced refining state during the ladle refining, thereby increasing the oxygen content, can be prevented, and, at the same time, in the refining furnace, the initial slag forming property and the reactivity can be improved. Specifically, the reduced metal deposited in the previous treatment is oxidized in a period between the previous treatment and this treatment, and when the metal begins to dissolve in this reduction period operation, particularly at the end of the reduction period operation, the equilibrium condition is broken. As a result, the molten steel is partially contaminated. For this reason, the deposited metal is dissolved in the molten steel being tapped before the reduction, and, this dissolved metal, together with the tapped molten steel, is deoxidized.

In the ladle refining in step (3), while a refining time longer than 60 min is generally regarded as offering a better effect, in the present invention, the refining in the ladle furnace in step (3) is carried out for not more than 60 min, preferably not more than 45 min, more preferably 25 to 45 min, and, regarding degassing after the ladle refining, while it is a general knowledge that a degassing time of less than 25 min suffices for satisfactory results, in the present invention, the degassing in the preferred production process of the present invention is carried out for not less than 25 min. In particular, in the circulation-type vacuum degassing device, it is a general knowledge that satisfactory results can be obtained by bringing the amount of the molten steel circulated to about 5 times the total amount of the molten steel. On the other hand, in the preferred production process, in the circulation-type vacuum degassing device, the amount of the molten steel circulated in the degassing is brought to at least 8 times, preferably at least 10 times, more preferably at least 15 times, larger than the total amount of the molten steel. By virtue of this constitution, the time of ladle refining, wherein refining is carried out while heating, can be brought to a minimum necessary time, and, in the step of degassing not involving heating, the floating separation time for oxide inclusions can be satisfactorily ensured. This can prevent an increase in oxygen content caused by the contamination from refractories or slag on the inner side of the ladle furnace, and, at the same time, the formation of large inclusions having a size of not less than about 20 μm can be prevented. In the circulation-type vacuum degassing, particularly since a nozzle is dipped in the molten steel and only the molten steel is circulated, the slag on the upper surface of the molten steel is in a satisfactorily quiet state. Therefore, the number of oxide inclusions from slag into the molten steel is fewer than that during the reduction period process in the ladle furnace. Therefore, in the pre-deoxidized molten steel, the adoption of a satisfactorily long degassing time can realize a significant reduction of even relatively small deoxidation products. In the present specification, this method is called short-time LF, long-time RH treatment or short LF, long RH treatment.

The present invention embraces a high-cleanliness steel produced by the above means.

The high-cleanliness steel according to the present invention is preferably a high-cleanliness steel, excellent particularly in rolling fatigue life, which is characterized in that the content of oxygen in the steel is not more than 10 ppm; preferably, when the content of carbon in the steel is less than 0.6% by mass, the content of oxygen in the steel is not more than 8 ppm; and, particularly preferably, in the case of $C \geqq 0.6\%$ by mass, the oxygen content is not more than 6 ppm. It is generally known that lowering the oxygen content can contribute to improved rolling fatigue life. Among the steels produced by the production process according to the present invention, high-cleanliness steels having an oxygen content of not more than 10 ppm, preferably not more than 8 ppm in the case of $C<0.6\%$ by mass in the steel, particularly preferably not more than 6 ppm in the case of $C \geqq 0.6\%$ by mass, stably exhibit excellent rolling fatigue life.

Further, according to a preferred embodiment, the steels produced according to the process of the present invention include high-cleanliness steels possessing excellent rolling fatigue life and fatigue strength, which are characterized in that the number of oxide inclusions having a size of not less than 20 μm as detected by dissolving the steel product in an acid, for example, oxide inclusions having an $Al_2O_3$ content of not less than 50%, is not more than 40, preferably not more than 30, more preferably not more than 20, per 100 g of the steel product. This evaluation method for steel products reflects both the oxygen content and the maximum inclusion diameter in a predetermined volume. Regarding the fatigue strength, fatigue life, and quietness, in the case of steels having the same oxygen content, oxide inclusions having a certain large size are harmful, and, in particular, oxide inclusions having a size of not less than 20 μm are harmful. Therefore, among the steels produced by the process according to the present invention, steels, wherein the number of oxide inclusions having a size of not less than 20 μm as detected by dissolving the steel product in an acid is not more than 40, preferably not more than 30, particularly preferably not more than 20, per 100 g of the steel product, are high-cleanliness steels having both excellent rolling fatigue life and excellent fatigue strength and, in addition, excellent quietness.

According to a preferred embodiment, the high-cleanliness steels according to the present invention further include high-cleanliness steels, which are excellent particularly in rotating bending fatigue strength and cyclic stress fatigue strength and are characterized in that, when the maximum inclusion diameter in 100 $mm^2$ of the cross-section of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm. The cyclic stress fatigue strength and the fatigue limit are known to greatly depend upon the maximum inclusion diameter in a predetermined volume. This is disclosed in Japanese Patent Laid-Open No. 194121/1999 of which the applicant is identical to that in the application of the present invention. High-cleanliness steels, wherein, for example, typically when the maximum inclusion diameter in 100 mm of the cross-section of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm, stably exhibit excellent fatigue strength. In this case, the high-cleanliness steels have an oxygen content of not more than 10 ppm, preferably not more than 8 ppm in the case of C<0.6% by mass in the steel, particularly preferably not more than 6 ppm in the case of C≧0.6% by mass, and a predicted value of maximum inclusion diameter of not more than 60 μm, preferably not more than 40 μm, more preferably not more than 25 μm. The steels produced by the process according to the present invention are high-cleanliness steels possessing both excellent rolling fatigue life and excellent fatigue strength. While acid dissolution is a very time-consuming, troublesome work, the above method, which, without steel product dissolution work, can observe a certain area under a microscope to statistically predict the maximum inclusion diameter, is advantageously simple. Further, in particular, regarding fatigue created by cyclic stress of tensile compression, it is known that the maximum diameter of inclusions present at a site susceptible to failure is a great factor which governs the strength. This method, which can statistically predict this maximum diameter, is advantageous.

Third Invention

A preferred production process of a high-cleanliness steel according to the third invention comprises the following steps (1) to (5).

(1) A molten steel is subjected to oxidizing refining in an arc melting furnace or a converter. Subsequently, in the same furnace, a deoxidizer including manganese, silicon, and aluminum (form of alloy of manganese, silicon, and aluminum, etc. is not critical) is added in an amount of not less than 2 kg per ton of the molten metal, and, in some cases, a slag former, such as CaO, is simultaneously added to deoxidize the molten steel. The deoxidized molten steel is then transferred to a ladle. The deoxidation in a steel making furnace, such as an arc melting furnace or a converter, is a most important step in the present invention. The deoxidation before the ladle refining, which has hitherto been regarded as unnecessary, to reduce the oxygen content to some extent before the ladle refining can finally realize the production of steels having low oxygen content.

(2) The molten steel transferred to the ladle is subjected to reduction refining and regulation of chemical composition in a ladle refining furnace.

(3) The molten steel, which has been subjected to reduction refining and regulation of chemical composition in step (2), is degassed by circulating the molten steel through a circulation-type vacuum degassing device, and, in addition, the chemical composition of the steel is finally regulated.

(4) The molten steel, which has been degassed and subjected to final regulation of the chemical composition in step (3), is cast into an ingot.

(5) The ingot is rolled or forged into a product shape which is then optionally heat treated to provide a steel product.

In the preferred production process of a high-cleanliness steel according to the present invention, regarding step (1), wherein the molten steel is transferred to the ladle furnace, among the steps (1) to (5), while the molten steel is generally tapped at a temperature of about 50° C. above the melting point of the steel, in the present invention, the molten steel is transferred at a temperature of at least 100° C. above, preferably at least 120° C. above, more preferably 150° C. above, the melting point of the steel. By virtue of this constitution, the metal deposited around the ladle can be fully dissolved in the molten steel, and the slag can also be fully floated, whereby the separation and dropping of the metal and slag into the molten steel in an advanced refining state during the ladle refining, thereby increasing the oxygen content, can be prevented.

According to a preferred embodiment, in the ladle refining in the above step, while a refining time longer than 60 min is generally regarded as offering a better effect, in the present invention, the refining in the ladle furnace is carried out for not more than 60 min, preferably not more than 45 min, more preferably 25 to 45 min, and, regarding degassing in step (3), while it is a general knowledge that a degassing time of less than 25 min suffices for satisfactory results, that is, it is a general knowledge that satisfactory results can be obtained by bringing the amount of the molten steel circulated to about 5 times the total amount of the molten steel, in the present invention, the amount of the molten steel circulated in the circulation-type degassing device is brought to at least 8 times, preferably at least 10 times, more preferably at least 15 times, larger than the total amount of the molten steel, to perform degassing for a long period of time, i.e., not less than 25 min. By virtue of this constitution, the time of ladle refining, wherein refining is carried out while heating, can be brought to a minimum necessary time, and, in the step of degassing not involving heating, the floating separation time for oxide inclusions can be satisfactorily ensured. This can prevent an increase in oxygen content caused by the contamination from refractories or slag on the inner side of the ladle refining furnace, and, at the same time, the formation of large inclusions having a size of not less than about 20 μm can be prevented. In the circulation-type vacuum degassing, particularly since a nozzle is dipped in the molten steel and only the molten steel is circulated, the slag on the upper surface of the molten steel is in a satisfactorily quiet state. Therefore, the number of oxide inclusions from slag into the molten steel is fewer than that during the reduction period process in the ladle refining furnace. Therefore, in the pre-deoxidized molten steel, the adoption of a satisfactorily long degassing time can realize a significant reduction of even relatively small deoxidation products. In the present specification, this method is called short-time LF, long-time RH treatment or short LF, long RH treatment.

The present invention embraces a high-cleanliness steel produced by the above means.

According to a preferred embodiment, the high-cleanliness steel according to the present invention is a high-cleanliness steel, excellent particularly in rolling fatigue life, which is characterized in that the content of oxygen in the steel is not more than 10 ppm; preferably, when the content of carbon in the steel is less than 0.6% by mass, the content of oxygen in the steel is not more than 8 ppm; and, particularly preferably, in the case of C≧0.6% by mass, the oxygen content is not more than 6 ppm. It is generally known that lowering the oxygen content can contribute to improved rolling fatigue life. Among the steels produced by the production process according to the present invention, high-cleanliness steels having an oxygen content of not more than 10 ppm, preferably not more than 8 ppm in the case of C<0.6% by mass in the steel, particularly preferably not more than 6 ppm in the case of C≧0.6% by mass, stably exhibit excellent rolling fatigue life.

Further, according to a preferred embodiment, the steels produced according to the process of the present invention include high-cleanliness steels possessing excellent rolling fatigue life and fatigue strength, which are characterized in that the number of oxide inclusions having a size of not less than 20 μm as detected by dissolving the steel product in an acid, for example, oxide inclusions having an $Al_2O_3$ content of not less than 50%, is not more than 40, preferably not more than 30, more preferably not more than 20, per 100 g of the steel product. This evaluation method for steel products reflects both the oxygen content and the maximum inclusion diameter in a predetermined volume. Regarding the fatigue strength, fatigue life, and quietness, in the case of steels having the same oxygen content, oxide inclusions having a certain large size are harmful, and, in particular, oxide inclusions having a size of not less than 20 μm are harmful. Therefore, among the steels produced by the process according to the present invention, steels, wherein the number of oxide inclusions having a size of not less than 20 μm (for example, having an $Al_2O_3$ content of not less than 50%) as detected by dissolving the steel product in an acid is not more than 40, preferably not more than 30, particularly preferably not more than 20, per 100 g of the steel product, are high-cleanliness steels having both excellent rolling fatigue life and excellent fatigue strength and, in addition, excellent quietness.

According to a preferred embodiment, the high-cleanliness steels according to the present invention further include high-cleanliness steels, which are excellent particularly in rotating bending fatigue strength and cyclic stress fatigue strength and are characterized in that, when the maximum inclusion diameter in 100 $mm^2$ of the cross-section of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm. The cyclic stress fatigue strength and the fatigue limit are known to greatly depend upon the maximum inclusion diameter in a predetermined volume. This is disclosed in Japanese Patent Laid-Open No. 194121/1999 of which the applicant is identical to that in the application of the present invention. High-cleanliness steels, wherein, for example, typically when the maximum inclusion diameter in 100 $mm^2$ of the cross-section of the steel product is measured in 30 sites, the predicted value of the maximum inclusion diameter in 30000 $mm^2$ as calculated according to statistics of extreme values is not more than 60 μm, preferably not more than 40 μm more preferably not more than 25 μm, stably exhibit excellent fatigue strength. In this case, the high-cleanliness steels have an oxygen content of not more than 10 ppm, preferably not more than 8 ppm in the case of C<0.6% by mass in the steel, particularly preferably not more than 6 ppm in the case of C≧0.6% by mass, and a predicted value of maximum inclusion diameter of not more than 60 μm, preferably not more than 40 μm, more preferably not more than 25 μm. The steels produced by the process according to the present invention are high-cleanliness steels possessing both excellent rolling fatigue life and excellent fatigue strength. While acid dissolution is a very time-consuming, troublesome work, the above method, which, without steel product dissolution work, can observe a certain area under a microscope to statistically predict the maximum inclusion diameter, is advantageously simple. Further, particularly in fatigue created by cyclic stress of tensile compression, it is known that the maximum diameter of inclusions present at a site susceptible to failure is a great factor which governs the strength. This method, which can statistically predict this maximum diameter, is advantageous.

Fourth Invention

A preferred production process of a high-cleanliness steel according to the fourth invention comprises the following steps (1) to (5).

(1) A molten steel is subjected to oxidizing refining in an arc melting furnace or a converter to prepare a molten steel having a predetermined chemical composition and a predetermined temperature which is then transferred to a ladle furnace.

(2) The molten steel transferred to the ladle furnace is subjected to reduction refining in a ladle furnace and the chemical composition of the molten steel is regulated. At that time, in the ladle furnace, it is general knowledge that a stirring time longer than 60 min provides a better effect. On the other hand, in the present invention, the refining time in the ladle refining is brought to not more than 60 min, preferably not more than 45 min, and still more preferably 25 to 45 min.

(3) The molten steel, which has been subjected to reduction refining and regulation of chemical composition in step (2), is degassed by circulating the molten steel through a circulation-type vacuum degassing device, and, in addition, the chemical composition of the steel is finally regulated. In this case, it is a general knowledge that the degassing time is less than 25 min and, in a circulation-type vacuum degassing device, satisfactory results are obtained by bringing the amount of the molten steel circulated to about 5 times the total amount of the molten steel. On the other hand, in the present invention, the amount of the molten steel circulated is brought to at least 8 times, preferably at least 10 times, more preferably at least 15 times the total amount of the molten steel, and the degassing is carried out for a longer period of time, that is, for not less than 25 min. The steps (2) and (3) are most important to the present invention. The ladle refining time for refining while heating in step (2) is brought to a necessary minimum time, and the degassing not involving heating in step (3), particularly circulation-type vacuum degassing is carried out in such a manner that a nozzle is dipped in the molten steel and only the molten steel is circulated. Therefore, the slag on the upper surface of the molten steel is in a satisfactorily quiet state, and, thus, the number of oxide inclusions from slag into the molten steel is fewer than that during the reduction period process in the ladle furnace. In this system, when the floating separation time for oxide inclusions is satisfactorily ensured, an increase in oxygen content caused by contamination from refractories or slag on the inner side of the ladle furnace can be prevented and, in addition, the formation of large inclusions having a size of not less than about 30 μm can be prevented. This can realize the production of high-cleanliness steels.

(4) The molten steel, which has been subjected to final regulation of the chemical composition in step (3), is cast into an ingot.

(5) The ingot is rolled or forged into a product shape which is then optionally heat treated to provide a steel product.

In the production process of a high-cleanliness steel, according to a preferred embodiment, in the steps (1) to (5), in transferring the molten steel after step (1) to the ladle refining furnace, while the molten steel is generally tapped at a temperature of about 50° C. above the melting point of the steel, in the present invention, the molten steel is tapped at a temperature of at least 100° C. above, preferably at least 120° C. above, more preferably 150° C. above, the melting point of the steel. By virtue of this constitution, the metal deposited around the ladle furnace can be fully dissolved in the molten steel, and the slag can be fully floated, whereby the separation and dropping of the metal and slag into the molten steel in an advanced refining state during the ladle refining, thereby increasing the oxygen content, can be prevented.

The present invention embraces a high-cleanliness steel produced by the above means.

According to a preferred embodiment, the high-cleanliness steel according to the present invention is a high-cleanliness steel, excellent particularly in rolling fatigue life, which is characterized in that the content of oxygen in the steel is not more than 10 ppm; preferably, when the content of carbon in the steel is less than 0.6% by mass, the content of oxygen in the steel is not more than 8 ppm; and, particularly preferably, in the case of C≧0.6% by mass, the oxygen content is not more than 6 ppm. It is generally known that lowering the oxygen content can contribute to improved rolling fatigue life. Among the steels produced by the production process according to the present invention, high-cleanliness steels having an oxygen content of not more than 10 ppm, preferably not more than 8 ppm in the case of C<0.6% by mass in the steel, particularly preferably not more than 6 ppm in the case of C≧0.6% by mass, stably exhibit excellent rolling fatigue life.

Further, according to a preferred embodiment, the steels produced according to the process of the present invention include high-cleanliness steels possessing excellent rolling fatigue life and fatigue strength, which are characterized in that the number of oxide inclusions having a size of not less than 20 μm as detected by dissolving the steel product in an acid, for example, oxide inclusions having an $Al_2O_3$ content of not less than 50%, is not more than 40, preferably not more than 30, more preferably not more than 20, per 100 g of the steel product. This evaluation method for steel products reflects both the oxygen content and the maximum inclusion diameter in a predetermined volume. Regarding the fatigue strength, fatigue life, and quietness, in the case of steels having the same oxygen content, oxide inclusions having a certain large size are harmful, and, in particular, oxide inclusions having a size of not less than 20 μm are harmful. Therefore, among the steels produced by the process according to the present invention, steels, wherein the number of oxide inclusions having a size of not less than 20 μm (for example, having an $Al_2O_3$ content of not less than 50%) as detected by dissolving the steel product in an acid is not more than 40, preferably not more than 30, more preferably not more than 20, per 100 g of the steel product, are high-cleanliness steels having both excellent rolling fatigue life and excellent fatigue strength and, in addition, excellent quietness.

According to a preferred embodiment, the steels according to the present invention further include high-cleanliness steels, which are excellent particularly in rotating bending fatigue strength and cyclic stress fatigue strength and are characterized in that, when the maximum inclusion diameter in 100 $mm^2$ of the cross-section of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm. The cyclic stress fatigue strength and the fatigue limit are known to greatly depend upon the maximum inclusion diameter in a predetermined volume. This is disclosed in Japanese Patent Laid-Open No. 194121/1999 of which the applicant is identical to that in the application of the present invention. High-cleanliness steels, wherein, for example, typically when the maximum inclusion diameter in 100 $mm^2$ of the cross-section of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm, stably exhibit excellent fatigue strength. In this case, the high-cleanliness steels have an oxygen content of not more than 10 ppm, preferably not more than 8 ppm in the case of C<0.6% by mass in the steel, particularly preferably not more than 6 ppm in the case of C≧0.6% by mass, and a predicted value of maximum inclusion diameter of not more than 60 μm, preferably not more than 40 μm, more preferably not more than 25 μm. The steels produced by the process according to the present invention are high-cleanliness steels possessing both excellent rolling fatigue life and excellent fatigue strength. While acid dissolution is a very time-consuming, troublesome work, the above method, which, without steel product dissolution work, can observe a certain area under a microscope to statistically predict the maximum inclusion diameter, is advantageously simple. Further, particularly in fatigue created by cyclic stress of tensile compression, it is known that the maximum diameter of inclusions present at a site susceptible to failure is a great factor which governs the strength. This method, which can statistically predict this maximum diameter, is advantageous.

Fifth Invention

A preferred production process of a high-cleanliness steel according to the fifth invention comprises the following steps (1) to (5).

(1) A molten steel is subjected to oxidizing refining in an arc melting furnace or a converter to prepare a molten steel having a predetermined chemical composition and a predetermined temperature which is then transferred to a ladle furnace.

(2) The molten steel transferred to the ladle refining furnace is subjected to reduction refining in the ladle furnace and the chemical composition of the molten steel is regulated. At that time, in the ladle furnace, a stirring gas is blown through the bottom of the ladle at 1.5 to 5.0 N.l/min/t to forcibly agitate the molten steel, and, in addition, electromagnetic stirring is carried out. Thus, ladle refining is carried out for 50 to 80 min, preferably 70 to 80 min.

(3) The molten steel, which has been subjected to reduction refining and regulation of chemical composition in step (2), is degassed by circulating the molten steel through a circulation-type vacuum degassing device, and, in addition, the chemical composition of the steel is finally regulated. In this case, it is a general knowledge that the degassing time is less than 25 min and, in a circulation-type vacuum degassing device, satisfactory results are obtained by bringing the amount of the molten steel circulated to about 5 times the total amount of the molten steel. On the other hand, in the present invention, the amount of the molten steel circulated is brought to at least 8 times, preferably at least 10 times, more preferably at least 15 times the total amount of the molten steel, and the degassing is carried out for a longer period of time, that is, for not less than 25 min. The steps (2) and (3) are most important to the fifth invention. In the ladle refining time for refining while gas stirring and electromagnetic stirring in step (2), even when the refining is not short-time refining, that is, even refining for a long period of time, i.e., 50 to 80 min, preferably 70 to 80 min, can also satisfactorily enhance the cleanliness. The stirring energy of the electromagnetic stirring is brought to 200 to 700 w per ton of the molten steel. As described above, the electromagnetic stirring does not agitate slag itself. Therefore, it is possible to prevent breaking of the slag equilibrium system caused by melt loss of refractories of the furnace and the inclusion of slag. Further, since degassing, particularly circulation-type vacuum degassing, is carried out in such a manner that a nozzle is dipped in the molten steel and only the molten steel is circulated, the slag on the upper surface of the molten steel is in a satisfactorily quiet state, and the number of oxide inclusions from slag into the molten steel is fewer than that during the reduction period process in the ladle. In this system, when the floating separation time for oxide inclusions is satisfactorily ensured, an increase in oxygen content caused by contamination from refractories or slag on the inner side of the ladle can be prevented and, in addition, the formation of large inclusions having a size of not less than about 30 μm can be prevented. This can realize the production of high-cleanliness steels.

(4) The molten steel, which has been subjected to final regulation of the chemical composition, is cast into an ingot.

(5) The ingot is rolled or forged into a product shape which is then optionally heat treated to provide a steel product.

In the production process of a high-cleanliness steel, according to a preferred embodiment, in the ladle refining in step (2) among the steps (1) to (5), particularly the ladle is brought to an inert atmosphere and thus is blocked from the air, and, in this state, ladle refining is carried out (step 6). In this preferred embodiment of the present invention, step (6) is most important to the present invention.

The practice of the ladle refining in an inert atmosphere while blocking from the air in step (6), in combination of the ladle refining wherein refining is carried out by gas stirring in combination with electromagnetic stirring in step (2), permits, even when the refining is not short-time refining, that is, even refining for a long period of time, i.e., 50 to 80 min, preferably 70 to 80 min, to satisfactorily enhance the cleanliness. Specifically, the ladle is covered. The space defined by the cover is filled with an inert gas, for example, an argon gas, a nitrogen gas, or a mixed gas composed of an argon gas and a nitrogen gas to seal the molten steel in the ladle from the air. Thus, the equilibrium system of the slag is maintained. Preferably, the pressure of the inert gas within the cover is reduced to not more than 10 Torr. This can further enhance the effect. According to this constitution, the slag can be fully floated, and the separation and dropping of the metal and slag into the molten steel in an advanced refining state during the ladle refining, thereby increasing the oxygen content, can be prevented. The sealing gas is a gas of not less than 50 $Nm^3/H$, and, in the case of refining under reduced pressure, a gas flow rate below this range is also possible.

The present invention embraces a high-cleanliness steel produced by the above means.

According to a preferred embodiment, the high-cleanliness steel according to the present invention is a high-cleanliness steel, excellent particularly in rolling fatigue life, which is characterized in that the content of oxygen in the steel is not more than 10 ppm; preferably, when the content of carbon in the steel is less than 0.6% by mass, the content of oxygen in the steel is not more than 8 ppm. It is particularly preferably, in the case of C≧0.6% by mass, that the oxygen content is not more than 6 ppm. It is generally known that lowering the oxygen content can contribute to improved rolling fatigue life. Among the steels produced by the production process according to the present invention, high-cleanliness steels having an oxygen content of not more than 10 ppm, preferably not more than 8 ppm in the case of C<0.6% by mass in the steel, particularly preferably not more than 6 ppm in the case of C≧0.6% by mass, stably exhibit excellent rolling fatigue life.

Further, according to a preferred embodiment, the steels produced according to the process of the present invention include high-cleanliness steels possessing excellent rolling fatigue life and fatigue strength, which are characterized in that the number of oxide inclusions having a size of not less than 20 μm as detected by dissolving the steel product in an acid, for example, oxide inclusions having an $Al_2O_3$ content of not less than 50%, is not more than 40, preferably not more than 30, more preferably not more than 20, per 100 g of the steel product. This evaluation method for steel products reflects both the oxygen content and the maximum inclusion diameter in a predetermined volume. Regarding the fatigue strength, fatigue life, and quietness, in the case of steels having the same oxygen content, oxide inclusions having a certain large size are harmful, and, in particular, oxide inclusions having a size of not less than 20 μm are harmful. Therefore, among the steels produced by the process according to the present invention, steels, wherein the number of oxide inclusions having a size of not less than 20 μm (for example, having an $Al_2O_3$ content of not less than 50%) as detected by dissolving the steel product in an acid is not more than 40, preferably not more than 30, more preferably not more than 20, per 100 g of the steel product, are high-cleanliness steels having both excellent rolling fatigue life and excellent fatigue strength and, in addition, excellent quietness.

According to a preferred embodiment, the steels according to the present invention further include high-cleanliness steels, which are excellent particularly in rotating bending fatigue strength and cyclic stress fatigue strength and are characterized in that, when the maximum inclusion diameter in 100 $mm^2$ of the cross-section of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm. The cyclic stress fatigue strength and the fatigue limit are known to greatly depend upon the maximum inclusion diameter in a predetermined volume. This is disclosed in Japanese Patent Laid-Open No. 194121/1999 of which the applicant is identical to that in the application of the present invention. High-cleanliness steels, wherein, for example, typically when the maximum inclusion diameter in 100 $mm^2$ of the cross-section of the steel product is measured in 30 sites, the predicted value of the maximum inclusion diameter in 30000 $mm^2$ as calculated according to statistics of extreme values is not more than 60 μm, preferably not more than 40 μm, more preferably not more than 25 μm, stably exhibit excellent fatigue strength. In this case, the high-cleanliness steels have an oxygen content of not more than 10 ppm, preferably not more than 8 ppm in the case of C<0.6% by mass in the steel, particularly preferably not more than 6 ppm in the case of C≧0.6% by mass, and a predicted value of maximum inclusion diameter of not more than 60 μm preferably not more than 40 μm, more preferably not more than 25 μm. The steels produced by the process according to the present invention are high-cleanliness steels possessing both excellent rolling fatigue life and excellent fatigue strength. While acid dissolution is a very time-consuming, troublesome work, the above method, which, without steel product dissolution work, can observe a certain area under a microscope to statistically predict the maximum inclusion diameter, is advantageously simple.

Further, particularly in fatigue created by cyclic stress of tensile compression, it is known that the maximum diameter of inclusions present at a site susceptible to failure is a great factor which governs the strength. This method, which can statistically predict this maximum diameter, is advantageous.

EXAMPLE A

In tapping a molten steel, which had been subjected to oxidizing refining in an arc melting furnace, from the melting furnace, dexoidizers, such as manganese, aluminum, and silicon, were previously added to a ladle or alternatively were added to the molten steel in the course of the tapping. The amount of the deoxidizers added was not less than 1 kg on a purity basis per ton of the molten steel to perform tapping deoxidation, that is, pre-deoxidation. The molten steel was then subjected to reduction refining in a ladle refining process, and the refined molten steel was degassed in a circulation-type vacuum degassing device, followed by an ingot production process using casting. Steel products of JIS SUJ 2 and SCM 435 in 10 heats thus obtained were examined for the oxygen content of the products, the predicted value of the maximum inclusion diameter according to statistics of extreme values, and $L_{10}$ service life by a thrust-type rolling service life test. In the measurement of the predicted value of the maximum inclusion diameter, a test piece was taken off from a ϕ65 forged material, the observation of 100 $mm^2$ was carried out for 30 test pieces, and the maximum inclusion diameter in 30000 $mm^2$ was predicted according to statistics of extreme values. In the thrust-type rolling service life test, a test piece having a size of ϕ60×ϕ20×8.3T, which had been subjected to carburizing, quench hardening and tempering, was tested at a maximum hertz stress Pmax: 4900 MPa, followed by calculation to determine the $L_{10}$ service life.

An example of operation according to the present invention for 10 heats of steel SUJ 2 is shown in Table A1.

TABLE A1

| Operation | Tapping deoxidation ($A_1$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Tapping temp.: m.p. + ° C. | 62 | 56 | 52 | 57 | 65 | 60 | 75 | 65 | 57 | 73 |
| Amount of deoxidizer added at the time of tapping or added to ladle, kg/t | 1.9 | 3 | 2.2 | 2.8 | 1.3 | 1.9 | 2.9 | 2 | 2.8 | 1 |
| LF: Time, min | 55 | 51 | 56 | 56 | 60 | 57 | 59 | 57 | 60 | 55 |
| LF: Termination temp., ° C. | 1525 | 1526 | 1521 | 1520 | 1526 | 1524 | 1525 | 1522 | 1526 | 1523 |
| RH: Time, min | 23 | 23 | 23 | 23 | 23 | 23 | 23 | 23 | 23 | 23 |
| RH: Quantity of circulation, times | 5.7 | 6.5 | 7.1 | 5.5 | 6.7 | 6.4 | 5.6 | 6.8 | 5.7 | 7 |
| RH: Termination temp., ° C. | 1499 | 1493 | 1492 | 1498 | 1502 | 1502 | 1492 | 1497 | 1500 | 1499 |
| Casting temp., ° C. | 1475 | 1476 | 1476 | 1475 | 1478 | 1478 | 1475 | 1477 | 1476 | 1475 |
| Oxygen content of product, ppm | 4.9 | 5.6 | 4.8 | 5.2 | 5.3 | 5.3 | 4.9 | 4.9 | 5.8 | 5.1 |
| Number of inclusions of not less than 20 μm in 100 g of steel product | 38 | 33 | 30 | 26 | 27 | 35 | 32 | 34 | 31 | 36 |
| Maximum predicted diameter of inclusions, μm | 49 | 44.8 | 38.4 | 52 | 47.7 | 42.4 | 49 | 49 | 52.2 | 40.8 |
| $L_{10}$ (× $10^7$) | 2.2 | 1.9 | 3.1 | 3.0 | 2.5 | 2.4 | 2.7 | 3.5 | 2.9 | 2.8 |
| Results of evaluation | Δ | Δ | Δ | Δ | Δ | Δ | Δ | Δ | Δ | Δ |

An example of the operation according to the present invention for 10 heats of steel SCM 435 is shown in Table A2.

TABLE A2

| Operation | Tapping deoxidation ($B_1$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Tapping temp.: m.p. + ° C. | 68 | 54 | 69 | 61 | 74 | 68 | 62 | 67 | 55 | 65 |
| Amount of deoxidizer added at the time of tapping or added to ladle, kg/t | 2.5 | 1.8 | 2.5 | 1.9 | 1.5 | 1.6 | 1.7 | 1.5 | 1.5 | 2.6 |
| LF: Time, min | 55 | 51 | 57 | 56 | 59 | 53 | 60 | 53 | 54 | 51 |
| LF: Termination temp., ° C. | 1565 | 1574 | 1567 | 1571 | 1570 | 1569 | 1572 | 1575 | 1565 | 1573 |
| RH: Time, min | 22 | 22 | 21 | 20 | 23 | 20 | 24 | 23 | 20 | 21 |
| RH: Quantity of circulation, times | 6.8 | 6.0 | 6.6 | 5.7 | 5.9 | 5.5 | 7.0 | 6.5 | 7.0 | 6.3 |
| RH: Termination temp., ° C. | 1531 | 1533 | 1537 | 1534 | 1531 | 1532 | 1539 | 1541 | 1539 | 1536 |
| Casting temp., ° C. | 1514 | 1518 | 1518 | 1520 | 1520 | 1516 | 1520 | 1520 | 1512 | 1516 |
| Oxygen content of product, ppm | 7.9 | 6.7 | 8.0 | 7.4 | 7.9 | 6.5 | 8.3 | 7.9 | 7.9 | 6.9 |
| Number of inclusions of not less than 20 μm in 100 g of steel product | 40 | 33 | 35 | 39 | 35 | 25 | 25 | 30 | 37 | 36 |
| Maximum predicted diameter of inclusions, μm | 47.4 | 46.9 | 48.0 | 51.8 | 55.3 | 45.5 | 49.8 | 55.3 | 55.3 | 45.4 |

TABLE A2-continued

| Operation | Tapping deoxidation ($B_1$) | | | | | | | | | |
|---|---|---|---|---|---|---|---|---|---|---|
| No. | 1 | 2 | 3 | 4 | 5 | 6 | 7 | 8 | 9 | 10 |
| $L_{10}$ ($\times 10^7$) | 1.2 | 1.9 | 1.8 | 2.1 | 1.5 | 2.8 | 2.7 | 1.2 | 2.4 | 2.1 |
| Results of evaluation | Δ | Δ | Δ | Δ | Δ | Δ | Δ | Δ | Δ | Δ |

Δ: Fair

An example of the operation according to the present invention for 10 heats of steel SUJ 2 is shown in Table A3.

TABLE A3

| Operation | Tapping deoxidation + tapping temp. ($A_2$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Tapping temp.: m.p. + ° C. | 147 | 148 | 116 | 145 | 155 | 152 | 139 | 113 | 152 | 126 |
| Amount of deoxidizer added at the time of tapping or added to ladle, kg/t | 2.7 | 1.5 | 2.3 | 1.7 | 1.7 | 2.7 | 1.9 | 2.3 | 1.1 | 2.7 |
| LF: Time, min | 56 | 60 | 59 | 51 | 53 | 53 | 52 | 52 | 58 | 53 |
| LF: Termination temp., ° C. | 1524 | 1520 | 1521 | 1523 | 1523 | 1520 | 1523 | 1525 | 1525 | 1522 |
| RH: Time, min | 23 | 23 | 23 | 23 | 23 | 23 | 23 | 23 | 23 | 23 |
| RH: Quantity of circulation, times | 6 | 6.5 | 5.5 | 6.3 | 5.9 | 6.7 | 6.4 | 6.1 | 6.7 | 6.3 |
| RH: Termination temp., ° C. | 1498 | 1501 | 1502 | 1500 | 1503 | 1498 | 1502 | 1497 | 1494 | 1501 |
| Casting temp., ° C. | 1478 | 1476 | 1476 | 1476 | 1477 | 1476 | 1478 | 1475 | 1478 | 1476 |
| Oxygen content of product, ppm | 5.2 | 5.1 | 5 | 4.6 | 4.9 | 5.1 | 4.5 | 5.2 | 4.9 | 4.7 |
| Number of inclusions of not less than 20 μm in 100 g of steel product | 30 | 28 | 28 | 26 | 25 | 22 | 23 | 16 | 25 | 30 |
| Maximum predicted diameter of inclusions, μm | 20.8 | 20.4 | 20 | 23 | 24.5 | 25.5 | 22.5 | 26 | 24.5 | 23.5 |
| $L_{10}$ ($\times 10^7$) | 3.4 | 3.7 | 4.7 | 4.0 | 4.1 | 2.6 | 3.3 | 4.9 | 3.9 | 5.2 |
| Results of evaluation | ○ | ○ | ○ | ○ | ○ | ○ | ○ | ○ | ○ | ○ |

○: Good

An example of the operation according to the present invention for 10 heats of steel SCM 435 is shown in Table A4.

TABLE A4

| Operation | Tapping deoxidation + tapping temp. ($B_2$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Tapping temp.: m.p. + ° C. | 104 | 119 | 138 | 116 | 119 | 147 | 114 | 141 | 110 | 113 |
| Amount of deoxidizer added at the time of tapping or added to ladle, kg/t | 2 | 2.8 | 1.9 | 2.2 | 2.9 | 2.5 | 1.7 | 1.6 | 1.5 | 2.9 |
| LF: Time, min | 49 | 51 | 52 | 51 | 52 | 47 | 53 | 51 | 51 | 47 |
| LF: Termination temp., ° C. | 1565 | 1572 | 1572 | 1572 | 1573 | 1572 | 1575 | 1566 | 1572 | 1567 |
| RH: Time, min | 24 | 20 | 22 | 21 | 23 | 20 | 24 | 22 | 23 | 22 |
| RH: Quantity of circulation, times | 6.5 | 6.1 | 5.5 | 7.2 | 6.6 | 6.5 | 7.1 | 5.8 | 7.3 | 7.0 |
| RH: Termination temp., ° C. | 1533 | 1538 | 1532 | 1534 | 1540 | 1538 | 1538 | 1536 | 1538 | 1538 |
| Casting temp., ° C. | 1519 | 1517 | 1517 | 1511 | 1516 | 1515 | 1513 | 1516 | 1511 | 1513 |
| Oxygen content of product, ppm | 7.1 | 7.3 | 7.1 | 7.4 | 6.5 | 6.8 | 7.1 | 7.1 | 6.9 | 6.4 |
| Number of inclusions of not less than 20 μm in 100 g of steel product | 28 | 29 | 20 | 25 | 30 | 28 | 29 | 26 | 22 | 20 |
| Maximum predicted diameter of inclusions, μm | 37.6 | 38.5 | 38.3 | 39.3 | 34.5 | 35.6 | 37.8 | 36.2 | 34.5 | 32.6 |
| $L_{10}$ ($\times 10^7$) | 2.9 | 2.8 | 2.4 | 3.0 | 3.6 | 3.3 | 3.4 | 3.1 | 2.8 | 3.3 |
| Results of evaluation | ○ | ○ | ○ | ○ | ○ | ○ | ○ | ○ | ○ | ○ |

○: Good

An example of the operation of tapping deoxidation+short LF, long RH according to the present invention for 10 heats of steel SUJ 2 is shown in Table A5.

TABLE A5

| Operation | Tapping deoxidation + short LF, long RH ($A_3$) | | | | | | | | | |
|---|---|---|---|---|---|---|---|---|---|---|
| No. | 1 | 2 | 3 | 4 | 5 | 6 | 7 | 8 | 9 | 10 |
| Type of Steel | SUJ 2 | SUJ 2 | SUJ 2 | SUJ 2 | SUJ 2 | SUJ 2 | SUJ 2 | SUJ 2 | SUJ 2 | SUJ 2 |
| Tapping temp.: m.p. + ° C. | 66 | 80 | 61 | 79 | 55 | 66 | 68 | 65 | 67 | 60 |
| Amount of deoxidizer added at the time of tapping or added to ladle, kg/t | 1.8 | 1.7 | 3 | 1.6 | 2.6 | 2.7 | 2.8 | 2.2 | 3 | 2 |
| LF: Time, min | 41 | 34 | 33 | 31 | 38 | 30 | 40 | 32 | 39 | 44 |
| LF: Termination temp., ° C. | 1546 | 1547 | 1548 | 1549 | 1550 | 1551 | 1552 | 1553 | 1554 | 1555 |
| RH: Time, min | 56 | 57 | 59 | 54 | 55 | 55 | 54 | 57 | 60 | 58 |
| RH: Quantity of circulation, times | 18.7 | 19.0 | 19.7 | 18.0 | 18.3 | 18.3 | 18.0 | 19.0 | 20.0 | 19.3 |
| RH: Termination temp., ° C. | 1502 | 1510 | 1506 | 1502 | 1505 | 1508 | 1503 | 1508 | 1506 | 1508 |
| Casting temp., ° C. | 1478 | 1477 | 1477 | 1478 | 1477 | 1478 | 1478 | 1475 | 1477 | 1476 |
| Oxygen content of product, ppm | 4.8 | 4 | 4.1 | 4.6 | 5.2 | 4.8 | 4.5 | 4.2 | 4.2 | 4.4 |
| Number of inclusions of not less than 20 μm in 100 g of steel product | 26 | 30 | 22 | 28 | 21 | 20 | 30 | 30 | 26 | 23 |
| Maximum predicted diameter of inclusions, μm | 21.8 | 19.4 | 18.9 | 21 | 21.6 | 18.4 | 22.7 | 21.3 | 20.8 | 20.2 |
| $L_{10}$ ($\times 10^7$) | 4.8 | 4.0 | 5.1 | 4.0 | 3.4 | 3.9 | 4.4 | 3.6 | 3.7 | 3.1 |
| Results of evaluation | ○ | ○ | ○ | ○ | ○ | ○ | ○ | ○ | ○ | ○ |

○: Good

An example of the operation of tapping deoxidation+short LF, long RH according to the present invention for 10 heats of steel SCM 435 is shown in Table A6.

TABLE A6

| Operation | Tapping deoxidation + short LF, long RH ($B_3$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Tapping temp.: m.p. + ° C. | 62 | 72 | 56 | 55 | 71 | 59 | 63 | 78 | 67 | 63 |
| Amount of deoxidizer added at the time of tapping or added to ladle, kg/t | 3 | 1.6 | 2.8 | 1.8 | 2.9 | 2.4 | 2.3 | 2.6 | 2.1 | 1.9 |
| LF: Time, min | 42 | 42 | 40 | 41 | 42 | 45 | 41 | 37 | 42 | 36 |
| LF: Termination temp., ° C. | 1580 | 1582 | 1585 | 1580 | 1579 | 1578 | 1578 | 1585 | 1584 | 1581 |
| RH: Time, min | 36 | 45 | 39 | 35 | 43 | 39 | 45 | 36 | 43 | 38 |
| RH: Quantity of circulation, times | 12.0 | 15.0 | 13.0 | 11.7 | 14.3 | 13.0 | 15.0 | 12.0 | 14.3 | 12.7 |
| RH: Termination temp., ° C. | 1537 | 1533 | 1533 | 1535 | 1539 | 1539 | 1534 | 1539 | 1534 | 1539 |
| Casting temp., ° C. | 1514 | 1513 | 1515 | 1515 | 1515 | 1516 | 1516 | 1515 | 1516 | 1515 |
| Oxygen content of product, ppm | 7 | 7.3 | 7.2 | 7.1 | 6.7 | 7.3 | 6.8 | 7.1 | 6.5 | 7.1 |
| Number of inclusions of not less than 20 μm in 100 g of steel product | 28 | 29 | 25 | 25 | 22 | 30 | 23 | 28 | 26 | 23 |
| Maximum predicted diameter of inclusions, μm | 25.0 | 25.0 | 24.9 | 24.7 | 25.0 | 24.8 | 24.9 | 24.6 | 24.7 | 24.9 |
| $L_{10}$ ($\times 10^7$) | 3.0 | 2.6 | 3.8 | 3.7 | 3.1 | 3.3 | 2.9 | 2.3 | 3.6 | 2.7 |
| Results of evaluation | ○ | ○ | ○ | ○ | ○ | ○ | ○ | ○ | ○ | ○ |

○: Good

An example of the operation of tapping deoxidation+high-temperature tapping+short LF, long RH according to the present invention for 10 heats of steel SUJ 2 is shown in Table A7.

TABLE A7

| Operation | Tapping deoxidation + tapping temp. + shrot LF, long RH ($A_4$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Tapping temp.: m.p. + ° C. | 132 | 143 | 131 | 150 | 153 | 134 | 151 | 138 | 111 | 157 |

TABLE A7-continued

| Operation | Tapping deoxidation + tapping temp. + shrot LF, long RH ($A_4$) | | | | | | | | | |
|---|---|---|---|---|---|---|---|---|---|---|
| No. | 1 | 2 | 3 | 4 | 5 | 6 | 7 | 8 | 9 | 10 |
| Amount of deoxidizer added at the time of tapping or added to ladle, kg/t | 2.8 | 1 | 2.9 | 1.9 | 2.7 | 2.6 | 2.5 | 2.4 | 1.7 | 2.2 |
| LF: Time, min | 43 | 34 | 35 | 38 | 31 | 39 | 38 | 41 | 35 | 44 |
| LF: Termination temp., ° C. | 1541 | 1541 | 1546 | 1546 | 1541 | 1540 | 1543 | 1544 | 1544 | 1546 |
| RH: Time, min | 54 | 50 | 58 | 48 | 52 | 47 | 51 | 60 | 53 | 48 |
| RH: Quantity of circulation, times | 18.8 | 16.1 | 18.6 | 16.0 | 16.8 | 15.7 | 17.6 | 20.7 | 18.2 | 16.5 |
| RH: Termination temp., ° C. | 1498 | 1502 | 1502 | 1502 | 1500 | 1501 | 1498 | 1502 | 1497 | 1498 |
| Casting temp., ° C. | 1478 | 1476 | 1477 | 1475 | 1478 | 1475 | 1475 | 1476 | 1476 | 1475 |
| Oxygen content of product, ppm | 4.1 | 4.7 | 4.1 | 4.2 | 4.1 | 4.9 | 4.3 | 3.8 | 4.3 | 4.7 |
| Number of inclusions of not less than 20 μm in 100 g of steel product | 14 | 11 | 5 | 6 | 8 | 8 | 13 | 10 | 6 | 7 |
| Maximum predicted diameter of inclusions, μm | 12.3 | 14.1 | 12.3 | 14.4 | 14.1 | 14.7 | 12.9 | 11.4 | 12.9 | 13.8 |
| $L_{10}$ ($\times 10^7$) | 7.1 | 7.9 | 9.9 | 9.1 | 11.3 | 10.6 | 10.9 | 11.9 | 10.0 | 8.4 |
| Results of evaluation | ◎ | ◎ | ◎ | ◎ | ◎ | ◎ | ◎ | ◎ | ◎ | ◎ |

◎: Excellent

An example of the operation of tapping deoxidation+high-temperature tapping+short LF, long RH according to the present invention for 10 heats of steel SCM 435 is shown in Table A8.

TABLE A8

| Operation | Tapping deoxidation + tapping temp. + short LF, long RH ($B_4$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Tapping temp.: m.p. + ° C. | 143 | 115 | 104 | 148 | 130 | 106 | 109 | 124 | 122 | 105 |
| Amount of deoxidizer added at the time of tapping or added to ladle, kg/t | 2 | 2.1 | 2.4 | 1.7 | 1.7 | 2.9 | 2.1 | 2 | 2.4 | 2.5 |
| LF: Time, min | 35 | 34 | 33 | 42 | 33 | 43 | 38 | 45 | 41 | 37 |
| LF: Termination temp., ° C. | 1577 | 1579 | 1585 | 1578 | 1584 | 1578 | 1582 | 1581 | 1577 | 1576 |
| RH: Time, min | 36 | 45 | 44 | 40 | 38 | 37 | 46 | 39 | 40 | 43 |
| RH: Quantity of circulation, times | 12.4 | 14.5 | 14.2 | 13.3 | 13.1 | 11.9 | 15.3 | 13.0 | 12.9 | 14.3 |
| RH: Termination temp., ° C. | 1532 | 1541 | 1535 | 1537 | 1531 | 1531 | 1532 | 1540 | 1538 | 1536 |
| Casting temp., ° C. | 1513 | 1520 | 1517 | 1521 | 1516 | 1511 | 1518 | 1511 | 1511 | 1519 |
| Oxygen content of product, ppm | 6.5 | 5.4 | 5.5 | 5.9 | 6.0 | 6.1 | 5.3 | 6.0 | 5.8 | 5.7 |
| Number of inclusions of not less than 20 μm in 100 g of steel product | 8 | 10 | 6 | 9 | 8 | 14 | 8 | 14 | 11 | 8 |
| Maximum predicted diameter of inclusions, μm | 24.6 | 23.5 | 23.8 | 24.4 | 24.6 | 24.0 | 22.5 | 24.0 | 26.7 | 26.8 |
| $L_{10}$ ($\times 10^7$) | 7.9 | 8.6 | 10.4 | 9.3 | 9.8 | 9.6 | 8.8 | 8.7 | 10.0 | 9.3 |
| Results of evaluation | ◎ | ◎ | ◎ | ◎ | ◎ | ◎ | ◎ | ◎ | ◎ | ◎ |

◎: Excellent

For comparison with the present invention, an example of the operation according to a prior art technique for steel SUJ 2 is shown in Table A9, and an example of the operation according to a prior art technique for steel SCM 435 is shown in Table A10.

TABLE A9

| Operation | Conventional operation (prior art) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Tapping temp.: m.p. + ° C. | 57 | 72 | 58 | 60 | 74 | 75 | 51 | 65 | 62 | 68 |

TABLE A9-continued

| Operation | Conventional operation (prior art) | | | | | | | | | |
|---|---|---|---|---|---|---|---|---|---|---|
| No. | 1 | 2 | 3 | 4 | 5 | 6 | 7 | 8 | 9 | 10 |
| Amount of deoxidizer added at the time of tapping or added to ladle, kg/t | — | — | — | — | — | — | — | — | — | — |
| LF: Time, min | 61 | 61 | 63 | 61 | 62 | 62 | 61 | 63 | 61 | 63 |
| LF: Termination temp., ° C. | 1525 | 1524 | 1526 | 1525 | 1523 | 1524 | 1523 | 1520 | 1525 | 1520 |
| RH: Time, min | 23 | 23 | 23 | 23 | 23 | 23 | 23 | 23 | 23 | 23 |
| RH: Quantity of circulation, times | 5.7 | 6.7 | 7.1 | 6.5 | 6.2 | 5.7 | 7 | 5.5 | 6.8 | 6.2 |
| RH: Termination temp., ° C. | 1493 | 1502 | 1501 | 1497 | 1501 | 1501 | 1502 | 1503 | 1496 | 1499 |
| Casting temp., ° C. | 1477 | 1475 | 1475 | 1475 | 1475 | 1475 | 1476 | 1478 | 1478 | 1476 |
| Oxygen content of product, ppm | 5.4 | 5.1 | 5.1 | 6.1 | 5.8 | 5.9 | 5.8 | 5.9 | 5.2 | 6.2 |
| Number of inclusions of not less than 20 μm in 100 g of steel product | 59 | 56 | 54 | 65 | 48 | 41 | 50 | 47 | 45 | 49 |
| Maximum predicted diameter of inclusions, μm | 86.4 | 61.2 | 66.3 | 97.6 | 81.2 | 76.7 | 92.8 | 76.7 | 72.8 | 74.4 |
| $L_{10}$ ($\times 10^7$) | 1.9 | 2.4 | 2.4 | 1.8 | 1.9 | 3.4 | 1.9 | 2.2 | 2.0 | 2.2 |
| Results of evaluation | x | x | x | x | x | x | x | x | x | x |

x: Failure

TABLE A10

| Operation | Conventional operation (prior art) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Tapping temp.: m.p. + ° C. | 61 | 54 | 69 | 50 | 74 | 58 | 58 | 69 | 64 | 54 |
| Amount of deoxidizer added at the time of tapping or added to ladle, kg/t | — | — | — | — | — | — | — | — | — | — |
| LF: Time, min | 62 | 63 | 61 | 61 | 61 | 63 | 63 | 63 | 61 | 61 |
| LF: Termination temp., ° C. | 1570 | 1574 | 1566 | 1572 | 1567 | 1569 | 1567 | 1569 | 1569 | 1570 |
| RH: Time, min | 23 | 23 | 23 | 20 | 21 | 23 | 21 | 23 | 23 | 24 |
| RH: Quantity of circulation, times | 6.8 | 7.5 | 7.0 | 8.3 | 6.2 | 6.0 | 7.4 | 8.0 | 7.3 | 6.7 |
| RH: Termination temp., ° C. | 1533 | 1538 | 1541 | 1540 | 1541 | 1533 | 1535 | 1534 | 1531 | 1531 |
| Casting temp., ° C. | 1517 | 1519 | 1520 | 1518 | 1517 | 1511 | 1516 | 1512 | 1512 | 1521 |
| Oxygen content of product, ppm | 7.6 | 9.2 | 9.2 | 8.8 | 6.9 | 8.3 | 6.9 | 8.3 | 9.4 | 9.1 |
| Number of inclusions of not less than 20 μm in 100 g of steel product | 49 | 54 | 59 | 52 | 42 | 57 | 56 | 53 | 53 | 42 |
| Maximum predicted diameter of inclusions, μm | 68.4 | 82.8 | 73.6 | 70.4 | 55.2 | 83.0 | 55.2 | 83.0 | 84.6 | 91.0 |
| $L_{10}$ ($\times 10^7$) | 1.0 | 1.3 | 1.1 | 1.9 | 2.3 | 1.5 | 2.0 | 1.2 | 1.2 | 1.9 |
| Results of evaluation | x | x | x | x | x | x | x | x | x | x |

x: Failure

As is apparent from Tables A1 to A8, for steel products produced using tapping deoxidation, that is, pre-deoxidation, according to the present invention, when the tapping temperature is brought to a high temperature above the conventional operation, that is, the melting point+at least 100° C., and, in addition, degassing is satisfactorily carried out by shortening the operation time in the ladle refining furnace and, in addition, increasing the quantity of circulation RH in circulation degassing (that is, amount of molten steel circulated/total amount of molten steel), for both steel types, SUJ 2 and SCM 435, the oxygen content of the products is small and, in addition, the number of inclusions having a size of not less than 20 μm is significantly decreased. As can be seen from Tables A1 to A8, regarding the cleanliness, for the examples of the present invention, all the steel products are evaluated as fair (Δ), good (○), and excellent (◎), that is, are excellent high-cleanliness steels. By contrast, as can be seen from Tables A9 and A10, for all the conventional examples, the cleanliness is evaluated as failure (×), and the conventional steel products cannot be said to be clean steels. In this connection, it should be noted that fair (Δ) is based on the comparison with good (○) and excellent (◎) and, as compared with steels not subjected to tapping deoxidation according to the prior art method which is evaluated as failure (×), the steels evaluated as fair (Δ) have much higher cleanliness.

For heats wherein pre-deoxidation, that is, tapping deoxidation, has been carried out, both the oxygen content and the predicted value of the maximum inclusion diameter are reduced by increasing $T_{SH}$ [(temperature at which molten steel is transferred to ladle furnace)−(melting point of molten steel)=$T_{SH}$)] to improve the cleanliness. For heats in which pre-deoxidation has been carried out, regarding the relationship of the refining time in the ladle furnace with the oxygen content and the predicted value of the maximum inclusion diameter, when the refining time is not less than about 25 min, the oxygen content and the predicted value of the maximum inclusion diameter are satisfactorily lowered. The predicted value of the maximum inclusion diameter, however, increases with increasing the refining time. The reason for this is considered as follows. With the elapse of time, the melt loss of refractories in the ladle furnace is increased, the equilibrium of the slag system is broken, for example, as a result of oxidation due to the contact with the air, and the level of the dissolved oxygen goes beyond the minimum level of dissolved oxygen. Further, the relationship of the amount of molten steel circulated/total amount of molten steel in the circulation-type vacuum degassing device with the oxygen content and the predicted value of the maximum inclusion diameter, the effect of enhancing the cleanliness increases with increasing the amount of molten steel circulated, and is substantially saturated when the amount of molten steel circulated/total amount of molten steel is not less than 15 times.

It was confirmed that reducing the oxygen content and the predicted value of the maximum inclusion diameter results in improved $L_{10}$ life. This indicates that steels produced by the process according to the present invention, which can reduce the oxygen content and the predicted value of the maximum inclusion diameter, have excellent fatigue strength properties such as excellent rolling fatigue life.

FIG. A1 is a diagram showing the oxygen content of products in 10 heats in the production process according to the present invention wherein the tapping deoxidation is performed in the transfer of the molten steel of steel SUJ 2 to the ladle furnace, and the oxygen content of products in 10 heats in the conventional process wherein the tapping deoxidation is not carried out. In FIGS. A1, A3, and A5, $A_1$ shows data on the tapping deoxidation according to the present invention, $A_2$ data on the tapping deoxidation+high-temperature tapping according to the present invention, $A_3$ data on the tapping deoxidation+short-time LF, long-time RH treatment according to the present invention, $A_4$ data on the tapping deoxidation+high-temperature tapping+short-time LF, long-time RH treatment according to the present invention, and conventional data on prior art.

FIG. A2 is a diagram showing the oxygen content of products in 10 heats in the production process according to the present invention wherein the tapping deoxidation is performed in the transfer of the molten steel of steel SCM 435 to the ladle, and the oxygen content of products in 10 heats in the conventional process wherein the tapping deoxidation is not carried out. In FIGS. A2, A4, and A6, $B_1$ shows data on the tapping deoxidation according to the present invention, $B_2$ data on the tapping deoxidation+high-temperature tapping according to the present invention, $B_3$ data on the tapping deoxidation+short-time LF, long-time RH treatment according to the present invention, $B_4$ data on the tapping deoxidation+high-temperature tapping+short-time LF, long-time RH treatment according to the present invention, and conventional data on prior art.

FIG. A3 is a diagram showing the maximum predicted inclusion diameter determined according to statistics of extreme values in 10 heats in the production process according to the present invention wherein the deoxidation is performed in the transfer of the molten steel of steel SUJ 2 to the ladle furnace, and according to the prior art method wherein the deoxidation is not carried out.

FIG. A4 is a diagram showing the maximum predicted inclusion diameter determined according to statistics of extreme values in 10 heats in the production process according to the present invention wherein the deoxidation is performed in the transfer of the molten steel of steel SCM 435 to the ladle furnace, and according to the prior art method wherein the deoxidation is not carried out.

FIG. A5 shows data on $L_{10}$ life as determined by a thrust rolling service life test in 10 heats in the production process according to the present invention wherein the deoxidation is performed in the transfer of the molten steel of steel SUJ 2 to the ladle furnace, and according to the prior art method wherein the deoxidation is not carried out.

FIG. A6 shows data on $L_{10}$ life as determined by a thrust rolling service life test in 10 heats in the production process according to the present invention wherein the deoxidation is performed in the transfer of the molten steel of steel SCM 435 to the ladle furnace, and according to the prior art method wherein the deoxidation is not carried out.

As is apparent from the test results, it was confirmed that, for both steel SUJ 2 and steel SCM 435, pre-deoxidation, that is, tapping deoxidation before the ladle refining, can significantly reduce the oxygen content of the products, and the predicted value of the maximum inclusion diameter and, according to the process according to the present invention, the cleanliness is significantly improved and the $L_{10}$ life as determined by the thrust rolling service life test is significantly improved. The addition of treatments to the process, that is, the addition of only tapping deoxidation according to the present invention, the addition of tapping deoxidation+high-temperature tapping according to the present invention, the addition of tapping deoxidation+short-time LF, long-time RH treatment according to the present invention, and the addition of the tapping deoxidation+high-temperature tapping+short-time LF, long-time RH treatment, can significantly improve all the oxygen content of products, the predicted value of the maximum inclusion diameter, and the $L_{10}$ life as determined by the thrust rolling service life test. In particular, the addition of short-time LF, long-time RH treatment can offer very large effect.

As is apparent from the foregoing description, tapping deoxidation, wherein deoxidizers, such as manganese, aluminum, and silicon, are previously added to a ladle in the transfer of a molten steel, produced in a refining furnace, such as an arc furnace, to the ladle, or alternatively, is added to the molten steel in the course of the transfer of the molten steel to the ladle according to the production process of the present invention, whereby the molten steel is pre-deoxidized before the ladle refining, a large quantity of steel products having a very high level of cleanliness can be provided without use of a remelting process which incurs very high cost. Further, the adoption of tapping deoxidation+high-temperature tapping and the addition of tapping deoxidation+high-temperature tapping+short-time LF, long-time RH can provide steel products having a higher level of cleanliness. This can realize the provision of high-cleanliness steels for use as steels for mechanical parts required to possess fatigue strength, fatigue life, and quietness, particularly, for example, as steels for rolling bearings, steels for constant velocity joints, steels for gears, steels for continuously variable transmission of toroidal type, steels for mechanical structures for cold forging, tool steels, and spring steels, and processes for producing the same, that is, can offer unprecedented excellent effect.

EXAMPLE B

A molten steel, which had been produced by a melting process in an arc melting furnace, was circulated through a circulation-type vacuum degassing device to degas the molten steel. The degassed molten steel was then transferred to a ladle furnace where the molten steel was subjected to ladle refining. The refined molten steel was then circulated through a circulation-type vacuum degassing device to degas the molten steel, followed by an ingot production process using casting. Steel products of JIS SUJ 2 and SCM 435 in 10 heats thus obtained were examined for the oxygen content of the products, the predicted value of the maximum inclusion diameter according to statistics of extreme values, and $L_{10}$ service life by a thrust-type rolling service life test. In the measurement of the predicted value of the maximum inclusion diameter, a test piece was taken off from a ϕ65 forged material, the observation of 100 $mm^2$ was carried out for 30 test pieces, and the maximum inclusion diameter in 30000 $mm^2$ was predicted according to statistics of extreme values. In the thrust-type rolling service life test, a test piece having a size of ϕ60×ϕ20×8.3T, which had been subjected to carburizing, quench hardening and tempering, was tested at a maximum hertz stress Pmax: 4900 MPa, followed by calculation to determine the $L_{10}$ service life.

An example of operation in the case of only W-RH treatment defined in claim 1 according to the present invention for 10 heats of steel SUJ 2 is shown in Table B1.

TABLE B1

| Operation | W - RH ($A_1$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Tapping temp.: m.p. + ° C. | 75 | 64 | 63 | 60 | 71 | 61 | 73 | 59 | 64 | 68 |
| 1st RH: Time, min | 15 | 9 | 15 | 8 | 10 | 8 | 11 | 12 | 15 | 11 |
| 1st RH: Quantity of circulation, times | 5.0 | 3.0 | 5.0 | 2.7 | 3.3 | 2.7 | 3.7 | 4.0 | 5.0 | 3.7 |
| 1st RH: Amount of deoxidizer added, kg/t | 2.6 | 1.6 | 2.6 | 1.7 | 2.8 | 2 | 2.9 | 1.1 | 1.3 | 2.6 |
| LF: Time, min | 48 | 60 | 49 | 52 | 59 | 57 | 58 | 49 | 48 | 57 |
| LF: Termination temp., ° C. | 1532 | 1534 | 1533 | 1532 | 1528 | 1531 | 1533 | 1534 | 1535 | 1533 |
| 2nd RH: Time, min | 22 | 21 | 22 | 25 | 24 | 24 | 25 | 23 | 24 | 25 |
| 2nd RH: Quantity of circulation, times | 7.3 | 7.0 | 7.3 | 8.3 | 8.0 | 8.0 | 8.3 | 7.7 | 8.0 | 8.3 |
| 2nd RH: Termination temp., ° C. | 1509 | 1508 | 1503 | 1510 | 1510 | 1509 | 1504 | 1505 | 1503 | 1506 |
| Casting temp., ° C. | 1476 | 1478 | 1476 | 1476 | 1478 | 1476 | 1477 | 1476 | 1475 | 1476 |
| Oxygen content of product, ppm | 4.8 | 5.1 | 4.6 | 4.7 | 4.9 | 5.1 | 4.9 | 4.8 | 4.8 | 5 |
| Number of inclusions of not less than 20 μm in 100 g of steel product | 23 | 21 | 19 | 26 | 27 | 30 | 21 | 20 | 20 | 29 |
| Maximum predicted diameter of inclusions, μm | 22.8 | 20.5 | 19.7 | 21.8 | 20 | 19.8 | 19.8 | 21.2 | 18.6 | 20.2 |
| $L_{10}$ (× $10^7$) | 3.8 | 3.3 | 5.0 | 4.8 | 4.7 | 4.1 | 5.3 | 3.2 | 5.5 | 4.9 |
| Results of evaluation | ○ | ○ | ○ | ○ | ○ | ○ | ○ | ○ | ○ | ○ |

○: Good

An example of operation in the case of only W-RH treatment according to the present invention for 10 heats of steel SCM 435 is shown in Table B2.

TABLE B2

| Operation | W - RH ($B_1$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Tapping temp.: m.p. + ° C. | 68 | 74 | 69 | 74 | 65 | 77 | 63 | 60 | 58 | 70 |
| 1st RH: Time, min | 12 | 12 | 11 | 12 | 10 | 10 | 13 | 8 | 15 | 15 |
| 1st RH: Quantity of circulation, times | 4.0 | 4.0 | 3.7 | 4.0 | 3.3 | 3.3 | 4.3 | 2.7 | 5.0 | 5.0 |
| 1st RH: Amount of deoxidizer added, kg/t | 2.9 | 2.2 | 2 | 1.5 | 1.5 | 1.8 | 2.3 | 2.5 | 2.7 | 2.2 |
| LF: Time, min | 60 | 47 | 55 | 47 | 56 | 57 | 51 | 45 | 60 | 56 |
| LF: Termination temp., ° C. | 1579 | 1585 | 1578 | 1583 | 1580 | 1578 | 1580 | 1579 | 1582 | 1583 |
| 2nd RH: Time, min | 22 | 22 | 25 | 24 | 22 | 25 | 20 | 22 | 25 | 24 |
| 2nd RH: Quantity of circulation, times | 7.3 | 7.3 | 8.3 | 8.0 | 7.3 | 8.3 | 6.7 | 7.3 | 8.3 | 8.0 |
| 2nd RH: Termination temp., ° C. | 1523 | 1522 | 1523 | 1524 | 1525 | 1521 | 1524 | 1520 | 1524 | 1522 |
| Casting temp., ° C. | 1515 | 1516 | 1515 | 1513 | 1514 | 1515 | 1515 | 1514 | 1516 | 1515 |
| Oxygen content of product, ppm | 6.7 | 6.7 | 7 | 7.2 | 7.1 | 6.9 | 6.6 | 6.8 | 6.4 | 7 |
| Number of inclusions of not less than 20 μm in 100 g of steel product | 30 | 27 | 25 | 22 | 24 | 28 | 23 | 26 | 26 | 26 |
| Maximum predicted diameter of inclusions, μm | 20.1 | 21.7 | 22.8 | 20.2 | 24 | 21.9 | 22.2 | 22.5 | 20.7 | 22 |
| $L_{10}$ (× $10^7$) | 2.7 | 3.3 | 3.4 | 2.6 | 2.5 | 3.4 | 4.0 | 4.0 | 3.8 | 3.7 |
| Results of evaluation | ○ | ○ | ○ | ○ | ○ | ○ | ○ | ○ | ○ | ○ |

○: Good

An example of the operation of W-RH treatment+high-temperature tapping according to the present invention for 10 heats of steel SUJ 2 is shown in Table B3.

TABLE B3

| Operation | W - RH + tapping temp. ($A_2$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Tapping temp.: m.p. + ° C. | 136 | 152 | 128 | 169 | 163 | 145 | 120 | 125 | 160 | 154 |
| 1st RH: Time, min | 15 | 9 | 15 | 8 | 10 | 8 | 11 | 12 | 15 | 11 |
| 1st RH: Quantity of circulation, times | 5.0 | 3.0 | 5.0 | 2.7 | 3.3 | 2.7 | 3.7 | 4.0 | 5.0 | 3.7 |
| 1st RH: Amount of deoxidizer added, kg/t | 2.6 | 1.6 | 2.6 | 1.7 | 2.8 | 2 | 2.9 | 1.1 | 1.3 | 2.6 |
| LF: Time, min | 72 | 64 | 63 | 72 | 72 | 62 | 66 | 60 | 65 | 71 |
| LF: Termination temp., ° C. | 1532 | 1534 | 1533 | 1532 | 1528 | 1531 | 1533 | 1534 | 1535 | 1533 |
| 2nd RH: Time, min | 22 | 21 | 22 | 24 | 24 | 24 | 23 | 23 | 24 | 24 |
| 2nd RH: Quantity of circulation, times | 7.3 | 7.0 | 7.3 | 8.3 | 8.0 | 8.0 | 8.3 | 7.7 | 8.0 | 8.3 |
| 2nd RH: Termination temp., ° C. | 1509 | 1508 | 1503 | 1510 | 1510 | 1509 | 1504 | 1505 | 1503 | 1506 |
| Casting temp., ° C. | 1476 | 1478 | 1476 | 1476 | 1478 | 1476 | 1477 | 1476 | 1475 | 1476 |
| Oxygen content of product, ppm | 4.8 | 5.1 | 4.5 | 4.6 | 4.9 | 5.2 | 5.0 | 4.6 | 4.8 | 5.1 |
| Number of inclusions of not less than 20 μm in 100 g of steel product | 21 | 23 | 14 | 16 | 20 | 23 | 22 | 17 | 19 | 26 |
| Maximum predicted diameter of inclusions, μm | 15.7 | 16.2 | 14.1 | 14.3 | 15.6 | 16.6 | 16.0 | 14.9 | 14.8 | 17.2 |
| $L_{10}$ ($\times 10^7$) | 7.0 | 6.0 | 8.8 | 7.7 | 6.5 | 5.2 | 6.6 | 8.4 | 7.2 | 5.3 |
| Results of evaluation | ○ | ○ | ○ | ○ | ○ | ○ | ○ | ○ | ○ | ○ |

○: Good

An example of the operation W-RH treatment+high-temperature tapping according to the present invention for 10 heats of steel SCM 435 is shown in Table B4.

TABLE B4

| Operation | W - RH + tapping temp. ($B_2$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Tapping temp.: m.p. + ° C. | 135 | 140 | 130 | 123 | 102 | 122 | 118 | 109 | 157 | 115 |
| 1st RH: Time, min | 12 | 12 | 11 | 12 | 10 | 10 | 13 | 8 | 15 | 15 |
| 1st RH: Quantity of circulation, times | 4.0 | 4.0 | 3.7 | 4.0 | 3.3 | 3.3 | 4.3 | 2.7 | 5.0 | 5.0 |
| 1st RH: Amount of deoxidizer added, kg/t | 2.9 | 2.2 | 2 | 1.5 | 1.5 | 1.8 | 2.3 | 2.5 | 2.7 | 2.2 |
| LF: Time, min | 72 | 68 | 62 | 71 | 61 | 67 | 64 | 73 | 62 | 68 |
| LF: Termination temp., ° C. | 1579 | 1585 | 1578 | 1583 | 1580 | 1578 | 1580 | 1579 | 1582 | 1583 |
| 2nd RH: Time, min | 22 | 22 | 23 | 24 | 22 | 23 | 20 | 22 | 24 | 24 |
| 2nd RH: Quantity of circulation, times | 7.3 | 7.3 | 8.3 | 8.0 | 7.3 | 8.3 | 6.7 | 7.3 | 8.3 | 8.0 |
| 2nd RH: Termination temp., ° C. | 1523 | 1522 | 1523 | 1524 | 1525 | 1521 | 1524 | 1520 | 1524 | 1522 |
| Casting temp., ° C. | 1515 | 1516 | 1515 | 1513 | 1514 | 1515 | 1515 | 1514 | 1516 | 1515 |
| Oxygen content of product, ppm | 6.2 | 6.7 | 6.6 | 6.1 | 6.3 | 6.4 | 6.2 | 6.5 | 6.4 | 6.5 |
| Number of inclusions of not less than 20 μm in 100 g of steel product | 14 | 18 | 15 | 13 | 16 | 16 | 13 | 17 | 15 | 18 |
| Maximum predicted diameter of inclusions, μm | 20.2 | 21.6 | 20.3 | 19.7 | 20.4 | 20.8 | 19.5 | 21.3 | 20.6 | 21.0 |
| $L_{10}$ ($\times 10^7$) | 6.2 | 5.0 | 6.4 | 7.8 | 5.2 | 6.9 | 7.0 | 4.8 | 5.9 | 4.1 |
| Results of evaluation | ○ | ○ | ○ | ○ | ○ | ○ | ○ | ○ | ○ | ○ |

○: Good

An example of the operation of W-RH treatment+short LF, long RH according to the present invention for 10 heats of steel SUJ 2 is shown in Table B5.

TABLE B5

| Operation | W - RH + short LF, long RH ($A_3$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Tapping temp.: m.p. + ° C. | 59 | 68 | 74 | 61 | 69 | 78 | 74 | 59 | 73 | 67 |
| 1st RH: Time, min | 14 | 12 | 12 | 9 | 10 | 9 | 12 | 9 | 15 | 11 |
| 1st RH: Quantity of circulation, times | 4.7 | 4.0 | 4.0 | 3.0 | 3.3 | 3.0 | 4.0 | 3.0 | 5.0 | 3.7 |
| 1st RH: Amount of deoxidizer added, kg/t | 2.6 | 1.3 | 1.5 | 2.2 | 1 | 2.2 | 1.5 | 2.1 | 2.2 | 1.3 |
| LF: Time, min | 44 | 38 | 35 | 44 | 45 | 42 | 41 | 36 | 36 | 44 |
| LF: Termination temp., ° C. | 1541 | 1545 | 1544 | 1543 | 1542 | 1541 | 1541 | 1543 | 1541 | 1544 |
| 2nd RH: Time, min | 49 | 38 | 37 | 46 | 54 | 54 | 53 | 59 | 45 | 41 |
| 2nd RH: Quantity of circulation, times | 16.3 | 12.7 | 12.3 | 15.3 | 18.0 | 18.0 | 17.7 | 19.7 | 15.0 | 13.7 |
| 2nd RH: Termination temp., ° C. | 1507 | 1505 | 1507 | 1507 | 1506 | 1503 | 1504 | 1505 | 1508 | 1508 |
| Casting temp., ° C. | 1476 | 1478 | 1478 | 1476 | 1475 | 1475 | 1477 | 1477 | 1476 | 1476 |
| Oxygen content of product, ppm | 4.8 | 4.3 | 4.4 | 4.5 | 5.1 | 5.1 | 4.1 | 4.4 | 4.9 | 4.6 |
| Number of inclusions of not less than 20 μm in 100 g of steel product | 15 | 14 | 21 | 17 | 25 | 19 | 16 | 12 | 20 | 19 |
| Maximum predicted diameter of inclusions, μm | 14.1 | 13.7 | 14.1 | 13.2 | 12.5 | 14.3 | 13.8 | 12.5 | 12.8 | 14.7 |
| $L_{10}$ ($\times 10^7$) | 8.6 | 10.6 | 10.7 | 10.0 | 7.0 | 9.3 | 9.9 | 9.4 | 8.9 | 9.4 |
| Results of evaluation | ◎ | ◎ | ◎ | ◎ | ◎ | ◎ | ◎ | ◎ | ◎ | ◎ |

◎: Excellent

An example of the operation of W-RH treatment+short LF, long RH according to the present invention for 10 heats of steel SCM 435 is shown in Table B6.

TABLE B6

| Operation | W - RH + short LF, long RH ($B_3$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Tapping temp.: m.p. + ° C. | 56 | 70 | 78 | 67 | 76 | 63 | 74 | 63 | 64 | 72 |
| 1st RH: Time, min | 9 | 14 | 12 | 12 | 15 | 13 | 8 | 14 | 15 | 10 |
| 1st RH: Quantity of circulation, times | 3.0 | 4.7 | 4.0 | 4.0 | 5.0 | 4.3 | 2.7 | 4.7 | 5.0 | 3.3 |
| 1st RH: Amount of deoxidizer added, kg/t | 2.4 | 2.8 | 1.6 | 2.7 | 2.2 | 3 | 2.5 | 3 | 2.9 | 1.9 |
| LF: Time, min | 40 | 38 | 42 | 41 | 37 | 42 | 36 | 43 | 38 | 35 |
| LF: Termination temp., ° C. | 1585 | 1578 | 1581 | 1579 | 1582 | 1579 | 1585 | 1583 | 1577 | 1577 |
| 2nd RH: Time, min | 31 | 55 | 34 | 32 | 31 | 54 | 37 | 53 | 52 | 46 |
| 2nd RH: Quantity of circulation, times | 10.3 | 18.3 | 11.3 | 10.7 | 10.3 | 18.0 | 12.3 | 17.7 | 17.3 | 15.3 |
| 2nd RH: Termination temp., ° C. | 1524 | 1520 | 1523 | 1524 | 1524 | 1522 | 1525 | 1525 | 1524 | 1523 |
| Casting temp., ° C. | 1516 | 1513 | 1514 | 1515 | 1515 | 1515 | 1515 | 1516 | 1516 | 1514 |
| Oxygen content of product, ppm | 6.3 | 6.4 | 6.1 | 6.4 | 6 | 6.5 | 6.5 | 6.4 | 6.4 | 6.4 |
| Number of inclusions of not less than 20 μm in 100 g of steel product | 14 | 12 | 11 | 15 | 14 | 15 | 10 | 14 | 11 | 15 |
| Maximum predicted diameter of inclusions, μm | 24 | 22.7 | 22.2 | 22.2 | 23 | 23.7 | 23.7 | 22.5 | 23.4 | 22.1 |
| $L_{10}$ ($\times 10^7$) | 7.9 | 8.8 | 10.1 | 9.7 | 7.7 | 6.9 | 8.3 | 9.4 | 9.5 | 8.0 |
| Results of evaluation | ◎ | ◎ | ◎ | ◎ | ◎ | ◎ | ◎ | ◎ | ◎ | ◎ |

◎: Excellent

An example of the operation of W-RH treatment+high-temperature tapping+short LF, long RH according to the present invention for 10 heats of steel SUJ 2 is shown in Table B7.

TABLE B7

| Operation | W - RH + tapping temp. + short LF, long RH ($A_4$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Tapping temp.: m.p. + ° C. | 140 | 182 | 170 | 149 | 189 | 166 | 163 | 182 | 142 | 157 |
| 1st RH: Time, min | 13 | 14 | 8 | 13 | 8 | 17 | 15 | 18 | 14 | 11 |
| 1st RH: Quantity of circulation, times | 4.3 | 4.7 | 2.7 | 4.3 | 2.7 | 5.7 | 5.0 | 6.0 | 4.7 | 3.7 |
| 1st RH: Amount of deoxidizer added, kg/t | 1.2 | 2.2 | 0.5 | 2.1 | 2.1 | 1.6 | 2.5 | 2.4 | 0.9 | 1.1 |
| LF: Time, min | 37 | 40 | 40 | 43 | 37 | 37 | 44 | 38 | 33 | 39 |
| LF: Termination temp., ° C. | 1541 | 1546 | 1546 | 1543 | 1540 | 1545 | 1542 | 1544 | 1540 | 1542 |
| 2nd RH: Time, min | 49 | 56 | 53 | 59 | 53 | 55 | 46 | 49 | 58 | 56 |
| 2nd RH: Quantity of circulation, times | 15.8 | 19.2 | 17.1 | 19.7 | 17.6 | 18.3 | 15.7 | 15.9 | 20.0 | 19.4 |
| 2nd RH: Termination temp., ° C. | 1501 | 1502 | 1496 | 1493 | 1502 | 1499 | 1492 | 1495 | 1501 | 1501 |
| Casting temp., ° C. | 1477 | 1478 | 1475 | 1477 | 1478 | 1477 | 1478 | 1475 | 1476 | 1476 |
| Oxygen content of product, ppm | 4.6 | 4.1 | 4.5 | 4 | 4.3 | 4.2 | 3.7 | 4.5 | 3.8 | 3.9 |
| Number of inclusions of not less than 20 μm in 100 g of steel product | 2 | 5 | 6 | 7 | 8 | 8 | 8 | 5 | 2 | 4 |
| Maximum predicted diameter of inclusions, μm | 11.7 | 11 | 11.8 | 10.9 | 10.5 | 10.3 | 11.2 | 12.1 | 10.9 | 10.4 |
| $L_{10}$ (× $10^7$) | 9.7 | 12.2 | 11.0 | 12.6 | 11.3 | 10.9 | 11.5 | 10.2 | 10.8 | 11.1 |
| Results of evaluation | ◎ | ◎ | ◎ | ◎ | ◎ | ◎ | ◎ | ◎ | ◎ | ◎ |

◎: Excellent

An example of the operation of W-RH treatment+high-temperature tapping+short LF, long RH according to the present invention for 10 heats of steel SCM 435 is shown in Table B8.

TABLE B8

| Operation | W - RH + tapping temp. + short LF, long RH ($B_4$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Tapping temp.: m.p. + ° C. | 136 | 131 | 137 | 106 | 107 | 102 | 136 | 138 | 105 | 134 |
| 1st RH: Time, min | 18 | 8 | 9 | 16 | 11 | 8 | 17 | 8 | 15 | 14 |
| 1st RH: Quantity of circulation, times | 6 | 2.67 | 3.00 | 5.33 | 3.67 | 2.67 | 5.67 | 2.67 | 5.00 | 4.67 |
| 1st RH: Amount of deoxidizer added, kg/t | 2.4 | 2.1 | 1 | 2.5 | 1.3 | 1.6 | 0.8 | 1.4 | 0.8 | 2.3 |
| LF: Time, min | 33 | 37 | 44 | 42 | 40 | 35 | 39 | 40 | 34 | 34 |
| LF: Termination temp., ° C. | 1577 | 1581 | 1577 | 1576 | 1579 | 1586 | 1582 | 1585 | 1579 | 1584 |
| 2nd RH: Time, min | 39 | 39 | 42 | 42 | 40 | 44 | 37 | 39 | 38 | 41 |
| 2nd RH: Quantity of circulation, times | 13.0 | 13.5 | 14.0 | 13.5 | 12.4 | 14.3 | 12.7 | 13.3 | 12.2 | 12.9 |
| 2nd RH: Termination temp., ° C. | 1541 | 1538 | 1532 | 1539 | 1541 | 1537 | 1540 | 1537 | 1532 | 1539 |
| Casting temp., ° C. | 1515 | 1518 | 1521 | 1513 | 1518 | 1520 | 1521 | 1519 | 1511 | 1520 |
| Oxygen content of product, ppm | 6.0 | 5.8 | 5.3 | 5.2 | 5.6 | 4.7 | 5.5 | 5.5 | 5.8 | 5.6 |
| Number of inclusions of not less than 20 μm in 100 g of steel product | 5 | 3 | 6 | 8 | 8 | 6 | 2 | 5 | 4 | 3 |
| Maximum predicted diameter of inclusions, μm | 22.0 | 21.3 | 20.3 | 20.5 | 23.4 | 20.0 | 22.9 | 22.1 | 23.2 | 21.8 |
| $L_{10}$ (× $10^7$) | 10.4 | 10.6 | 9.8 | 9.6 | 10.0 | 11.0 | 9.2 | 9.1 | 10.2 | 9.9 |
| Results of evaluation | ◎ | ◎ | ◎ | ◎ | ◎ | ◎ | ◎ | ◎ | ◎ | ◎ |

◎: Excellent

For comparison with the present invention, an example of the operation according to a prior art technique for steel SUJ 2 is shown in Table B9, and an example of the operation according to a prior art technique for steel SCM 435 is shown in Table B10.

TABLE B9

| Operation | Conventional operation (prior art) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Tapping temp.: m.p. + ° C. | 57 | 72 | 58 | 60 | 74 | 75 | 51 | 65 | 62 | 68 |
| 1st RH: Time, min | — | — | — | — | — | — | — | — | — | — |
| 1st RH: Quantity of circulation, times | — | — | — | — | — | — | — | — | — | — |
| 1st RH: Amount of deoxidizer added, kg/t | — | — | — | — | — | — | — | — | — | — |
| LF: Time, min | 61 | 61 | 63 | 61 | 62 | 62 | 61 | 63 | 61 | 63 |
| LF: Termination temp., ° C. | 1525 | 1524 | 1526 | 1525 | 1523 | 1524 | 1523 | 1520 | 1525 | 1520 |
| 2nd RH: Time, min | 23 | 23 | 23 | 23 | 23 | 23 | 23 | 23 | 23 | 23 |
| 2nd RH: Quantity of circulation, times | 5.7 | 6.7 | 7.1 | 6.5 | 6.2 | 5.7 | 7 | 5.5 | 6.8 | 6.2 |
| 2nd RH: Termination temp., ° C. | 1493 | 1502 | 1501 | 1497 | 1501 | 1501 | 1502 | 1503 | 1496 | 1499 |
| Casting temp., ° C. | 1477 | 1475 | 1475 | 1475 | 1475 | 1475 | 1476 | 1478 | 1478 | 1476 |
| Oxygen content of product, ppm | 5.4 | 5.1 | 5.1 | 6.1 | 5.8 | 5.9 | 5.8 | 5.9 | 5.2 | 6.2 |
| Number of inclusions of not less than 20 μm in 100 g of steel product | 59 | 56 | 54 | 65 | 48 | 41 | 50 | 47 | 45 | 49 |
| Maximum predicted diameter of inclusions, μm | 86.4 | 61.2 | 66.3 | 97.6 | 81.2 | 76.7 | 92.8 | 76.7 | 72.8 | 74.4 |
| $L_{10}$ ($\times 10^7$) | 1.9 | 2.4 | 2.4 | 1.8 | 1.9 | 3.4 | 1.9 | 2.2 | 2.0 | 2.2 |
| Results of evaluation | x | x | x | x | x | x | x | x | x | x |

x: Failure

TABLE B10

| Operation | Conventional operation (prior art) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Tapping temp.: m.p. + ° C. | 61 | 54 | 69 | 50 | 74 | 58 | 58 | 69 | 64 | 54 |
| 1st RH: Time, min | — | — | — | — | — | — | — | — | — | — |
| 1st RH: Quantity of circulation, times | — | — | — | — | — | — | — | — | — | — |
| 1st RH: Amount of deoxidizer added, kg/t | — | — | — | — | — | — | — | — | — | — |
| LF: Time, min | 62 | 63 | 61 | 61 | 61 | 63 | 63 | 63 | 61 | 61 |
| LF: Termination temp., ° C. | 1570 | 1574 | 1566 | 1572 | 1567 | 1569 | 1567 | 1569 | 1569 | 1570 |
| 2nd RH: Time, min | 23 | 23 | 23 | 20 | 21 | 23 | 21 | 23 | 23 | 24 |
| 2nd RH: Quantity of circulation, times | 6.8 | 7.5 | 7.0 | 8.3 | 6.2 | 6.0 | 7.4 | 8.0 | 7.3 | 6.7 |
| 2nd RH: Termination temp., ° C. | 1533 | 1538 | 1541 | 1540 | 1541 | 1533 | 1535 | 1534 | 1531 | 1531 |
| Casting temp., ° C. | 1517 | 1519 | 1520 | 1518 | 1517 | 1511 | 1516 | 1512 | 1512 | 1521 |
| Oxygen content of product, ppm | 7.6 | 9.2 | 9.2 | 8.8 | 6.9 | 8.3 | 6.9 | 8.3 | 9.4 | 9.1 |
| Number of inclusions of not less than 20 μm in 100 g of steel product | 49 | 54 | 59 | 52 | 42 | 57 | 56 | 53 | 53 | 42 |
| Maximum predicted diameter of inclusions, μm | 68.4 | 82.8 | 73.6 | 70.4 | 55.2 | 83.0 | 55.2 | 83.0 | 84.6 | 91.0 |
| $L_{10}$ ($\times 10^7$) | 1.0 | 1.3 | 1.1 | 1.9 | 2.3 | 1.5 | 2.0 | 1.2 | 1.2 | 1.9 |
| Results of evaluation | x | x | x | x | x | x | x | x | x | x |

x: Failure

As is apparent from Tables B1 to B8, for steel products produced using W-RH treatment according to the present invention wherein a molten steel produced in an arc melting furnace or a converter is pre-degassed, is transferred to a ladle furnace to perform refining, and is then circulated through a circulation-type vacuum degassing device to degas the molten steel, the adoption of a combination of W-RH treatment+high-temperature tapping at a temperature above the conventional operation, i.e., melting point+at least 100° C., the adoption of a combination of W-RH treatment+short LF, long RH treatment wherein the operation time in the ladle furnace is shortened and, in addition, the RH quantity of circulation in circulation degassing (that is, amount of molten steel circulated/total amount of molten steel circulated) is increased to satisfactorily perform degassing for a long period of time, and the adoption of a combination of all the above treatments, that is, a combination of the W-RH treatment+high-temperature tapping+short LF, long RH, can realize, for both steel types, SUJ 2 and SCM 435, lowered oxygen content of products and significantly decreased number of inclusions having a size of not less than 20 μm. Further, as can be seen from Tables B1 to B8, for the examples of the present invention, regarding the cleanliness, all the steel products are evaluated as good (○) and excellent (◎), that is, are excellent high-cleanliness steels. By contrast, as can be seen from Tables B9 and B10, for all the conventional examples, the cleanliness is evaluated as failure (×), and the conventional steel products cannot be said to be clean steels.

For the heats wherein the W-RH treatment has been carried out, both the oxygen content and the predicted value of the maximum inclusion diameter are reduced by increasing $T_{SH}$ [(temperature at which molten steel is transferred to ladle furnace)−(melting point of molten steel)=$T_{SH}$)] to improve the cleanliness. For heats in which the W-RH treatment has been carried out, regarding the relationship of the refining time in the ladle furnace with the oxygen content and the predicted value of the maximum inclusion diameter, when the refining time is not less than about 25 min, the oxygen content and the predicted value of the maximum inclusion diameter are satisfactorily lowered. The predicted value of the maximum inclusion diameter, however, increases with increasing the refining time. The reason for this is considered as follows. With the elapse of time, the melt loss of refractories in the ladle refining furnace is increased, the equilibrium of the slag system is broken, for example, as a result of oxidation due to the contact with the air, and the level of the dissolved oxygen goes beyond the minimum level of dissolved oxygen. Further, the relationship of the amount of molten steel circulated/total amount of molten steel in the circulation-type vacuum degassing device with the oxygen content and the predicted value of the maximum inclusion diameter, the effect of enhancing the cleanliness increases with increasing the amount of molten steel circulated, and is substantially saturated when the amount of molten steel circulated/total amount of molten steel is not less than 15 times.

It was confirmed that reducing the oxygen content and the predicted value of the maximum inclusion diameter results in improved $L_{10}$ life. This indicates that steels produced by the process according to the present invention, which can reduce the oxygen content and the predicted value of the maximum inclusion diameter, have excellent fatigue strength properties such as excellent rolling fatigue life.

FIG. B1 is a diagram showing the oxygen content of products in 10 heats in the production process according to the present invention using W-RH treatment wherein, in the treatment of molten steel for steel SUJ 2, pre-degassing is performed before ladle refining and, in addition, after the ladle refining, the molten steel is degassed, and the oxygen content of products in 10 heats in the conventional process wherein the pre-deoxidation is not carried out. In FIGS. B1, B3, and B5, $A_1$ shows data on the adoption of only W-RH treatment according to the present invention, $A_2$ data on the W-RH treatment+high-temperature tapping according to the present invention, A3 data on the W-RH treatment+short-time LF, long-time RH treatment according to the present invention, $A_4$ data on the W-RH treatment+high-temperature tapping+short-time LF, long-time RH treatment according to the present invention, and conventional data on prior art wherein the pre-degassing is not carried out.

FIG. B2 is a diagram showing the oxygen content of products in 10 heats in the production process according to the present invention using W-RH treatment wherein, in the treatment of molten steel for steel SCM 435, pre-degassing is performed before ladle refining and, in addition, after the ladle refining, the molten steel is degassed, and the oxygen content of products in 10 heats in the conventional process wherein the pre-deoxidation is not carried out. In FIGS. B2, B4, and B6, $B_1$ shows data on the adoption of only W-RH treatment according to the present invention, $B_2$ data on the W-RH treatment+high-temperature tapping according to the present invention, $B_3$ data on the W-RH treatment+short-time LF, long-time RH treatment according to the present invention, $B_4$ data on the W-RH treatment+high-temperature tapping+short-time LF, long-time RH treatment according to the present invention, and conventional data on prior art wherein the pre-degassing is not carried out.

FIG. B3 is a diagram showing the maximum predicted inclusion diameter determined according to statistics of extreme values of products in 10 heats in the production process according to the present invention using W-RH treatment wherein, in the treatment of molten steel for steel SUJ 2, pre-degassing is performed before ladle refining and, in addition, after the ladle refining, the molten steel is degassed, and the maximum predicted inclusion diameter of products in 10 heats in the conventional process wherein the pre-degassing is not carried out.

FIG. B4 is a diagram showing the maximum predicted inclusion diameter determined according to statistics of extreme values of products in 10 heats in the production process according to the present invention using W-RH treatment wherein, in the treatment of molten steel for steel SCM 435, pre-degassing is performed before ladle refining and, in addition, after the ladle refining, the molten steel is degassed, and the maximum predicted inclusion diameter of products in 10 heats in the conventional process wherein the pre-degassing is not carried out.

FIG. B5 shows data on $L_{10}$ service life of products as determined by a thrust rolling service life test in 10 heats in the production process according to the present invention using W-RH treatment wherein, in the treatment of molten steel for steel SUJ 2, pre-degassing is performed before ladle refining and, in addition, after the ladle refining, the molten steel is degassed, and the $L_{10}$ service life of products in 10 heats in the conventional process wherein the pre-degassing is not carried out.

FIG. B6 shows data on $L_{10}$ service life as determined by a thrust rolling service life test in 10 heats in the production process according to the present invention using W-RH treatment wherein, in the treatment of molten steel for steel SCM 435, pre-degassing is performed before ladle refining and, in addition, after the ladle refining, the molten steel is degassed, and the $L_{10}$ service life of products in 10 heats in the conventional process wherein the pre-degassing is not carried out.

As is apparent from the test results, it was confirmed that, for both steel SUJ 2 and steel SCM 435, W-RH treatment, wherein pre-degassing is performed before ladle refining and, in addition, after the ladle refining, the molten steel is degassed, can significantly reduce both the oxygen content of the products and the predicted value of the maximum inclusion diameter and, according to the process of the present invention, the cleanliness is significantly improved and the $L_{10}$ life as determined by the thrust rolling service life test is significantly improved. The addition of treatments to the process, that is, the addition of only W-RH treatment according to the present invention, the addition of W-RH treatment+high-temperature tapping according to the present invention, and the addition of W-RH treatment+short-time LF, long-time RH treatment or the addition of W-RH treatment+high-temperature tapping+short-time LF, long-time RH treatment according to the present invention, can significantly improve all the oxygen content of products, the predicted value of the maximum inclusion diameter, and the $L_{10}$ life as determined by the thrust rolling service life test.

As is apparent from the foregoing description, according to the present invention, a large quantity of steel products having a very high level of cleanliness can be provided without use of a remelting process which incurs very high cost. This can realize the provision of high-cleanliness steels for use as steels for mechanical parts required to possess fatigue strength and fatigue life, particularly, for example, as steels for rolling bearings, steels for constant velocity joints, steels for gears, steels for continuously variable transmission of toroidal type, steels for mechanical structures for cold forging, tool steels, and spring steels, and processes for producing the same, that is, can offer unprecedented excellent effect.

EXAMPLE C

A molten steel was subjected to oxidizing refining in an arc melting furnace. In the same furnace, deoxidizers, such as aluminum and silicon, were then added to the refined molten steel to deoxidize the molten steel. The pre-deoxidized molten steel was transferred to a ladle furnace to perform ladle refining. The refined molten steel was then degassed in a circulation-type vacuum degassing device, followed by an ingot production process using casting. Steel products of JIS SUJ 2 and SCM 435 in 10 heats thus obtained were examined for the oxygen content of the products, the predicted value of the maximum inclusion diameter according to statistics of extreme values, and $L_{10}$ service life by a thrust-type rolling service life test. In the measurement of the predicted value of the maximum inclusion diameter, a test piece was taken off from a ϕ65 forged material, the observation of 100 $mm^2$ was carried out for 30 test pieces, and the maximum inclusion diameter in 30000 $mm^2$ was predicted according to statistics of extreme values. In the thrust-type rolling service life test, a test piece having a size of ϕ60×ϕ20×8.3T, which had been subjected to carburizing, quench hardening and tempering, was tested at a maximum hertz stress Pmax: 4900 MPa, followed by calculation to determine the $L_{10}$ service life.

An example of the operation of oxidizing refining in an arc melting furnace or a converter followed by deoxidation in the same furnace (hereinafter referred to as "in-furnace deoxidation"), that is, only in-furnace deoxidation, according to the present invention for 10 heats of steel SUJ 2 is shown in Table C1.

TABLE C1

| Operation | In-furnace deoxidation ($A_1$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Amount of deoxidizer (Si, Mn, Al, etc.) added in in-furnace deoxidation, kg/t | 3.7 | 2 | 4.6 | 4.3 | 3.6 | 5 | 5.9 | 4.9 | 4.4 | 4.9 |
| Tapping temp.: m.p. + ° C. | 59 | 67 | 70 | 52 | 55 | 71 | 69 | 69 | 58 | 69 |
| LF: Time, min | 59 | 57 | 53 | 54 | 57 | 57 | 54 | 58 | 53 | 53 |
| LF: Termination temp., ° C. | 1524 | 1520 | 1520 | 1526 | 1520 | 1520 | 1524 | 1521 | 1525 | 1521 |
| RH: Time, min | 23 | 23 | 23 | 23 | 23 | 23 | 23 | 23 | 23 | 23 |
| RH: Quantity of circulation, times | 7.1 | 6.3 | 7 | 6.1 | 7.1 | 6.8 | 6.7 | 5.9 | 6.7 | 7.2 |
| RH: Termination temp., ° C. | 1497 | 1499 | 1500 | 1494 | 1500 | 1494 | 1496 | 1498 | 1496 | 1499 |
| Casting temp., ° C. | 1478 | 1475 | 1477 | 1477 | 1475 | 1475 | 1476 | 1475 | 1475 | 1475 |
| Oxygen content of product, ppm | 4.8 | 5.2 | 5 | 5.6 | 4.6 | 4.8 | 4.6 | 5.7 | 5 | 5 |
| Number of inclusions of not less than 20 μm in 100 g of steel product | 29 | 40 | 32 | 25 | 30 | 26 | 37 | 27 | 27 | 34 |
| Maximum predicted diameter of inclusions, μm | 48 | 41.6 | 50 | 56 | 36.8 | 43.2 | 41.4 | 51.3 | 50 | 50 |
| $L_{10}$ (× $10^7$) | 2.5 | 1.9 | 2.4 | 2.6 | 2.1 | 2.7 | 2.2 | 1.8 | 2.2 | 1.8 |
| Results of evaluation | Δ | Δ | Δ | Δ | Δ | Δ | Δ | Δ | Δ | Δ |

Δ: Fair

An example of the operation of only in-furnace deoxidation according to the present invention for 10 heats of steel SCM 435 is shown in Table C2.

TABLE C2

| Operation | In-furnace deoxidation ($B_1$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Amount of deoxidizer(Si, Mn, Al, etc.) added in in-furnace deoxidation, kg/t | 5.4 | 5.7 | 2.3 | 2.7 | 4.7 | 2.5 | 5.1 | 5.3 | 5.4 | 5.1 |
| Tapping temp.: m.p. + ° C. | 60 | 65 | 66 | 54 | 63 | 64 | 57 | 61 | 60 | 51 |
| LF: Time, min | 60 | 54 | 54 | 52 | 58 | 52 | 54 | 56 | 57 | 56 |
| LF: Termination temp., ° C. | 1575 | 1572 | 1570 | 1570 | 1565 | 1572 | 1568 | 1566 | 1567 | 1572 |
| RH: Time, min | 20 | 20 | 20 | 24 | 21 | 23 | 21 | 20 | 21 | 23 |
| RH: Quantity of circulation, times | 6.7 | 6.2 | 6.5 | 6.6 | 6.3 | 7.3 | 7.1 | 6.9 | 5.7 | 5.8 |
| RH: Termination temp., ° C. | 1540 | 1540 | 1535 | 1534 | 1541 | 1539 | 1541 | 1536 | 1536 | 1533 |
| Casting temp., ° C. | 1520 | 1517 | 1521 | 1518 | 1515 | 1519 | 1520 | 1520 | 1514 | 1520 |
| Oxygen content of product, ppm | 8.5 | 8.3 | 8.1 | 7.1 | 7.0 | 7.3 | 8.0 | 8.1 | 6.7 | 6.9 |

TABLE C2-continued

| Operation | In-furnace deoxidation ($B_1$) | | | | | | | | | |
|---|---|---|---|---|---|---|---|---|---|---|
| No. | 1 | 2 | 3 | 4 | 5 | 6 | 7 | 8 | 9 | 10 |
| Number of inclusions of not less than 20 μm in 100 g of steel product | 35 | 28 | 25 | 32 | 29 | 27 | 37 | 32 | 38 | 33 |
| Maximum predicted diameter of inclusions, μm | 51.0 | 58.1 | 48.6 | 49.7 | 42.0 | 51.1 | 56.0 | 48.6 | 40.2 | 48.3 |
| $L_{10}$ ($\times 10^7$) | 1.5 | 1.8 | 2.1 | 1.8 | 2.3 | 1.7 | 1.6 | 2.5 | 2.2 | 2.3 |
| Results of evaluation | Δ | Δ | Δ | Δ | Δ | Δ | Δ | Δ | Δ | Δ |

Δ: Fair

An example of the operation of in-furnace deoxidation+ high-temperature tapping according to the present invention for 10 heats of steel SUJ 2 is shown in Table C3.

TABLE C3

| Operation | In-furnace deoxidation + tapping temp. ($A_2$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Amount of deoxidizer (Si, Mn, Al, etc.) added in in-furnace deoxidation, kg/t | 3.1 | 2 | 3.2 | 4.6 | 2 | 4.8 | 2.1 | 3 | 3.3 | 4.1 |
| Tapping temp.: m.p. + ° C. | 187 | 178 | 124 | 143 | 178 | 142 | 175 | 163 | 180 | 142 |
| LF: Time, min | 54 | 59 | 57 | 59 | 60 | 60 | 57 | 59 | 56 | 54 |
| LF: Termination temp., ° C. | 1523 | 1525 | 1522 | 1526 | 1525 | 1520 | 1524 | 1525 | 1522 | 1520 |
| RH: Time, min | 23 | 23 | 23 | 23 | 23 | 23 | 23 | 23 | 23 | 23 |
| RH: Quantity of circulation, times | 7.2 | 6.1 | 6.3 | 7 | 6.7 | 5.5 | 6.4 | 5.9 | 5.8 | 6 |
| RH: Termination temp., ° C. | 1501 | 1503 | 1500 | 1499 | 1496 | 1496 | 1498 | 1493 | 1492 | 1499 |
| Casting temp., ° C. | 1477 | 1476 | 1478 | 1475 | 1475 | 1475 | 1475 | 1478 | 1476 | 1478 |
| Oxygen content of product, ppm | 4.8 | 4.5 | 4.6 | 4.6 | 4.7 | 5.1 | 4.6 | 4.9 | 4.9 | 4.7 |
| Number of inclusions of not less than 20 μm in 100 g of steel product | 19 | 19 | 19 | 18 | 26 | 30 | 24 | 22 | 30 | 24 |
| Maximum predicted diameter of inclusions, μm | 19.2 | 22.5 | 18.4 | 23 | 23.5 | 25.5 | 18.4 | 19.6 | 24.5 | 18.8 |
| $L_{10}$ ($\times 10^7$) | 4.0 | 3.8 | 4.4 | 3.9 | 4.3 | 4.3 | 3.9 | 4.1 | 3.7 | 3.7 |
| Results of evaluation | ○ | ○ | ○ | ○ | ○ | ○ | ○ | ○ | ○ | ○ |

○: Good

An example of the operation of in-furnace deoxidation+ high-temperature tapping according to the present invention for 10 heats of steel SCM 435 is shown in Table C4.

TABLE C4

| Operation | In-furnace deoxidation + tapping temp. ($B_2$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Amount of deoxidizer (Si, Mn, Al, etc.) added in in-furnace deoxidation, kg/t | 5.2 | 5 | 6 | 6 | 1.9 | 5.8 | 4.8 | 4.8 | 3.4 | 2.7 |
| Tapping temp.: m.p. + ° C. | 124 | 140 | 123 | 109 | 112 | 117 | 123 | 116 | 104 | 143 |
| LF: Time, min | 54 | 45 | 55 | 49 | 48 | 52 | 48 | 45 | 45 | 54 |
| LF: Termination temp., ° C. | 1567 | 1566 | 1573 | 1575 | 1575 | 1572 | 1566 | 1565 | 1567 | 1567 |
| RH: Time, min | 22 | 24 | 22 | 24 | 20 | 21 | 24 | 21 | 23 | 24 |
| RH: Quantity of circulation, times | 7.2 | 6.5 | 5.6 | 6.8 | 6.7 | 5.9 | 6.4 | 7.2 | 6.3 | 6.5 |
| RH: Termination temp., ° C. | 1535 | 1539 | 1532 | 1538 | 1538 | 1536 | 1538 | 1533 | 1541 | 1541 |
| Casting temp., ° C. | 1513 | 1513 | 1520 | 1514 | 1518 | 1521 | 1521 | 1521 | 1518 | 1518 |
| Oxygen content of product, ppm | 7.2 | 6.8 | 7.0 | 7.0 | 6.4 | 6.8 | 7.5 | 7.3 | 6.5 | 6.1 |
| Number of inclusions of not less than 20 μm in 100 g of steel product | 30 | 16 | 19 | 23 | 29 | 30 | 30 | 21 | 25 | 26 |

TABLE C4-continued

| Operation | In-furnace deoxidation + tapping temp. ($B_2$) | | | | | | | | | |
|---|---|---|---|---|---|---|---|---|---|---|
| No. | 1 | 2 | 3 | 4 | 5 | 6 | 7 | 8 | 9 | 10 |
| Maximum predicted diameter of inclusions, μm | 39.0 | 38.1 | 37.1 | 38.5 | 37.8 | 39.8 | 39.0 | 39.4 | 33.8 | 32.9 |
| $L_{10}$ ($\times 10^7$) | 2.8 | 3.3 | 2.9 | 3.5 | 3.1 | 3.5 | 3.3 | 3.0 | 3.7 | 3.6 |
| Results of evaluation | ○ | ○ | ○ | ○ | ○ | ○ | ○ | ○ | ○ | ○ |

○: Good

An example of the operation of in-furnace deoxidation+ short LF, long RH according to the present invention for 10 heats of steel SUJ 2 is shown in Table C5.

TABLE C5

| Operation | In-furnace deoxidation + short LF, long RH ($A_3$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Amount of deoxidizer (Si, Mn, Al, etc.) added in in-furnace deoxidation, kg/t | 4.7 | 5 | 4.4 | 2.3 | 2.6 | 2 | 4.5 | 2.3 | 3.6 | 4.5 |
| Tapping temp.: m.p. + ° C. | 67 | 79 | 59 | 78 | 64 | 72 | 75 | 75 | 69 | 72 |
| LF: Time, min | 43 | 31 | 45 | 40 | 37 | 35 | 41 | 30 | 37 | 45 |
| LF: Termination temp., ° C. | 1546 | 1543 | 1545 | 1544 | 1545 | 1541 | 1544 | 1545 | 1546 | 1545 |
| RH: Time, min | 53 | 56 | 56 | 59 | 59 | 59 | 60 | 56 | 56 | 58 |
| RH: Quantity of circulation, times | 17.7 | 18.7 | 18.7 | 19.7 | 19.7 | 19.7 | 20.0 | 18.7 | 18.7 | 19.3 |
| RH: Termination temp., ° C. | 1508 | 1502 | 1508 | 1510 | 1505 | 1508 | 1509 | 1508 | 1506 | 1506 |
| Casting temp., ° C. | 1476 | 1477 | 1477 | 1478 | 1478 | 1478 | 1475 | 1477 | 1478 | 1475 |
| Oxygen content of product, ppm | 4.9 | 4.4 | 4.6 | 4.5 | 4.1 | 5.1 | 5 | 4.3 | 5 | 5.1 |
| Number of inclusions of not less than 20 μm in 100 g of steel product | 29 | 27 | 27 | 25 | 26 | 29 | 29 | 22 | 20 | 24 |
| Maximum predicted diameter of inclusions, μm | 18 | 18 | 22.8 | 21.1 | 20.8 | 20.5 | 18.2 | 20.6 | 22.6 | 18.7 |
| $L_{10}$ ($\times 10^7$) | 5.7 | 5.9 | 5.1 | 5.4 | 5.7 | 5.5 | 5.8 | 5.6 | 5.2 | 6.0 |
| Results of evaluation | ○ | ○ | ○ | ○ | ○ | ○ | ○ | ○ | ○ | ○ |

○: Good

An example of the operation of in-furnace deoxidation+ short LP, long RH according to the present invention for 10 heats of steel SCM 435 is shown in Table C6.

TABLE C6

| Operation | In-furnace deoxidation + short LF, Long RH ($B_3$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Amount of deoxidizer (Si, Mn, Al, etc.) added in in-furnace deoxidation, kg/t | 3.9 | 4.4 | 2.7 | 4.5 | 3.6 | 3 | 2.6 | 2.5 | 2.2 | 5.8 |
| Tapping temp.: m.p. + ° C. | 66 | 62 | 56 | 71 | 58 | 70 | 80 | 75 | 62 | 62 |
| LF: Time, min | 41 | 44 | 44 | 44 | 42 | 39 | 44 | 39 | 43 | 38 |
| LF: Termination temp., ° C. | 1581 | 1577 | 1584 | 1582 | 1577 | 1578 | 1579 | 1583 | 1583 | 1578 |
| RH: Time, min | 39 | 41 | 37 | 43 | 43 | 44 | 38 | 37 | 38 | 45 |
| RH: Quantity of circulation, times | 13.0 | 13.7 | 12.3 | 14.3 | 14.3 | 14.7 | 12.7 | 12.3 | 12.7 | 15.0 |
| RH: Termination temp., ° C. | 1540 | 1534 | 1536 | 1534 | 1539 | 1532 | 1537 | 1533 | 1540 | 1533 |
| Casting temp., ° C. | 1513 | 1513 | 1516 | 1514 | 1514 | 1515 | 1514 | 1514 | 1515 | 1514 |
| Oxygen content of product, ppm | 7 | 7.1 | 7.3 | 7.4 | 7.3 | 6.5 | 7 | 6.9 | 6.9 | 6.7 |
| Number of inclusions of not less than 20 μm in 100 g of steel product | 25 | 28 | 25 | 25 | 24 | 23 | 24 | 25 | 26 | 23 |
| Maximum predicted diameter of inclusions, μm | 23.7 | 20.7 | 24.6 | 22.7 | 22.9 | 23.7 | 22.8 | 21.7 | 24.8 | 24.6 |

TABLE C6-continued

| Operation | In-furnace deoxidation + short LF, Long RH ($B_3$) | | | | | | | | | |
|---|---|---|---|---|---|---|---|---|---|---|
| No. | 1 | 2 | 3 | 4 | 5 | 6 | 7 | 8 | 9 | 10 |
| $L_{10}$ ($\times 10^7$) | 4.5 | 5.1 | 4.4 | 4.8 | 4.9 | 5.1 | 4.8 | 4.8 | 4.3 | 5.7 |
| Results of evaluation | ○ | ○ | ○ | ○ | ○ | ○ | ○ | ○ | ○ | ○ |

○: Good

An example of the operation of in-furnace deoxidation+high-temperature tapping+short LF, long RH according to the present invention for 10 heats of steel SUJ 2 is shown in Table C7.

TABLE C7

| Operation | In-furnace deoxidation + tapping temp. + short LF, Long RH ($A_4$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Amount of deoxidizer (Si, Mn, Al, etc.) added in in-furnace deoxidation, kg/t | 2.8 | 2.4 | 3.6 | 5.6 | 3.1 | 1.5 | 2.1 | 5.9 | 3.1 | 1.6 |
| Tapping temp.: m.p. + ° C. | 133 | 149 | 162 | 164 | 119 | 138 | 122 | 163 | 137 | 143 |
| LF: Time Min | 39 | 36 | 36 | 42 | 43 | 37 | 38 | 30 | 42 | 37 |
| LF: Termination temp., ° C. | 1546 | 1543 | 1545 | 1544 | 1545 | 1541 | 1544 | 1545 | 1546 | 1545 |
| RH: Time, min | 53 | 53 | 53 | 53 | 56 | 52 | 57 | 53 | 52 | 56 |
| RH: Quantity of circulation, times | 17.7 | 18.3 | 17.8 | 17.1 | 18.7 | 17.9 | 18.4 | 17.5 | 16.7 | 19.3 |
| RH: Termination temp., ° C. | 1495 | 1497 | 1503 | 1502 | 1501 | 1503 | 1497 | 1503 | 1500 | 1503 |
| Casting temp., ° C. | 1475 | 1476 | 1476 | 1477 | 1475 | 1478 | 1476 | 1477 | 1478 | 1477 |
| Oxygen content of product, ppm | 4.8 | 4.2 | 4.7 | 4.7 | 4.4 | 4.1 | 4.4 | 4.8 | 4.5 | 4.2 |
| Number of inclusions of not less than20 μm in100 g of steel product | 14 | 6 | 8 | 9 | 6 | 14 | 13 | 8 | 15 | 14 |
| Maximum predicted diameter of inclusions, μm | 14.3 | 13.6 | 14.1 | 14.8 | 13.2 | 13.7 | 13.2 | 14.4 | 14.8 | 12.6 |
| $L_{10}$ ($\times 10^7$) | 7.8 | 9.0 | 8.7 | 8.7 | 10.6 | 9.7 | 10.8 | 9.4 | 9.8 | 10.0 |
| Results of evaluation | ◎ | ◎ | ◎ | ◎ | ◎ | ◎ | ◎ | ◎ | ◎ | ◎ |

◎: Excellent

An example of the operation of in-furnace deoxidation+high-temperature tapping+short LF, long RH according to the present invention for 10 heats of steel SCM 435 is shown in Table C8.

TABLE C8

| Operation | In-furnace deoxidation + tapping temp. + short LF, long RH ($B_4$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Amount of deoxidizer (Si, Mn, Al, etc.) added in in-furnace deoxidation, kg/t | 4.3 | 4 | 1.7 | 2.2 | 4.1 | 2.3 | 4.5 | 4.6 | 1.5 | 2.1 |
| Tapping temp.: m.p. + ° C. | 134 | 132 | 117 | 107 | 132 | 137 | 128 | 109 | 116 | 102 |
| LF: Time, min | 39 | 33 | 30 | 41 | 30 | 36 | 32 | 35 | 35 | 44 |
| LF: Termination temp., ° C. | 1577 | 1581 | 1577 | 1585 | 1584 | 1582 | 1582 | 1576 | 1582 | 1584 |
| RH: Time, min | 39 | 39 | 36 | 42 | 38 | 42 | 38 | 40 | 39 | 41 |
| RH: Quantity of circulation, times | 11.9 | 12.7 | 12.1 | 13.1 | 11.0 | 14.0 | 11.7 | 12.2 | 12.3 | 12.7 |
| RH: Termination temp., ° C. | 1534 | 1540 | 1534 | 1540 | 1541 | 1532 | 1539 | 1531 | 1538 | 1532 |
| Casting temp., ° C. | 1512 | 1513 | 1516 | 1513 | 1513 | 1515 | 1512 | 1516 | 1514 | 1518 |
| Oxygen content of product, ppm | 6.3 | 5.5 | 5.5 | 5.4 | 6.0 | 6.0 | 5.6 | 6.5 | 5.7 | 5.6 |
| Number of inclusions of not less than 20 μm in 100 g of steel product | 13 | 6 | 11 | 9 | 5 | 8 | 11 | 14 | 10 | 14 |
| Maximum predicted diameter of inclusions, μm | 24.0 | 23.5 | 23.3 | 22.5 | 23.9 | 23.7 | 23.8 | 24.6 | 23.7 | 23.6 |
| $L_{10}$ ($\times 10^7$) | 9.2 | 8.8 | 10.1 | 9.7 | 10.3 | 8.7 | 9.8 | 9.9 | 10.7 | 9.9 |
| Results of evaluation | ◎ | ◎ | ◎ | ◎ | ◎ | ◎ | ◎ | ◎ | ◎ | ◎ |

◎: Excellent

For comparison with the present invention, an example of the operation according to a prior art technique for steel SUJ 2 is shown in Table C9, and an example of the operation according to a prior art technique for SCM 435 is shown in Table C10.

TABLE C9

| Operation | Conventional operation (prior art) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Amount of deoxidizer (Si, Mn, Al, etc.) added in in-furnace deoxidation, kg/t | 57 | 72 | 58 | 60 | 74 | 75 | 51 | 65 | 62 | 68 |
| Tapping temp.: m.p. + ° C. | — | — | — | — | — | — | — | — | — | — |
| LF: Time, min | 61 | 61 | 63 | 61 | 62 | 62 | 61 | 63 | 61 | 63 |
| LF: Termination temp., ° C. | 1525 | 1524 | 1526 | 1525 | 1523 | 1524 | 1523 | 1520 | 1525 | 1520 |
| RH: Time, min | 23 | 23 | 23 | 23 | 23 | 23 | 23 | 23 | 23 | 23 |
| RH: Quantity of circulation, times | 5.7 | 6.7 | 7.1 | 6.5 | 6.2 | 5.7 | 7 | 5.5 | 6.8 | 6.2 |
| RH: Termination temp., ° C. | 1493 | 1502 | 1501 | 1497 | 1501 | 1501 | 1502 | 1503 | 1496 | 1499 |
| Casting temp., ° C. | 1477 | 1475 | 1475 | 1475 | 1475 | 1475 | 1476 | 1478 | 1478 | 1476 |
| Oxygen content of product, ppm | 5.4 | 5.1 | 5.1 | 6.1 | 5.8 | 5.9 | 5.8 | 5.9 | 5.2 | 6.2 |
| Number of inclusions of not less than 20 μm in 100 g of steel product | 59 | 56 | 54 | 65 | 48 | 41 | 50 | 47 | 45 | 49 |
| Maximum predicted diameter of inclusions, μm | 86.4 | 61.2 | 66.3 | 97.6 | 81.2 | 76.7 | 92.8 | 76.7 | 72.8 | 74.4 |
| $L_{10}$ ($\times 10^7$) | 1.9 | 2.4 | 2.4 | 1.8 | 1.9 | 3.4 | 1.9 | 2.2 | 2.0 | 2.2 |
| Results of evaluation | X | X | X | X | X | X | X | X | X | X |

X: Failure

TABLE C10

| Operation | Conventional operation (prior art) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Amount of deoxidizer (Si, Mn, Al, etc.) added in in-furnace deoxidation, kg/t | 61 | 54 | 69 | 50 | 74 | 58 | 58 | 69 | 64 | 54 |
| Tapping temp.: m.p. + ° C. | — | — | — | — | — | — | — | — | — | — |
| LF: Time, min | 62 | 63 | 61 | 61 | 61 | 63 | 63 | 63 | 61 | 61 |
| LF: Termination temp., ° C. | 1570 | 1574 | 1566 | 1572 | 1567 | 1569 | 1567 | 1569 | 1569 | 1570 |
| RH: Time, min | 23 | 23 | 23 | 20 | 21 | 23 | 21 | 23 | 23 | 24 |
| RH: Quantity of circulation, times | 6.8 | 7.5 | 7.0 | 8.3 | 6.2 | 6.0 | 7.4 | 8.0 | 7.3 | 6.7 |
| RH: Termination temp., ° C. | 1533 | 1538 | 1541 | 1540 | 1541 | 1533 | 1535 | 1534 | 1531 | 1531 |
| Casting temp., ° C. | 1517 | 1519 | 1520 | 1518 | 1517 | 1511 | 1516 | 1512 | 1512 | 1521 |
| Oxygen content of product, ppm | 7.6 | 9.2 | 9.2 | 8.8 | 6.9 | 8.3 | 6.9 | 8.3 | 9.4 | 9.1 |
| Number of inclusions of not less than 20 μm in 100 g of steel product | 49 | 54 | 59 | 52 | 42 | 57 | 56 | 53 | 53 | 42 |
| Maximum predicted diameter of inclusions μm | 68.4 | 82.8 | 73.6 | 70.4 | 55.2 | 83.0 | 55.2 | 83.0 | 84.6 | 91.0 |
| $L_{10}$ ($\times 10^7$) | 1.0 | 1.3 | 1.1 | 1.9 | 2.3 | 1.5 | 2.0 | 1.2 | 1.2 | 1.9 |
| Results of evaluation | X | X | X | X | X | X | X | X | X | X |

X: Failure

As is apparent from Tables C1 to C8, for steel products produced according to the present invention wherein a molten steel produced in an arc melting furnace or a converter is subjected to in-furnace deoxidation in the same furnace, is transferred to a ladle furnace to perform refining, and is then circulated through a circulation-type vacuum degassing device to degas the molten steel, for steels produced using a combination of in-furnace deoxidation+high-temperature tapping at a temperature above the conventional operation, i.e., melting point+at least 100° C., for steels produced using a combination of in-furnace deoxidation+short LF, long RH treatment wherein the operation time in the ladle furnace is shortened and, in addition, the RH quantity of circulation in circulation degassing (that is, amount of molten steel circulated/total amount of molten steel circulated) is increased to satisfactorily perform degassing for a long period of time, and for steels produced using a combination of all the above treatments, that is, a combination of the in-furnace deoxidation+high-temperature tapping+short LF, long RH, can realize, for both steel types, SUJ 2 and SCM 435, lowered oxygen content of products and significantly decreased number of inclusions having a size of not less than 20 μm. Further, as can be seen from Tables C1 to C8, for the examples of the present invention, regarding the cleanliness, all the steel products are evaluated as fair (Δ), good (○), or excellent (◎), that is, are excellent high-cleanliness steels. By contrast, as can be seen from Tables C9 and C10, for all the conventional examples, the cleanliness is evaluated as failure (×), and the conventional steel products cannot be said to be clean steels. In this connection, it should be noted that fair (Δ) is based on the comparison with good (○) and excellent (◎) and, as compared with steels produced according to the conventional process involving no tapping deoxidation which is evaluated as failure (×), the steels evaluated as fair (Δ) have much higher cleanliness.

For the heats wherein the in-furnace deoxidation has been carried out, both the oxygen content and the predicted value of the maximum inclusion diameter are reduced by increasing $T_{SH}$ [(temperature at which molten steel is transferred to ladle refining furnace)−(melting point of molten steel)=$T_{SH}$)] to improve the cleanliness. For the heats in which the in-furnace deoxidation has been carried out, regarding the relationship of the refining time in the ladle furnace with the oxygen content and the predicted value of the maximum inclusion diameter, when the refining time is not less than about 25 min, the oxygen content and the predicted value of the maximum inclusion diameter are satisfactorily lowered. The predicted value of the maximum inclusion diameter, however, increases with increasing the refining time. The reason for this is considered as follows. With the elapse of time, the melt loss of refractories in the ladle furnace is increased, the equilibrium of the slag system is broken, for example, as a result of oxidation due to the contact with the air, and the level of the dissolved oxygen goes beyond the minimum level of dissolved oxygen. Further, the relationship of the amount of molten steel circulated/total amount of molten steel in the circulation-type vacuum degassing device with the oxygen content and the predicted value of the maximum inclusion diameter, the effect of enhancing the cleanliness increases with increasing the amount of molten steel circulated, and is substantially saturated when the amount of molten steel circulated/total amount of molten steel is not less than 15 times.

It was confirmed that reducing the oxygen content and the predicted value of the maximum inclusion diameter results in improved $L_{10}$ life. This indicates that steels produced by the process according to the present invention, which can reduce the oxygen content and the predicted value of the maximum inclusion diameter, have excellent fatigue strength properties such as excellent rolling fatigue life.

FIG. C1 is a diagram showing the oxygen content of products in 10 heats in the production process according to the present invention wherein, in the treatment of a molten steel for steel SUJ 2, a molten steel is subjected to oxidizing refining in an arc melting furnace or a converter, a deoxidizer is then added to the same furnace before tapping to deoxidize the molten steel, and the deoxidized molten steel is transferred to a ladle furnace to perform ladle refining, and is then circulated through a circulation-type vacuum degassing device to degas the molten steel, and the oxygen content of products in 10 heats in the conventional process wherein the in-furnace deoxidation is not carried out. In FIGS. C1, C3, and C5, $A_1$ shows data on the adoption of only in-furnace deoxidation according to the present invention, $A_2$ data on in-furnace deoxidation+high-temperature tapping according to the present invention, $A_3$ data on in-furnace deoxidation+short-time LF, long-time RH treatment according to the present invention, $A_4$ data on in-furnace deoxidation+high-temperature tapping+short-time LF, long-time RH treatment according to the present invention, and conventional data on prior art.

FIG. C2 is a diagram showing the oxygen content of products in 10 heats in the production process according to the present invention wherein, in the treatment of a molten steel for steel SCM 435, a molten steel is subjected to oxidizing refining in an arc melting furnace or a converter, a deoxidizer is then added to the same furnace before tapping to deoxidize the molten steel, and the deoxidized molten steel is transferred to a ladle furnace to perform ladle refining, and is then circulated through a circulation-type vacuum degassing device to degas the molten steel, and the oxygen content of products in 10 heats in the conventional process wherein the in-furnace deoxidation is not carried out. In FIGS. 16, 18, and 20, $B_1$ shows data on the adoption of only in-furnace deoxidation according to the present invention, $B_2$ data on in-furnace deoxidation+high-temperature tapping according to the present invention, $B_3$ data on in-furnace deoxidation+short-time LF, long-time RH treatment according to the present invention, $B_4$ data on in-furnace deoxidation+high-temperature tapping+short-time LF, long-time RH treatment according to the present invention, and conventional data on the conventional process wherein the in-furnace deoxidation is not carried out.

FIG. C3 is a diagram showing the maximum predicted inclusion diameter of products determined according to statistics of extreme values in 10 heats in the production process of the present invention using in-furnace deoxidation in the treatment of a molten steel for steel SUJ 2 according to the present invention, and the maximum predicted inclusion diameter of products in 10 heats in the conventional process wherein the in-furnace deoxidation is not carried out.

FIG. C4 is a diagram showing the maximum predicted inclusion diameter of products determined according to statistics of extreme values in 10 heats in the production process of the present invention using in-furnace deoxidation in the treatment of a molten steel for steel SCM 435 according to the present invention, and the maximum predicted inclusion diameter of products in 10 heats in the conventional process wherein the in-furnace deoxidation is not carried out.

FIG. C5 shows data on $L_{10}$ service life of products as determined by a thrust rolling service life test in 10 heats in the production process of the present invention using in-furnace deoxidation in the treatment of a molten steel for steel SUJ 2 according to the present invention, and the $L_{10}$ service life of products in 10 heats in the conventional process wherein the in-furnace deoxidation is not carried out.

FIG. C6 shows data on $L_{10}$ service life of products as determined by a thrust rolling service life test in 10 heats in the production process of the present invention using in-furnace deoxidation in the treatment of a molten steel for steel SCM 435 according to the present invention, and the $L_{10}$ service life of products in 10 heats in the conventional process wherein the in-furnace deoxidation is not carried out.

As is apparent from the test results, it was confirmed that, for both steel SUJ 2 and steel SCM 435, the adoption of a method wherein a molten steel is subjected to oxidizing refining in an arc melting furnace or a converter, a deoxidizer is then added to the same furnace before tapping to deoxidize the molten steel, and the deoxidized molten steel is transferred to a ladle furnace to perform ladle refining, and is then circulated through a circulation-type vacuum degassing device to degas the molten steel, can significantly reduce both the oxygen content of the products and the predicted value of the maximum inclusion diameter and, according to the process of the present invention, the cleanliness is significantly improved and the $L_{10}$ life as determined by the thrust rolling service life test is significantly improved. The addition of treatments to the process, that is, the addition of only in-furnace deoxidation according to the present invention, the addition of in-furnace deoxidation+high-temperature tapping according to the present invention, and the addition of in-furnace deoxidation+short-time LF, long-time RH treatment according to the present invention or the addition of in-furnace deoxidation+high-temperature tapping+short-time LF, long-time RH treatment according to the present invention can significantly improve all the oxygen content of products, the predicted value of the maximum inclusion diameter, and the $L_{10}$ life as determined by the thrust rolling service life test.

As is apparent from the foregoing description, according to the present invention, a large quantity of steel products having a very high level of cleanliness can be provided without use of a remelting process which incurs very high cost. This can realize the provision of high-cleanliness steels for use as steels for mechanical parts required to possess fatigue strength and fatigue life, particularly, for example, as steels for rolling bearings, steels for constant velocity joints, steels for gears, and steels for continuously variable transmission of toroidal type, that is, can offer unprecedented excellent effect.

EXAMPLE D

A molten steel, which had been subjected to oxidizing smelting and produced by a melting process in an arc melting furnace was then transferred to a ladle furnace where the molten steel was subjected to ladle refining for a short period of time of not more than 60 min. Next, degassing was carried out for not less than 25 min. In particular, degassing was carried out in a circulation-type vacuum degassing device in such a manner that the amount of the molten steel circulated was not less than 8 times the total amount of the molten steel, followed by an ingot production process using casting. Steel products of JIS SUJ 2 and SCM 435 in 10 heats thus obtained were examined for the oxygen content of the products, the predicted value of the maximum inclusion diameter according to statistics of extreme values, and $L_{10}$ service life by a thrust-type rolling service life test. In the measurement of the predicted value of the maximum inclusion diameter, a test piece was taken off from a ϕ65 forged material, the observation of 100 $mm^2$ was carried out for 30 test pieces, and the maximum inclusion diameter in 30000 $mm^2$ was predicted according to statistics of extreme values. In the thrust-type rolling service life test, a test piece having a size of ϕ60×ϕ20×8.3T, which had been subjected to carburizing, quench hardening and tempering, was tested at a maximum hertz stress Pmax: 4900 MPa, followed by calculation to determine the $L_{10}$ service life.

An example of the operation of oxidizing refining in an arc melting furnace or a converter followed by the transfer of the molten steel to a ladle furnace where the ladle refining-was carried out for not more than 60 min and degassing was then carried out in a circulation-type vacuum degassing device for not less than 25 min (here this being referred to as "short-time LF, long-time RH or short LF or long RH"), that is, short-time LF, long-time RH, for 10 heats of steel SUJ 2 is shown in Table D1.

TABLE D1

| Operation | Short LF, long RH ($A_1$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Tapping temp.: m.p. + ° C. | 67 | 79 | 59 | 78 | 64 | 72 | 75 | 61 | 57 | 59 |
| LF: Time, min | 43 | 31 | 45 | 40 | 37 | 35 | 41 | 30 | 37 | 45 |
| LF: Termination temp., ° C. | 1546 | 1543 | 1545 | 1544 | 1526 | 1541 | 1544 | 1534 | 1530 | 1524 |
| RH: Time, min | 53 | 56 | 56 | 59 | 29 | 59 | 60 | 44 | 38 | 27 |
| RH: Quantity of circulation, times | 17.7 | 18.7 | 18.7 | 19.7 | 9.0 | 19.7 | 20.0 | 13.7 | 11.9 | 8.5 |
| RH: Termination temp., ° C. | 1508 | 1502 | 1508 | 1510 | 1505 | 1508 | 1509 | 1508 | 1506 | 1506 |
| Casting temp., ° C. | 1476 | 1477 | 1477 | 1478 | 1478 | 1478 | 1475 | 1477 | 1478 | 1475 |
| Oxygen content of product, ppm | 4.9 | 4.4 | 4.6 | 4.5 | 5.3 | 5.1 | 5 | 4.8 | 5.2 | 5 |
| Number of inclusions of not less than 20 μm in 100 g of steel product | 29 | 27 | 27 | 25 | 30 | 29 | 29 | 26 | 27 | 28 |
| Maximum predicted diameter of inclusions, μm | 18 | 18 | 22.8 | 21.1 | 22.9 | 20.5 | 18.2 | 20.6 | 20.1 | 21.7 |
| $L_{10}$ (× $10^7$) | 5.7 | 5.1 | 4.1 | 4.9 | 4.6 | 4.1 | 5.3 | 4.2 | 4.7 | 4.7 |
| Results of evaluation | ○ | ○ | ○ | ○ | ○ | ○ | ○ | ○ | ○ | ○ |

○: Good

An example of the operation of oxidizing μmelting in an arc melting furnace or a converter followed by the transfer of the molten steel to a ladle furnace where the ladle refining was carried out for not more than 60 min and degassing was then carried out in a circulation-type vacuum degassing device for not less than 25 min, that is, short-time LF, long-time RH treatment, for 10 heats of steel SCM 435 is shown in Table D2.

TABLE D2

| Operation | Short LF, long RH ($B_1$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Tapping temp.: m.p. + ° C. | 66 | 62 | 56 | 71 | 58 | 70 | 80 | 75 | 62 | 62 |
| LF: Time, min | 41 | 44 | 44 | 44 | 42 | 39 | 44 | 39 | 43 | 38 |
| LF: Termination temp., ° C. | 1581 | 1568 | 1584 | 1571 | 1577 | 1578 | 1579 | 1583 | 1572 | 1578 |
| RH: Time, min | 39 | 26 | 37 | 30 | 43 | 44 | 38 | 37 | 29 | 45 |

TABLE D2-continued

| Operation | Short LF, long RH ($B_1$) | | | | | | | | | |
|---|---|---|---|---|---|---|---|---|---|---|
| No. | 1 | 2 | 3 | 4 | 5 | 6 | 7 | 8 | 9 | 10 |
| RH: Quantity of circulation, times | 13.0 | 8.2 | 12.3 | 9.5 | 14.3 | 14.7 | 12.7 | 12.3 | 8.8 | 15.0 |
| RH: Termination temp., ° C. | 1540 | 1534 | 1536 | 1534 | 1539 | 1532 | 1537 | 1533 | 1540 | 1533 |
| Casting temp., ° C. | 1513 | 1513 | 1516 | 1514 | 1514 | 1515 | 1514 | 1514 | 1515 | 1514 |
| Oxygen content of product, ppm | 7 | 7.7 | 7.3 | 7.5 | 7.3 | 6.5 | 7 | 6.9 | 7.4 | 6.7 |
| Number of inclusions of not less than 20 μm in 100 g of steel product | 25 | 29 | 25 | 27 | 24 | 23 | 24 | 25 | 28 | 23 |
| Maximum predicted diameter of inclusions, μm | 23.7 | 24.8 | 24.6 | 24.1 | 22.9 | 23.7 | 22.8 | 21.7 | 24.2 | 24.6 |
| $L_{10}$ ($\times 10^7$) | 2.9 | 2.3 | 3.9 | 3.4 | 3.4 | 3.5 | 3.8 | 4.0 | 3.0 | 3.9 |
| Results of evaluation | ○ | ○ | ○ | ○ | ○ | ○ | ○ | ○ | ○ | ○ |

○: Good

An example of the operation of oxidizing refining in an arc melting furnace or a converter followed by tapping at a high temperature of at least 100° C. above the melting point of the molten steel (in this specification, this being referred to as "high-temperature tapping") to a ladle furnace where the ladle refining was carried out for not more than 60 min and degassing was then carried out in a circulation-type vacuum degassing device for not less than 25 min, that is, short-time LF, long-time RH treatment+high-temperature tapping, for 10 heats of steel SUJ 2 is shown in Table D3.

TABLE D3

| Operation | Tapping temp. + short LF, long RH ($A_2$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Tapping temp.: m.p. + ° C. | 133 | 149 | 162 | 164 | 119 | 138 | 122 | 163 | 137 | 143 |
| LF: Time, min | 39 | 36 | 36 | 42 | 43 | 37 | 38 | 30 | 42 | 37 |
| LF: Termination temp., ° C. | 1531 | 1543 | 1545 | 1537 | 1545 | 1541 | 1544 | 1533 | 1524 | 1531 |
| RH: Time, min | 41 | 53 | 53 | 48 | 56 | 52 | 57 | 38 | 29 | 35 |
| RH: Quantity of circulation, times | 12.6 | 18.3 | 17.8 | 15.7 | 18.7 | 17.9 | 18.4 | 11.5 | 9.0 | 10.5 |
| RH: Termination temp., ° C. | 1495 | 1497 | 1503 | 1502 | 1501 | 1503 | 1497 | 1503 | 1500 | 1503 |
| Casting temp., ° C. | 1475 | 1476 | 1476 | 1477 | 1475 | 1478 | 1476 | 1477 | 1478 | 1477 |
| Oxygen content of product, ppm | 4.8 | 4.2 | 4.7 | 4.7 | 4.4 | 4.1 | 4.4 | 4.8 | 4.5 | 4.2 |
| Number of inclusions of not less than 20 μm in 100 g of steel product | 14 | 6 | 8 | 9 | 6 | 14 | 13 | 8 | 15 | 14 |
| Maximum predicted diameter of inclusions, μm | 14.3 | 13.6 | 14.1 | 14.8 | 13.2 | 13.7 | 13.2 | 14.4 | 14.8 | 12.6 |
| $L_{10}$ ($\times 10^7$) | 8.0 | 10.6 | 9.6 | 8.8 | 9.0 | 9.4 | 9.7 | 7.3 | 7.7 | 10.9 |
| Results of evaluation | ◎ | ◎ | ◎ | ◎ | ◎ | ◎ | ◎ | ◎ | ◎ | ◎ |

◎: Excellent

An example of the operation of oxidizing refining in an arc melting furnace or a converter followed by tapping at a high temperature of at least 100° C. above the melting point of the molten steel to a ladle furnace where the ladle refining was carried out for not more than 60 min and degassing was then carried out in a circulation-type vacuum degassing device for not less than 25 min, that is, short-time LF, long-time RH treatment+high-temperature tapping, for 10 heats of steel SCM 435 is shown in Table D4.

TABLE D4

| Operation | Tapping temp. + short LF, long RH ($B_2$) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Tapping temp.: m.p. + ° C. | 134 | 132 | 117 | 107 | 132 | 137 | 128 | 109 | 116 | 102 |
| LF: Time, min | 39 | 33 | 30 | 41 | 30 | 36 | 32 | 35 | 35 | 44 |
| LF: Termination temp., ° C. | 1577 | 1581 | 1577 | 1585 | 1584 | 1582 | 1582 | 1576 | 1570 | 1569 |
| RH: Time, min | 39 | 39 | 36 | 42 | 38 | 42 | 38 | 33 | 28 | 29 |

TABLE D4-continued

| Operation | Tapping temp. + short LF, long RH ($B_2$) | | | | | | | | | |
|---|---|---|---|---|---|---|---|---|---|---|
| No. | 1 | 2 | 3 | 4 | 5 | 6 | 7 | 8 | 9 | 10 |
| RH: Quantity of circulation, times | 11.9 | 12.7 | 12.1 | 13.1 | 11.0 | 14.0 | 11.7 | 11.0 | 8.9 | 9.6 |
| RH: Termination temp., ° C. | 1534 | 1540 | 1534 | 1540 | 1541 | 1532 | 1539 | 1531 | 1538 | 1532 |
| Casting temp., ° C. | 1512 | 1513 | 1516 | 1513 | 1513 | 1515 | 1512 | 1516 | 1514 | 1518 |
| Oxygen content of product, ppm | 6.3 | 5.5 | 5.5 | 5.4 | 6.0 | 6.0 | 5.6 | 6.5 | 6.8 | 6.3 |
| Number of inclusions of not less than 20 μm in 100 g of steel product | 13 | 6 | 11 | 9 | 5 | 8 | 11 | 14 | 14 | 14 |
| Maximum predicted diameter of inclusions, μm | 24.0 | 23.5 | 23.3 | 22.5 | 23.9 | 23.7 | 23.8 | 24.6 | 23.7 | 23.6 |
| $L_{10}$ ($\times 10^7$) | 7.2 | 9.9 | 10.0 | 8.7 | 7.4 | 8.1 | 8.6 | 9.7 | 9.3 | 9.3 |
| Results of evaluation | ◎ | ◎ | ◎ | ◎ | ◎ | ◎ | ◎ | ◎ | ◎ | ◎ |

◎: Excellent

For comparison with the present invention, an example of the operation according to a prior art technique for steel SUJ 2 is shown in Table D5, and an example of the operation according to a prior art technique for steel SCM 435 is shown in Table D6.

TABLE D5

| Operation | Conventional operation (prior art) | | | | | | | | | |
|---|---|---|---|---|---|---|---|---|---|---|
| No. | 1 | 2 | 3 | 4 | 5 | 6 | 7 | 8 | 9 | 10 |
| Type of steel | SUJ 2 | SUJ 2 | SUJ 2 | SUJ 2 | SUJ 2 | SUJ 2 | SUJ 2 | SUJ 2 | SUJ 2 | SUJ 2 |
| Tapping temp.: m.p. + ° C. | 70 | 70 | 79 | 58 | 77 | 76 | 73 | 55 | 58 | 60 |
| LF: Time, min | 74 | 74 | 68 | 75 | 64 | 71 | 66 | 70 | 65 | 74 |
| LF: Termination temp., ° C. | 1523 | 1524 | 1524 | 1524 | 1523 | 1520 | 1522 | 1520 | 1523 | 1524 |
| RH: Time, min | 20 | 21 | 21 | 21 | 20 | 18 | 20 | 19 | 23 | 22 |
| RH: Quantity of circulation, times | 6.7 | 7.0 | 7.0 | 7.0 | 6.7 | 6.0 | 6.7 | 6.3 | 7.7 | 7.3 |
| RH: Termination temp., ° C. | 1494 | 1497 | 1492 | 1493 | 1498 | 1498 | 1492 | 1499 | 1497 | 1499 |
| Casting temp., ° C. | 1476 | 1477 | 1478 | 1476 | 1475 | 1478 | 1478 | 1478 | 1475 | 1476 |
| Oxygen content of product, ppm | 5.7 | 5.7 | 5.8 | 5.2 | 6 | 5.1 | 5.3 | 5.2 | 5.6 | 6.3 |
| Number of inclusions of not less than 20 μm in 100 g of steel product | 47 | 44 | 42 | 54 | 46 | 53 | 44 | 45 | 44 | 43 |
| Maximum predicted diameter of inclusions, μm | 76.3 | 77.2 | 68.2 | 68.5 | 82.3 | 63.9 | 76.5 | 91.3 | 70.3 | 68.5 |
| $L_{10}$ ($\times 10^7$) | 3.5 | 2.4 | 1.8 | 2.7 | 2.9 | 3.8 | 4.1 | 3.1 | 2.4 | 1.8 |
| Results of evaluation | X | X | X | X | X | X | X | X | X | X |

X: Failure

TABLE D6

| Operation | Conventional operation (prior art) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Tapping temp.: m.p. + ° C. | 61 | 62 | 60 | 61 | 56 | 57 | 63 | 62 | 62 | 63 |
| LF: Time, min | 63 | 64 | 66 | 64 | 68 | 67 | 71 | 62 | 75 | 69 |
| LF: Termination temp., ° C. | 1565 | 1567 | 1569 | 1572 | 1565 | 1569 | 1566 | 1566 | 1565 | 1571 |
| RH: Time, min | 19 | 19 | 18 | 21 | 18 | 23 | 19 | 20 | 18 | 20 |
| RH: Quantity of circulation, times | 6.3 | 6.3 | 6.0 | 7.0 | 6.0 | 7.7 | 6.3 | 6.7 | 6.0 | 6.7 |
| RH: Termination temp., ° C. | 1535 | 1534 | 1536 | 1532 | 1541 | 1540 | 1535 | 1541 | 1539 | 1535 |
| Casting temp., ° C. | 1516 | 1519 | 1511 | 1518 | 1515 | 1516 | 1515 | 1517 | 1515 | 1512 |
| Oxygen content of product, ppm | 9.5 | 6.5 | 5.3 | 5.5 | 6 | 6.3 | 6.3 | 6.3 | 5.7 | 5.2 |
| Number of inclusions of not less than 20 μm in 100 g of steel product | 51 | 49 | 48 | 58 | 60 | 43 | 56 | 47 | 43 | 54 |
| Maximum predicted diameter of inclusions, μm | 58.3 | 60.4 | 65.8 | 72.6 | 69.7 | 75.3 | 78.7 | 61 | 78.6 | 83.9 |

TABLE D6-continued

| Operation | Conventional operation (prior art) | | | | | | | | | |
|---|---|---|---|---|---|---|---|---|---|---|
| No. | 1 | 2 | 3 | 4 | 5 | 6 | 7 | 8 | 9 | 10 |
| $L_{10}$ ($\times 10^7$) | 0.9 | 1.8 | 2.3 | 1.1 | 1.7 | 1.4 | 1.4 | 2.4 | 2.3 | 1.7 |
| Results of evaluation | X | X | X | X | X | X | X | X | X | X |

X: Failure

As is apparent from Tables D1 to D4, for steel products produced using short LF, long RH treatment according to the present invention wherein a molten steel produced in an arc melting furnace or a converter is transferred to a ladle furnace to perform ladle refining for a short period of time, i.e., not more than about 60 min, and is then circulated through a circulation-type vacuum degassing device to increase the RH circulation quantity (that is, amount of molten metal circulated/total amount of molten metal) and to perform degassing for a long period of time, i.e., not less than 25 min and for steels producing using a combination of short LF, long RH treatment+high-temperature tapping at a temperature above the conventional operation, i.e., melting point+at least 100° C., for both steel types, SUJ 2 and SCM 435, the oxygen content of the products is small and, in addition, the number of inclusions having a size of not less than 20 μm is significantly decreased. As can be seen from Tables D1 to D4, for the examples of the present invention, all the steel products are evaluated as good (○) or excellent (◎), that is, are excellent high-cleanliness steels. By contrast, as can be seen from Tables D5 and D6, for all the conventional examples, the cleanliness is evaluated as failure (×), and the conventional steel products cannot be said to be clean steels.

For the heats wherein a molten steel is subjected to oxidizing μmelting in an arc melting furnace or a converter, both the oxygen content, and the predicted value of the maximum inclusion diameter are reduced by increasing $T_{SH}$ [(temperature at which molten steel is transferred to ladle furnace)−(melting point of molten steel)=$T_{SH}$)] to improve the cleanliness. For the heats, regarding the relationship of the refining time in the ladle furnace with the oxygen content and the predicted value of the maximum inclusion diameter, when the refining time is not more than 60 min, for example, is short and about 25 min, the oxygen content and the predicted value of the maximum inclusion diameter are satisfactorily lowered. The predicted value of the maximum inclusion diameter, however, increases with increasing the refining time. The reason for this is considered as follows. With the elapse of time, the melt loss of refractories in the ladle furnace is increased, the equilibrium of the slag system is broken, for example, as a result of oxidation due to the contact with the air, and the level of the dissolved oxygen goes beyond the minimum level of dissolved oxygen. Further, the relationship of the amount of molten steel circulated/total amount of molten steel in the circulation-type vacuum degassing device with the oxygen content and the predicted value of the maximum inclusion diameter, the effect of enhancing the cleanliness increases with increasing the amount of molten steel circulated, that is, with increasing the degassing time, and is substantially saturated when the amount of molten steel circulated/total amount of molten steel is not less than 15 times.

It was confirmed that reducing the oxygen content and the predicted value of the maximum inclusion diameter results in improved $L_{10}$ life. This indicates that steels produced by the process according to the present invention, which can reduce the oxygen content and the predicted value of the maximum inclusion diameter, have excellent fatigue strength properties such as excellent rolling fatigue life.

FIG. D1 is a diagram showing the oxygen content of products in 10 heats in the production process according to the present invention wherein, in the treatment of a molten steel for steel SUJ 2, a molten steel, which had been subjected to oxidizing refining and produced by a melting process in an arc melting furnace or a converter, is transferred to a ladle furnace to perform ladle refining for a short period of time and is then subjected to circulation-type vacuum degassing for a long period of time, and the oxygen content of products in 10 heats in the conventional process wherein a molten steel, which had been subjected to oxidizing refining and produced by a melting process in an arc melting furnace or a converter, is transferred to a ladle furnace to perform ladle refining for a long period of time and is then subjected to circulation-type vacuum degassing for a short period of time. In FIGS. D1, D3, and D5, $A_1$ shows data on the adoption of short-time LF, long-time RH treatment according to the present invention, $A_2$ data on the adoption of a combination of high-temperature tapping+short-time LF, long-time RH treatment according to the present invention, and conventional data on the conventional process.

FIG. D2 is a diagram showing the oxygen content of products in 10 heats in the production process according to the present invention wherein, in the treatment of a molten steel for steel SCM 435, a molten steel, which had been subjected to oxidizing refining and produced by a melting process in an arc melting furnace or a converter, is transferred to a ladle furnace to perform ladle refining for a short period of time and is then subjected to circulation-type vacuum degassing for a long period of time, and the oxygen content of products in 10 heats in the conventional process wherein a molten steel, which had been subjected to oxidizing refining and produced by a melting process in an arc melting furnace or a converter, is transferred to a ladle furnace to perform ladle refining for a long period of time and is then subjected to circulation-type vacuum degassing for a short period of time. In FIGS. D1, D3, and D5, $A_1$ shows data on the adoption of short-time LF, long-time RH treatment according to the present invention, $A_2$ data on the adoption of a combination of high-temperature tapping+short-time LF, long-time RH treatment according to the present invention, and conventional data on the conventional process.

FIG. D3 is a diagram showing the maximum predicted inclusion diameter determined according to statistics of extreme values in products in 10 heats in the production process according to the present invention wherein, in the treatment of a molten steel for steel SUJ 2, the process according to the present invention is carried out, and the maximum predicted inclusion diameter determined according to statistics of extreme values in products in 10 heats in the conventional process wherein, in the treatment of a molten steel for steel SUJ 2, long-time LF, short-time RH treatment is carried out.

FIG. D4 is a diagram showing the maximum predicted inclusion diameter determined according to statistics of extreme values in products in 10 heats in the production process according to the present invention wherein, in the treatment of a molten steel for steel SCM 435, the process according to the present invention is carried out, and the maximum predicted inclusion diameter determined according to statistics of extreme values in products in 10 heats in the conventional process wherein, in the treatment of a molten steel for steel SCM 435, long-time LF, short-time RH treatment is carried out.

FIG. D5 shows data on $L_{10}$ life as determined by a thrust rolling service life test in products in 10 heats in the production process according to the present invention wherein, in the treatment of a molten steel for steel SUJ 2, the process according to the present invention is carried out, and the $L_{10}$ life as determined by the thrust rolling service life test in products in 10 heats in the conventional process wherein, in the treatment of a molten steel for steel SUJ 2, long-time LF, short-time RH treatment is carried out.

FIG. D6 shows data on $L_{10}$ life as determined by a thrust rolling service life test in products in 10 heats in the production process according to the present invention wherein, in the treatment of a molten steel for steel SCM 435, the process according to the present invention is carried out, the $L_{10}$ life as determined by the thrust rolling service life test in products in 10 heats in the conventional process wherein, in the treatment of a molten steel for steel SCM 435, long-time LF, short-time RH treatment is carried out.

As is apparent from the test results, it was confirmed that, for both steel SUJ 2 and steel SCM 435, the process, in which a molten steel, which had been subjected to oxidizing refining and produced by a melting process in an arc melting furnace or a converter, is transferred to a ladle furnace to perform ladle refining for a short period of time and is then circulated through a circulation-type vacuum degassing device to perform degassing for a long period of time, can significantly reduce the oxygen content of the products, and the predicted value of the maximum inclusion diameter and, according to the process of the present invention, the cleanliness is significantly improved and the $L_{10}$ life as determined by the thrust rolling service life test is significantly improved. The addition of treatments to the process, that is, the addition of short-time LF, long-time RH treatment according to the present invention, and the addition of high-temperature tapping+short-time LF, long-time RH treatment according to the present invention, can significantly improve all the oxygen content of products, the predicted value of the maximum inclusion diameter, and the $L_{10}$ life as determined by the thrust rolling service life test.

As is apparent from the foregoing description, the present invention can provide a large quantity of steel products having a very high level of cleanliness without use of a remelting process which incurs very high cost. This can realize the provision of high-cleanliness steels for use as steels for mechanical parts required to possess fatigue strength, fatigue life, and quietness, particularly, for example, as steels for rolling bearings, steels for constant velocity joints, steels for gears, steels for continuously variable transmission of toroidal type, steels for mechanical structures for cold forging, tool steels, and spring steels, and processes for producing the same, that is, can offer unprecedented excellent effect.

EXAMPLE E

A molten steel of JIS SCM 435, which had been subjected to oxidizing refining and produced by a melt process in an arc furnace, was transferred to a ladle furnace provided with an electromagnetic induction stirrer where 50 to 80 min in total of ladle refining (stirring by gas for a short time in an inert atmosphere+electromagnetic stirring) was carried out. Next, degassing was carried out for 20 to 30 min. In particular, degassing was carried out in a circulation-type degassing device in such a manner that the amount of the molten steel circulated was not less than 12 times the total amount of the molten steel, followed by an ingot production process using casting to produce steel products of SCM 435 in 10 heats. For comparison, a molten steel of JIS SCM 435, which had been subjected to oxidizing refining and produced by a melt process in the same manner as described above in an arc furnace through the conventional operation, was transferred to a ladle furnace where the molten steel was stirred by gas for 35 to 50 min to perform ladle refining. Next, circulation-type degassing was carried out for not more than 25 min, followed by an ingot production process using casting to produce steel products of SCM 435 in 10 heats. These products thus obtained were examined for the oxygen content of the products, the predicted value of the maximum inclusion diameter according to statistics of extreme values, and $L_{10}$ service life by a thrust-type rolling service life test. In the measurement of the predicted value of the maximum inclusion diameter, a test piece was taken off from a $\phi 65$ forged material, the observation of 100 $mm^2$ was carried out for 30 test pieces, and the maximum inclusion diameter in 30000 $mm^2$ was predicted according to statistics of extreme values. In the thrust-type rolling service life test, a test piece having a size of $\phi 60 \times \phi 20 \times 8.3T$, which had been subjected to carburizing, quench hardening and tempering, was tested at a maximum hertz stress Pmax: 4900 MPa, followed by calculation to determine the $L_{10}$ service life.

An example of the operation of the present invention and test results are shown in Table E1, and a comparative example of the conventional operation and test results are shown in Table E2.

TABLE E1

| Operation | Out-furnace (ladle) refining by (short-time stirring by gas + electromagnetic stirring) | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Out-furnace refining furnace: Time, min | 55 | 76 | 70 | 78 | 59 | 65 | 68 | 53 | 69 | 77 |
| Out-furnace refining furnace: Termination temp., ° C. | 1577 | 1581 | 1577 | 1585 | 1584 | 1582 | 1582 | 1576 | 1582 | 1584 |
| RH: Time, min | 28 | 21 | 24 | 22 | 21 | 28 | 26 | 25 | 25 | 28 |
| RH: Quantity of circulation, times | 9.3 | 7.0 | 8.0 | 7.3 | 7.0 | 9.3 | 8.7 | 8.3 | 8.3 | 9.3 |

TABLE E1-continued

| Operation | Out-furnace (ladle) refining by (short-time stirring by gas + electromagnetic stirring) | | | | | | | | | |
|---|---|---|---|---|---|---|---|---|---|---|
| No. | 1 | 2 | 3 | 4 | 5 | 6 | 7 | 8 | 9 | 10 |
| RH: Termination temp., ° C. | 1534 | 1540 | 1534 | 1540 | 1541 | 1532 | 1539 | 1531 | 1538 | 1532 |
| Casting temp., ° C. | 1512 | 1513 | 1516 | 1513 | 1513 | 1515 | 1512 | 1516 | 1514 | 1518 |
| Oxygen content of product, ppm | 6.3 | 5.5 | 5.5 | 5.4 | 6.0 | 6.0 | 6.6 | 6.5 | 5.7 | 5.6 |
| Number of inclusions of not less than 20 μm in 100 g of steel product | 13 | 6 | 11 | 9 | 5 | 8 | 11 | 14 | 10 | 14 |
| Maximum predicted diameter of inclusions, μm | 30.2 | 25.3 | 26.4 | 24.3 | 28.8 | 27.0 | 26.9 | 30.6 | 26.2 | 25.8 |
| $L_{10}$ ($\times 10^7$) | 9.2 | 10.0 | 8.4 | 8.9 | 11.3 | 10.7 | 10.8 | 9.4 | 9.8 | 9.3 |
| Results of evaluation | ◎ | ◎ | ◎ | ◎ | ◎ | ◎ | ◎ | ◎ | ◎ | ◎ |

◎: Excellent

TABLE E2

| Operation | Out-furnace (ladle) refining by short-time stirring by gas | | | | | | | | | |
|---|---|---|---|---|---|---|---|---|---|---|
| No. | 1 | 2 | 3 | 4 | 5 | 6 | 7 | 8 | 9 | 10 |
| Type of steel | SCM 435 | SCM 435 | SCM 435 | SCM 435 | SCM 435 | SCM 435 | SCM 435 | SCM 435 | SCM 435 | SCM 435 |
| Out-furnace refining furnace: Time, min | 35 | 45 | 48 | 38 | 42 | 47 | 42 | 39 | 48 | 44 |
| Out-furnace refining furnace: Termination temp., ° C. | 1570 | 1574 | 1566 | 1572 | 1567 | 1569 | 1567 | 1569 | 1569 | 1570 |
| RH: Time, min | 24 | 23 | 21 | 23 | 23 | 23 | 23 | 23 | 21 | 23 |
| RH: Quantity of circulation, times | 6.7 | 7.5 | 6.2 | 7.3 | 7.0 | 6.8 | 6.0 | 8.0 | 7.4 | 8.3 |
| RH: Termination temp., ° C. | 1531 | 1538 | 1541 | 1531 | 1541 | 1533 | 1533 | 1534 | 1535 | 1540 |
| Casting temp., ° C. | 1521 | 1519 | 1517 | 1512 | 1520 | 1517 | 1511 | 1512 | 1516 | 1518 |
| Oxygen content of product, ppm | 9.1 | 9.2 | 6.9 | 9.4 | 9.2 | 7.6 | 8.3 | 8.3 | 6.9 | 8.8 |
| Number of inclusions of not less than 20 μm in 100 g of steel product | 42 | 54 | 42 | 53 | 59 | 49 | 57 | 53 | 56 | 52 |
| Maximum predicted diameter of inclusions, μm | 91.0 | 82.8 | 55.2 | 84.6 | 73.6 | 68.4 | 83.0 | 83.0 | 55.2 | 70.4 |
| $L_{10}$ ($\times 10^7$) | 2.0 | 1.7 | 2.6 | 2.1 | 1.0 | 1.1 | 1.8 | 1.4 | 2.2 | 1.7 |
| Results of evaluation | X | X | X | X | X | X | X | X | X | X |

X: Failure

As is apparent from Table E1, for SCM 435 steel products of 10 heats produced according to the process of the present invention, wherein a molten steel of JIS SCM 435, which has been subjected to oxidizing refining and produced by a melt process in an arc furnace, is transferred to a ladle furnace provided with an electromagnetic induction stirrer, where 50 to 80 min in total of ladle refining (stirring by gas for a short time in an inert atmosphere+electromagnetic stirring) is carried out, and the molten steel is degassed for 20 to 30 min, in particular, degassing is carried out in a circulation-type degassing device in such a manner that the amount of the molten steel circulated is not less than 12 times the total amount of the molten steel, followed by an ingot production process using casting, that is, steel Nos. 1 to 10, the oxygen content of the product is 5.4 to 6.6 ppm, the number of inclusions having a size of not less than 20 μm per 100 g of the steel product is 5 to 14, and the maximum predicted inclusion diameter is 30.6 μm. That is, these products are very clean steels. Further, these products have very highly improved $L_{10}$ life. For the overall evaluation, all of these products are evaluated as very good (◎).

By contrast, as can be seen in Table E2, for SCM 435 steel products of 10 heats produced according to the comparative conventional process, wherein a molten steel of JIS SCM 435, which has been subjected to oxidizing refining and produced by a melt process in an arc furnace, is transferred to a ladle furnace where the molten steel is stirred by gas for 35 to 50 min to perform ladle refining, and the molten steel is subjected to circulation-type degassing for not more than 25 min, followed by an ingot production process using casting, the oxygen content of the product is slightly larger than that in the present invention although the oxygen content is relatively low. Further, the number of inclusions having a size of not less than 20 μm per 100 g of the steel product is much larger than that in the present invention and is 42 to 59, and the maximum predicted inclusion diameter is also larger than that in the present invention and is 55.2 to 91.0 μm. Further, the $L_{10}$ life is also lower than that in the present invention and is one-tenth to one-fifth of that in the present invention. All the comparative steels are evaluated as failure (×).

The above examples demonstrate that the process according to the present invention can lower the oxygen content and the predicted value of the maximum inclusion diameter, and the $L_{10}$ life is improved. This indicates that steels produced according to the process of the present invention, which can reduce the oxygen content and the predicted value of the maximum inclusion diameter, have excellent fatigue strength properties, such as excellent rolling fatigue service life.

As is apparent from the foregoing description, the present invention can provide a large quantity of steel products having a very high level of cleanliness without use of a remelting process which incurs very high cost. This can realize the provision of high-cleanliness steels for use as steels for mechanical parts required to possess fatigue strength, fatigue life, and quietness, particularly, for example, as steels for rolling bearings, steels for constant velocity joints, steels for gears, steels for continuously variable transmission of troidal type, steels for mechanical structures for cold forging, tool steels, and spring steels, and processes for producing the same, that is, can offer unprecedented excellent effect.

The invention claimed is:

1. A process for producing a high-cleanliness steel, comprising the steps of:

(a) producing a molten steel by oxidizing refining in an arc melting furnace or a converter;

(b) transferring the molten steel to a ladle;

(c) circulation vacuum degassing the molten steel in the ladle in a first circulation vacuum degassing step;

(d) transferring the degassed molten steel to a ladle furnace;

(e) reduction refining the molten steel in the ladle furnace; and (f) circulating the refined molten steel through a circulation vacuum degassing device to perform a second circulation vacuum degassing step to further degas the molten steel.

2. The process according to claim 1, wherein the molten steel is transferred to the ladle furnace at a tapping temperature of at least 100° C. above a melting point of the steel.

3. The process according to claim 1, wherein the refining in the ladle furnace is carried out for not more than 60 minutes, and the second degassing step is carried out for not less than 25 minutes.

* * * * *

UNITED STATES PATENT AND TRADEMARK OFFICE

CERTIFICATE OF CORRECTION

PATENT NO. : 7,396,378 B2
APPLICATION NO. : 10/297313
DATED : July 8, 2008
INVENTOR(S) : Sato et al.

It is certified that error appears in the above-identified patent and that said Letters Patent is hereby corrected as shown below:

Column 9, Lines 58-59, the title "BEST MODE FOR CRYING OUT THE INVENTION" should read: -- BEST MODE FOR CARRYING OUT THE INVENTION --

COLUMN 58, Lines 4-5, "Figs. 16, 18, and 20" should read -- Figs. 3D, 3F, and 4B --

Signed and Sealed this

Ninth Day of December, 2008

JON W. DUDAS
*Director of the United States Patent and Trademark Office*